US007935876B1

(12) United States Patent
West

(10) Patent No.: US 7,935,876 B1
(45) Date of Patent: May 3, 2011

(54) METHOD AND APPARATUS FOR STRING LOAD REDUCTION AND REAL-TIME PITCH ALTERATION ON STRINGED INSTRUMENTS

(76) Inventor: John Raymond West, Guerneville, CA (US)

( * ) Notice: Subject to any disclaimer, the term of this patent is extended or adjusted under 35 U.S.C. 154(b) by 0 days.

(21) Appl. No.: 12/009,233

(22) Filed: Jan. 16, 2008

Related U.S. Application Data

(60) Provisional application No. 60/880,789, filed on Jan. 16, 2007.

(51) Int. Cl.
*G10D 3/14* (2006.01)

(52) U.S. Cl. ..... 84/304; 84/306; 84/454; 84/200

(58) Field of Classification Search ..... 84/454, 84/200, 304, 306
See application file for complete search history.

(56) References Cited

U.S. PATENT DOCUMENTS

| | | | | | |
|---|---|---|---|---|---|
| 504,086 | A | * | 8/1893 | Johnson | 74/55 |
| 2,164,309 | A | * | 7/1939 | Collins | 192/139 |
| 2,250,393 | A | * | 7/1941 | Rado | 180/406 |
| 2,706,415 | A | * | 4/1955 | Curtis | 74/54 |
| 2,771,808 | A | | 11/1956 | Jenkins | |
| 3,353,416 | A | * | 11/1967 | Flint et al. | 74/10.6 |
| 3,452,635 | A | * | 7/1969 | Sebers et al. | 84/312 P |
| 3,762,523 | A | * | 10/1973 | Thorsby | 192/139 |
| 3,833,782 | A | | 9/1974 | Bartel | |
| 4,061,291 | A | * | 12/1977 | Cunningham | 242/375.3 |
| 4,080,864 | A | | 3/1978 | Jackson | |
| 4,100,832 | A | | 7/1978 | Peterson | |
| 4,106,387 | A | * | 8/1978 | Alifano | 84/312 P |
| 4,141,271 | A | | 2/1979 | Mullen | |
| 4,171,661 | A | | 10/1979 | Rose | |
| 4,426,907 | A | * | 1/1984 | Scholz | 84/454 |
| 4,491,050 | A | | 1/1985 | Franzmann | |
| 4,518,181 | A | * | 5/1985 | Yamada | 292/201 |
| 4,570,500 | A | * | 2/1986 | Richter | 74/54 |
| 4,584,923 | A | * | 4/1986 | Minnick | 84/454 |

(Continued)

FOREIGN PATENT DOCUMENTS

WO PCT/US00/02119 8/2000

OTHER PUBLICATIONS

Robot Guitar, www.gibson.com/robotguitar, released Dec. 7, 2007 (no printed documents found), Gibson Corporate, Nashville, TN, USA, viewed on line.

(Continued)

*Primary Examiner* — Elvin G Enad
*Assistant Examiner* — Robert W Horn

(57) ABSTRACT

A method and apparatus for string load reduction and real-time pitch alteration on stringed instruments. A string load is substantially reduced with a camming surface actuator so that the pitch can be rapidly manipulated by an input force which is generated by human power or an electronically controlled motor. Various types of camming surfaces are provided as well as a load optimization calculation which determines the shape of a variable ratio camming surface. Multiple embodiments are described including a constant force pitch alteration device, a motorized control system with pitch compensation and real-time tracking of string pitch to multiple relative input signals, a control signal generator based on real-time position measurement of a control object relative to an electromagnetic radiation sensor, and methods for generating mechanical looping, vibrato, and polyphonic chorus effects which can be automated or dynamically controlled by a user. Other embodiments are described and shown.

43 Claims, 18 Drawing Sheets

U.S. PATENT DOCUMENTS

| | | | | | |
|---|---|---|---|---|---|
| 4,674,387 | A | * | 6/1987 | Caruth | 84/304 |
| 4,674,388 | A | | 6/1987 | Mathias | |
| 4,876,794 | A | * | 10/1989 | Myers | 30/252 |
| 4,878,413 | A | * | 11/1989 | Steinberger | 84/314 N |
| 4,909,126 | A | | 3/1990 | Skinn et al. | |
| 4,920,847 | A | * | 5/1990 | Conklin, Jr. | 84/202 |
| 5,009,142 | A | * | 4/1991 | Kurtz | 84/454 |
| 5,038,657 | A | | 8/1991 | Busley | |
| 5,140,883 | A | * | 8/1992 | Fay | 84/266 |
| 5,171,927 | A | * | 12/1992 | Kubicki et al. | 84/304 |
| 5,323,680 | A | | 6/1994 | Miller et al. | |
| 5,390,579 | A | * | 2/1995 | Burgon | 84/454 |
| 5,392,680 | A | * | 2/1995 | Stets | 84/313 |
| 5,760,321 | A | | 6/1998 | Seabert | |
| 5,767,429 | A | | 6/1998 | Milano et al. | |
| 5,824,929 | A | | 10/1998 | Freeland et al. | |
| 5,886,270 | A | | 3/1999 | Wynn | |
| 5,986,190 | A | | 11/1999 | Wolf et al. | |
| 6,002,075 | A | | 12/1999 | Carter | |
| 6,080,921 | A | * | 6/2000 | Cunningham | 84/266 |
| 6,100,459 | A | | 8/2000 | Yost | |
| 6,278,047 | B1 | * | 8/2001 | Cumberland | 84/455 |
| 6,624,347 | B2 | * | 9/2003 | Erismann | 84/297 R |
| 6,806,411 | B1 | * | 10/2004 | Allen | 84/454 |
| 7,304,226 | B2 | * | 12/2007 | Harris | 84/304 |
| 7,323,633 | B2 | * | 1/2008 | Shaffer | 84/746 |
| 7,446,248 | B2 | * | 11/2008 | Skinn et al. | 84/312 R |
| 7,534,950 | B2 | * | 5/2009 | Lyles | 84/453 |
| 7,541,528 | B2 | * | 6/2009 | Lyles | 84/312 R |
| 7,692,079 | B2 | * | 4/2010 | Lyles | 84/312 R |
| 7,772,470 | B1 | * | 8/2010 | Olsen | 84/313 |
| 2003/0183062 | A1 | * | 10/2003 | Schryer | 84/313 |
| 2003/0226441 | A1 | * | 12/2003 | Barney | 84/297 S |
| 2008/0105108 | A1 | * | 5/2008 | Saenz | 84/485 R |
| 2010/0064877 | A1 | * | 3/2010 | Deck | 84/313 |
| 2010/0089219 | A1 | * | 4/2010 | D'Arco | 84/454 |

OTHER PUBLICATIONS

Buchla Lightning, www.buchla.com/lightning, released 1991 (no printed documents found), Buchla & Associates, Berkeley, CA, USA, viewed on line.

* cited by examiner

METHOD AND APPARATUS FOR STRING LOAD REDUCTION AND REAL-TIME PITCH ALTERATION ON STRINGED INSTRUMENTS

CROSS REFERENCE TO RELATED APPLICATIONS

The present application claims the benefit of the filing date of U.S. Provisional Patent Application Ser. No. 60/880,789, filed 16 Jan. 2007.

Statement Regarding Federally Sponsored

RESEARCH OR DEVELOPMENT

Not applicable.

REFERENCE TO A MICROFICHE APPENDIX

Not applicable.

TECHNICAL FIELD

The present invention relates generally to stringed musical instruments and more particularly to load reduction devices for pitch alteration systems and a real-time pitch alteration system for stringed instruments.

BACKGROUND INFORMATION AND DISCUSSION OF RELATED ART

Altering the pitch of a string on a stringed instrument opens up many avenues of expression for a performer. While most stringed instruments (except pianos and the like) have some means for the performer to alter the pitch by shortening the string length, like pressing a string down behind a fret or placing a bar of metal on the string, these standard techniques come with certain limitations. For example, on a guitar the performer typically only has five fingers of a given length with which to fret notes. This fact inherently limits the number of combinations of chords and melodies that this performer can actuate at a given tempo. Given these physical limitations on chord and melody generation possibilities, there has been much inspiration over the years to develop technologies which allow the performer to alter the pitch of the open string (and therefore all notes fretted on that string as well) in real time. Alteration of the open string pitch enables a performer to sound a different chord or melody without changing the position of the left hand, and therefore increases the avenues of expression available. Furthermore, many styles of music are characterized by the manner in which a performer alters or "bends" certain notes. The "Blues" for example is characterized melodically by frequent upward bending of the minor third.

All such devices which re-tune, bend, or alter the pitch of a string on a stringed instrument are considered to be in the general category of pitch alteration devices. Within this general category, devices are typically developed for either real-time pitch alteration during performance or tuning during the spaces between songs and performances. Re-tuning of a pitch in real-time is not possible in most cases since it takes about 10 to 100 milliseconds for the frequency to stabilize and then another 100 to 500 milliseconds to sample the stabilized frequency and determine what pitch was played (depending on the note played and the tuning algorithm). This required delay for frequency determination is usually longer than acceptable to a performer. Therefore prior art devices typically teach either tuning systems or real-time pitch alteration systems.

Real-time systems require virtually instantaneous tracking of string pitch to a control device which is typically operated by the performer. Examples are pedal steel pitch changers, guitar string benders, tremolo (or whammy) bars, and electronic pitch shifting devices. Tuning systems, on the other hand, do not have to operate in real-time and thus typically require several seconds or longer to move the pitch a small amount. Tuning systems are simply designed to adjust the relative pitch of strings to each other and other instruments so that the resulting music is in tune. Examples are tuning pegs, fine tuners, and automatic tuning devices.

Aside from electronic pitch shifters, which substantially degrade the tonal qualities of the sound, pitch alteration devices of all types are first presented with the problem of the string load. Typical stringed instruments such as guitars tension the strings at about 20 to 40 pounds of tension per string. The prior art teaches ace a number of different machines and methods for reducing this relatively high string load down to a level where a pitch change can be easily actuated by a force supplied by the performer or a motor. It is important to note that the load reduction requirement when the input force is supplied by the muscle power of the human user is substantially less than the reduction requirement if a motor (of reasonable size) is supplying the input force. For example, user actuated lever/spring assemblies on pedal steel guitars typically reduce a 25 pound string load down to about 0.5 pounds which is a total reduction of 50:1. Whereas a motorized pitch alteration device that utilizes modern servo or stepper motors requires a total reduction of 500:1 up to 2000:1, depending on the exact size and torque capabilities of the motor specified. In the discussion that follows I'll use an example of a 2" thick guitar to illustrate the relationship between the size of various mechanical components and the amount of reduction provided.

To my knowledge, all of the prior art pitch alteration devices utilize at least one or a combination of several of the following machine elements to reduce the string load: (a) lever arm, (b) toggle joint, (c) coiled spring, (d) cam, (e) screw, (f) worm gear, (g) wheel, and (h) various types of standard gearing (planetary gears, helical gears, etc.). In addition to the basic machine elements listed above the following methods are also used to reduce the string load: (a) shunting the bulk of the string load to the body of the instrument and then an actuator bends the string in a direction normal to the axis of the string (i.e. radially) or slides a bridge member beneath the string (therefore actuator does not carry the whole string load); (b) coiling of a string around a post to provide friction for holding the load, and (c) altering the incidence angle of the string force to take advantage of the fact that an oblique force is reduced by the sine of the incidence angle. In the discussion that follows I will refer to the ratio of the original string load to a reduced load as the reduction ratio.

The most common load reduction means is the typical lever as found in tremolo bars, etc. An example is the commercially successful U.S. Pat. No. 4,171,661 to Rose. Within the space constraints of the 2" thick guitar example mentioned above a lever alone will provide about 2:1 to 20:1 of reduction. The problem is that a lever derives its mechanical advantage by distributing the load out linearly from a pivot. This fact results in a pitch alteration mechanism that is too large or requires too much input force to be practical. The solution as practiced by Rose and most others is to combine the load reduction of the lever with a coiled spring.

While the prior art does teach of camming systems which can partially solve the space problem of levers by wrapping the length required for mechanical advantage around the pivot, all such camming systems either act radially on the string, act on a lever which is connected to the string, or are incorporated into tremolo lever assemblies; see U.S. Pat. No. 2,771,808 to Jenkins, U.S. Pat. No. 5,760,321 to Seabert, and U.S. Pat. No. 6,100,459 to Yost for examples. Since none of these systems are intended to reduce the load, they either exhibit minimal load reduction or limited throw. In theory a typical cam can provide a reduction of 30:1 to 50:1 in the 2" thick guitar example, but no prior art teaches of such a device. Furthermore, prior art cams provide mechanical advantage by displacing a cam follower which rides on the outside surface of the cam. As the follower gets further from the cam's axis of rotation, the moment arm of the string load increases, partially canceling a portion of the load reduction.

Continuing our guitar example, the common solution of including a coiled extension spring with a lever, as shown by Rose and many others, does increase the reduction ratio up to a range of 20:1 to 40:1. Unfortunately, coiled extension springs of this type also dampen the vibration of the string and increase in force output as the string force decreases (according to Hooke's Law). When there is no motor involved, like in a pedal steel guitar, the increase in force output with decreasing tension is helpful since the spring tends to help return the tension to a zero-point standard pitch without requiring another motion by the user. A motorized system, on the other hand, does not need the assistance of a "return spring", but would rather include a spring that reduces the load when the string is raised to higher tensions. The prior art teaches at least one example of a lever/spring system for an automatically tuned stringed instrument that optimizes load reduction by careful positioning of the load and spring to take full advantage of the oblique angle force laws mentioned above. However, in addition to the problems mentioned above with this type of system, such a device also doubles the load presented to the lever's pivot when compared to a simple cam and provides a limited range of motion due to the inherent limits of the lever and spring. Furthermore, such devices attempt to match the reduction ratio to the changing string load by matching as close as possible the linear change in spring force due to deflection of the spring to the sum of the sinusoidal changes in spring force and string force due to their respective angle of incidence relative to the common lever. The inherent mathematical difference between the linear spring function and the sinusoidal lever effects means that it is not possible with this method to closely match the reduction ratio to the string load. Further still, these systems are tuning systems and thus cannot provide real-time pitch control; see U.S. Pat. No. 4,909,126 to Skinn et al for an example of an auto-tuning system.

While the prior art does teach a number of load reduction means which utilize lead screws and worm gears, the efficiency of the screw must be set below 50% in order to prevent back-driving (load on the nut or gear drives the screw or worm). This basic fact means that a worm or lead screw on its own is not a good choice for reducing the load down to a level where a small motor can provide the input force. Some additional load reduction is required in motorized applications. For example, the commercially available Robot Guitar, manufactured by Gibson Guitar Corporation, provides a miniature motor which drives a high-reduction gear train which then drives a worm gear. In non-motorized applications the standard worm gear tuning peg is still problematic since it is known to slip slightly and since it requires a coiling of the string around a post. String coiling always results in non-linear stick/slip friction since the coils slide against each other non-uniformly as the tension varies; and this friction results in pitch errors since the non-linear behavior is not easily repeatable. Furthermore, standard tuning pegs do not provide an efficient enough reduction system to allow real-time control of string pitch, except in limited applications.

The use of planetary gears and other types of gear trains are common in the prior art for motorized systems. U.S. Pat. No. 5,886,270 may provide such an example. However, such systems are overly complex, inefficient, expensive, slow, noisy, and high maintenance since the relative inefficiency of the mechanism requires high gear reduction ratios. To my knowledge there is no prior art that teaches of a load reduction system that requires minimal gear reduction prior to the motor.

As mentioned above, another load reduction technique that is employed is to shunt the string load to the body of the instrument and then operate radially on the string, U.S. Pat. No. 4,674,388 to Mathias may provide such an example. While this technique works quite well at reducing the load, it requires too much travel for anything more than small alterations in pitch. Due primarily to the mechanical challenges mentioned above, most real-time pitch alteration devices are non-motorized and are generally operated by the performer's hand, foot, knee, etc. These systems, however, are frequently heavy and complex relative to the number of pitch changes possible. Pedal steel guitars, for example, are quite heavy and can only provide about 20 pre-defined pitch changes at most. Motorized automatic tuning devices are too slow to provide real-time functionality. There are a handful of devices which provide motorized vibrato effects, such as U.S. Pat. No. 4,100,832 to Peterson. But these devices are only capable of minor periodic variations in the pitch of all strings together at the same time. There are very few prior art attempts to my knowledge which provide a motorized real-time pitch alteration system: U.S. Pat. No. 5,038,657 to Busley and U.S. Pat. No. 5,760,321 to Seabert may provide relevant examples.

Some prior art teaches a power-actuated pitch alteration device which includes a foot-operated switch for controlling an electrical solenoid which rotates a cam shaft mounted on the guitar. The solenoid rotates the cam shaft between first and second positions, and tensioning arms engage camming surfaces on the rotating shaft thereby increasing or decreasing the tension in strings attached thereto. The device essentially provides a simplified version of an electrically operated, pedal steel-like pitch changer which does not require the strength of the performer to actuate the bend. Since the force is provided by the closing and opening of a solenoid, the device is fast enough to provide the performer with the ability to change between two different chords in the midst of a performance by simply pressing a pedal. And since the pedal is electrically, not mechanically, linked with the changer on the guitar, performing while standing and moving around is not a problem. While this device does provide a solution to some of the physical limitation issues associated with pedal steel guitars, this device has one major drawback: only two changes are possible. A solenoid is either on or off and therefore it is not possible to get more than two different open string chords with this design. At least one prior art patent teaches a motorized real-time pitch alteration device which includes a string connected directly to a motor shaft. However, there are numerous problems with the design which have prevented this device from ever making it to market. Winding the string around the motor shaft causes improper string return because the string is wound around the motor shaft similar to a typical tuning peg. Improper string return is a well-known problem in the pedal steel art, and it has largely been solved in modern pedal steels by eliminating string terminations which coil the string around a post. One such solution is disclosed in U.S. Pat. No. 4,141,271 to Mullen. The problem arises because as the tension varies, the coils resistively twist around the shank causing a non-linear variable. Improper string return problems are further amplified by the fact that the pitch alteration is provided by coiling a string around a tight radius. This method is not used in any other prior art for real-time pitch alteration because string deformation as the string coils and uncoils around the shaft will cause significant nonlinear errors. Since the motor carries the whole load of the string (up to 50 pounds when raising the pitch) and has to rapidly torque strings up to pitch on raises, it has to be a relatively large motor, which adds bulk and weight to the instrument. A gearhead may be provided as an alternative to help reduce the motor size. However, such a gearhead substantially increases the number of revolutions required to actuate a pitch change, likely slowing the unit down too much to be useful in a real-time system. Such a device also has no physical means to keep the string from loosening, and thus requires the motor to provide the torque required to hold the instrument in tune. This is problematic since there will be lot of heat generated which may damage the wood of the instrument (especially on acoustic guitars), it wastes a lot of power, and it prevents playing of the instrument acoustically since power is required to keep it in tune.

In addition to the above mechanical issues, this attempt does not provide a control system which enables true pedal steel-like pitch changer functionality For example, the device allows any combination of the strings to be pitch altered by any pre-programmed amount, but there is no means provided which allows a user to map multiple control interfaces with a plurality of pitch change operations. Furthermore, there is no control function which provides relative pitch change functionality like a "split tuning" on pedal steel where the actual pitch change is relative to the sum of two pedals. Though this attempt does indicate that the device is capable of correlating frequency of the string with motor location, there is no compensation algorithm given to account for nonlinear variables like those mentioned above plus others that are harder to control like temperature, humidity, instrument deformation, and the like.

Even though tuning systems do not provide real-time pitch control, I have include here some discussion of automatic tuning devices since almost all prior art patents which utilize motors to actuate pitch changes are in this category. A number of inventions have been proposed which seek to automatically tune the pitch of a string or strings via electromechanical means, such as the device to Skinn mentioned above. Such devices include a plurality of motors which are controlled by a computer that "listens" to the frequency of the strings after they have been strummed and then automatically restores to an in-tune state any strings which do not match a pre-determined in-tune pitch. The device is also capable of switching from one predetermined tuning to another. While this may sound at first like similar functionality to a real-time system, all automatic tuning devices that I am aware of are not usable for real-time systems because it takes about 3 seconds to change from one pitch to the next. Furthermore, there is no user interface and control system given which provides real-time access to a plurality of pitch change operations without removing the hands from the instrument, controllable pitch alteration rate, relative pitch function, or pitch change automation. It is not possible for a performer with such a device to change chords along with a tune like a pedal steel player can do, or to strike a first chord, for example, then slowly bend it upwards and have the bending notes reach and stop at a second higher chord right on a specific beat as desired by the performer.

To summarize, the prior art for pitch alteration systems has a number of problems which together have resulted in there being no commercially available device at the current time for providing motorized real-time pitch alteration on stringed instruments. Furthermore, the manually operable real-time systems available are extremely limited in pitch change capability and difficult to actuate due to complex lever systems.

The foregoing patents reflect the current state of the art of which I am aware. Reference to, and discussion of, these patents is intended to aid in discharging my acknowledged duty of candor in disclosing information that may be relevant to the examination of claims to the present invention. However, it is respectfully submitted that none of the above-indicated patents disclose, teach, suggest, show, or otherwise render obvious, either singly or when considered in combination, the invention described and claimed herein.

Furthermore, it is clear from the lack of prior art and the number of problems which still remain unaddressed, that a definite need exists for a real-time pitch alteration device which improves the efficiency of load reduction thereby enabling motorized systems and substantially improving manually-operated systems. And since motorized systems are not very developed at this point in time, there is a further need for a control system which enables a user to accurately actuate a variety of pitch changes in real-time without removing the hands from a playing position, thereby opening up whole new avenues of musical expression which were not previously possible.

BRIEF SUMMARY OF THE INVENTION

The present invention provides a method and apparatus for string load reduction and real-time pitch alteration on stringed instruments. Embodiments of the inventive device include a system for substantially reducing the load of a string with a camming surface actuator so that the pitch can be rapidly manipulated by an input force which is generated by human power or an electronically controlled motor. The camming surface actuator comprises: (a) a tension transfer portion adapted to transfer string tension to a camming surface portion via at least one bearing means that rides on at least one camming surface; (b) a rotating portion which provides structural support for the camming surface portion and rotates about an axis of rotation when an input force is applied thereto; and (c) the camming surface portion which provides a significant load reduction by comprising at least one of an optimized variable ratio camming surface, a concave camming surface, and a combined variable ratio concave camming surface. The variable ratio camming surface reduces the string load by presenting a generally low slope to the tension transfer portion, thereby shunting the bulk of the string load to an axle portion and optimizing a distribution of forces presented to the rotating portion by means of a variable slope. The variable slope is predetermined by a load optimization calculation which determines the shape of the variable ratio camming surface. The concave camming surface reduces the string load by presenting a generally low slope to the tension transfer portion and by providing a primary support surface facing the axis of rotation such that the tension transfer portion applies a pulling force on the concave camming surface in a direction substantially away from the axis of rotation when the string is under tension. The direction of the pulling force results in a reduction of a moment arm caused by the string load on the rotating portion and therefore an increase in a reduction ratio.

In one embodiment a load optimization calculation provides a shape for a variable ratio camming surface which results in a mechanical advantage ratio that increases in proportion to an increasing load of the string such that a required input force is approximately constant for most positions of the tension transfer portion. Such a constant force actuator increases a reduction ratio for a given size as compared to a fixed ratio actuator.

In one embodiment the camming surface actuator further comprises a constant force spring, thereby eliminating the need for low efficiency worm gears, lead screws, and the like and enabling direct coupling of a small motor to a rotating portion without further reduction in load.

In one embodiment a pitch alteration system comprises actuators installed in a body portion of a stringed instrument. In another embodiment a pitch alteration system comprises actuators installed on a headstock portion of a stringed instrument. And yet another embodiment comprises actuators installed in a body portion and a headstock portion of a stringed instrument. In other embodiments control means are installed inside a stringed instrument and in some cases located remotely from the instrument.

In one embodiment the apparatus provides a real-time motorized control system with pitch compensation and real-time tracking of string pitch to one or multiple input control signals resulting in relative pitch change functionality. The system comprises a plurality of motors driving a plurality of actuators which are connected to a plurality of strings, one motor and one actuator per string. A controller receives multiple incoming relative pitch change requests for a single string, calculates a pitch alteration request, then computes a new motor portion based on at least one compensation algorithm. A human user or a machine dynamically controls the position of at least one actuator in real time by providing a series of inputs to a controller over an interval of time via a control signal generator or other manual or automatic control means. Compensation algorithms adjust incoming pitch alteration requests to account for operating conditions such as ambient temperature and humidity; global factors such as a condition of the strings or a presence, of a capo; real-time actuator temperature variance; tuning adjustments made outside of a real-time performance; and real-time instrument deformation factors which result from varying string tension levels. According to this embodiment the real-time system is capable of actuating a pitch change within the constraints of a real-time performance deadline. A failure to meet the deadline resulting in a substantially noticeable difference, relative to a musical tempo, between an intended arrival time of a string at a new pitch and an actual arrival time of the string at the new pitch.

In one embodiment a control signal generator based on real-time position measurement of a control object relative to an electromagnetic radiation sensor is provided. The control object is variably positioned by a user within a predetermined range of motion. The electromagnetic radiation sensor provides real-time detection of a position of the control object. A signal processing means converts the position into an electrical signal which is representative of the position and a signal output means sends a corresponding electrical signal to the pitch alteration device which alters a pitch of a string on a stringed instrument in response to the corresponding electrical signal.

In one embodiment a computer is utilized as a control means thereby enabling a more complex motor control processes. Another embodiment uses a standard MIDI control means. In another embodiment a control signal generator sends signals to a computer which processes the signals according to predetermined instructions and then correspondingly sends signals to a pitch alteration system which result in the alteration of pitches on a stringed instrument. In other embodiments novel methods of performance are realized through the production of automated and dynamically controllable vibrato and polyphonic chorus effects, relative pitch changes on a single string, and mechanical looping effects which allows a performer to record in real-time a series of pitch change operations and then have them repeated.

Other novel features which are characteristic of the invention, as to organization and method of operation, together with further objects and advantages thereof will be better understood from the following description considered in connection with the accompanying drawings, in which some embodiments of the invention are illustrated by way of example. It is to be expressly understood, however, that the drawings are for illustration and description only and are not intended as a definition of the limits of the invention. The various features of novelty which characterize the invention are pointed out with particularity in the claims annexed to and forming part of this disclosure.

There has thus been broadly outlined the more important features of the invention in order that the detailed description thereof that follows may be better understood, and in order that the present contribution to the art may be better appreciated. There are, of course, additional features of the invention that will be described hereinafter and which will form additional subject matter of the claims appended hereto. Those skilled in the art will appreciate that the conception upon which this disclosure is based may be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the Abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The Abstract is neither intended to define the invention of this application, which is measured by the claims, nor is it intended to be limiting as to the scope of the invention in any way.

Certain terminology and derivations thereof may be used in the following description for convenience in reference only, and will not be limiting. For example, words such as "upward," "downward," "left," and "right" would refer to directions in the drawings to which reference is made unless otherwise stated. Similarly, words such as "inward" and "outward" would refer to directions toward and away from, respectively, the geometric center of a device or area and designated parts thereof. References in the singular tense include the plural, and vice versa, unless otherwise noted.

BRIEF DESCRIPTION OF THE SEVERAL VIEWS OF THE DRAWINGS

The invention will be better understood and objects other than those set forth above will become apparent when consideration is given to the following detailed description thereof. Such description makes reference to the annexed drawings wherein.

GLOSSARY

Figure 1:
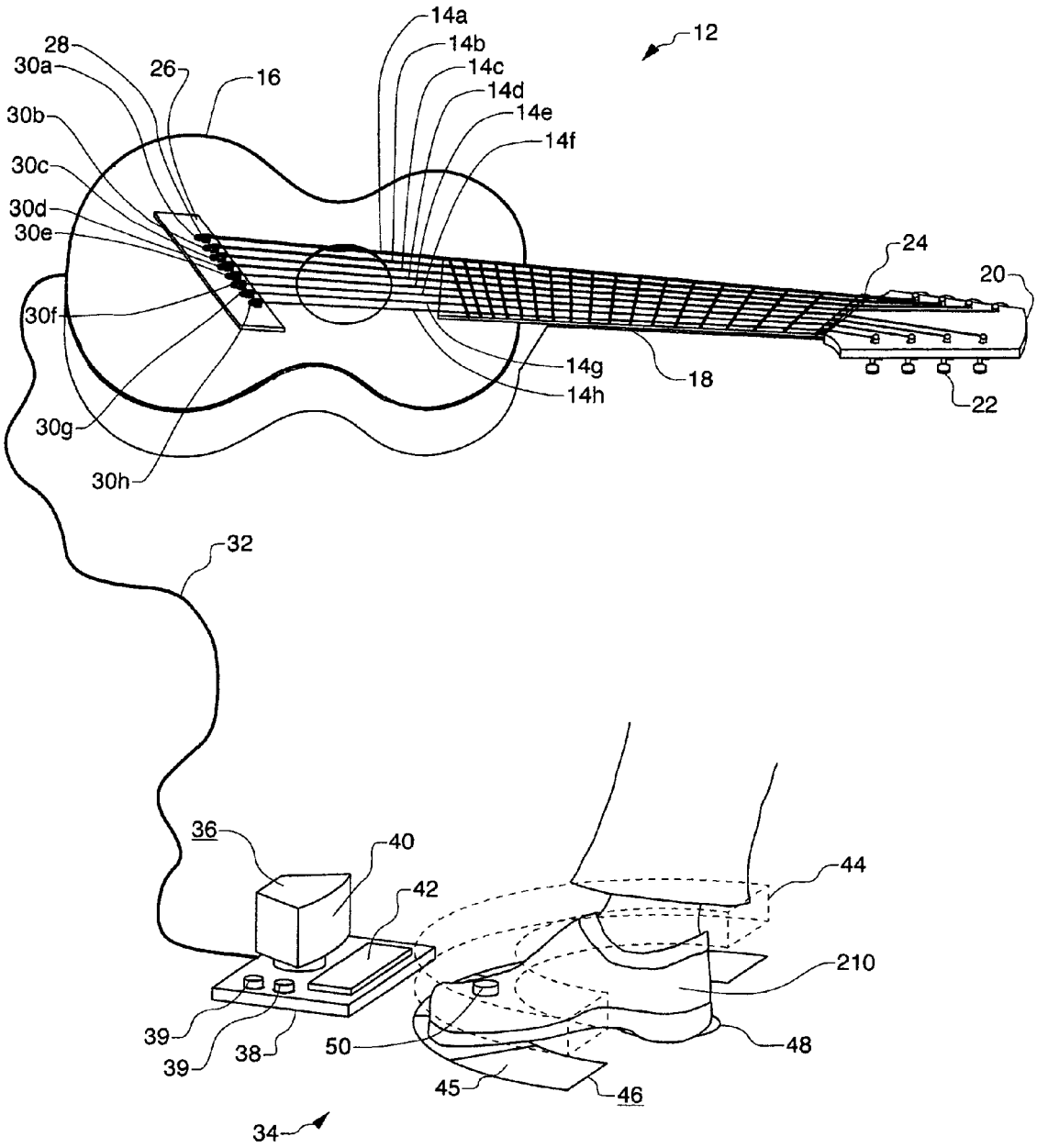
FIG. 1 shows a perspective view of pitch alteration system 10

Actuator: a pitch alteration device. The term actuator is not used herein to refer to an input force means, such as electromechanical, piezoelectric, magnetic, or human power, but rather simply refers to a mechanical device for altering the pitch of a string on a stringed instrument as a separate entity from the input force means.

Camming Surface: Any curved surface which rotates about an axis of rotation, carries a string load on a curved exterior surface or a concave interior surface, and is utilized to reduce a string load in a pitch alteration device.

Camming Surface Actuator: an actuator which comprises at least one camming surface for the purpose of reducing a string load in a pitch alteration device.

Camming Surface Portion: a device having at least one camming surface.

Compensation Algorithm: any function, series of equations, lookup table, or empirically derived set of values that has as its input an amount of pitch alteration plus at least one other variable and as its output a compensated new motor position, said compensated motor position accounting for at least one of environmental conditions, ambient temperature, humidity, actuator temperature, presence of a capo, instrument deformation under various string tension levels, and tuning offsets away from home position. The amount of pitch alteration which is inputted into the compensation calculation is typically in the form of a pitch alteration request, but this amount can also be in the form of a pitch change request which is prior to resolving relative pitch change issues.

Concave Camming Surface: any camming surface which is concave and faces an axis of rotation; furthermore a string load applied to the concave camming surface applies a pulling force in a direction substantially away from the axis of rotation.

Control Means: any device capable of translating the actions or programming instructions of a user into pitch change requests which result in the alteration of a pitch on a string.

Control Object: part of a control signal generator which allows variable positioning by a user within a predetermined range of motion for the purpose of having its position tracked by an electromagnetic radiation sensor and then converted into electrical signals which are used to control the pitch of a string on a stringed instrument.

Control Signal Generator: Any device comprising a control object for variable positioning by a user within a predetermined range of motion and a stationary portion with an electromagnetic radiation sensor for real-time detection of a position of the control object. The stationary portion tracks the position of the control object and then converts the positioning information into electrical signals which are used to control the pitch of a string on a stringed instrument.

Controller: any device capable of controlling the position of a motor in a pitch alteration system. Controllers sometimes include other features as described herein.

Constant Force Spring: any spring which supplies an approximately constant force output over a range of motion. It is important to note that constant force springs are very different from the more common types of linear force springs which are found in prior art devices. Examples of constant force springs are found in cord and seatbelt rollup mechanisms which "pull back" on the cord or belt with approximately the same amount of force no matter how far out the cord or belt is pulled.

Input Force: an amount of force that is applied to a pitch alteration device or a subsystem thereof. The pitch alteration device translates this force into a string. The input force is typically provided by at least one of human muscle power, a motor, and a spring.

Input Torque: an input force in a rotational system multiplied times the radius over which it acts.

Load Optimization Calculation: any function, series of equations, lookup table, graph or empirically derived set of values which is used to determine an optimum shape for the camming surface given various design constraints and a distribution of forces presented to a rotating portion which holds the camming surface.

Load Reduction Device: a device which reduces a string load, or a carried portion of a string load, so that a required input force to the device is reduced to a range where a human or appropriately sized motor can supply it.

Mechanical Advantage Ratio: when referring to a pitch alteration device, the mechanical advantage ratio is a string load divided by a minimum amount of input force required to alter the pitch of a string; also referred to simply as the ratio or the reduction ratio. Unless otherwise noted, all references herein to the mechanical advantage ratio are meant to refer to the ideal mechanical advantage ratio before friction has been taken into account as opposed to the actual mechanical advantage ratio which accounts for friction losses.

Pitch Alteration Device: a device for engaging with a string on a stringed instrument for the purpose of translating an input force from a human or motor into an increase or decrease in the tension of the string; also referred to as an actuator.

Pitch Alteration Request: a requested amount of pitch alteration which is a function of at least two relative pitch change requests. The pitch alteration request is calculated from the relevant relative pitch change requests before a pitch alteration occurs.

Pitch Alteration System: a pitch alteration device plus associated input force means and control electronics if applicable.

Pitch Change Operation: any operation executed by a pitch alteration device that results in the altering of at least one pitch on at least one string of a stringed instrument. A pitch change operation is generally referred to herein as both the operation itself and the collection of pitch change instructions associated with the operation. Thus it is possible to create a pitch change operation which stores numerous pitch change instructions. Pitch change operation's are typically associated with control signal generators and control means for the purpose of activation. Pitch change operations are further subcategorized as automatic and manual. Automatic pitch change operations contain instructions which automatically execute over a period of time and manual pitch change operations only contain instructions which require user input to execute.

Pitch Stop: an amount pitch alteration away from a home position pitch which is definable and tunable by a user. A pitch stop is a special type of pitch alteration request.

Real-Time Performance Deadline: a "soft" real-time deadline which determines whether or not a pitch alteration device is fast enough to be useful in real-time performance application. In general a soft real-time deadline is one in which a failure to meet the deadline does not result in a catastrophic loss but rather results in substantially reduced service quality. The deadline represents the point beyond which the device ceases to adequately perform its intended function and is therefore only marginally useful or possibly useless. Thus, the exceeding of a real-time performance deadline results in a substantially noticeable discrepancy, relative to a musical tempo, between an intended arrival time of a string at a new pitch and an actual arrival time of the string at the new pitch.

Relative Pitch Change Request: a request for the current pitch of the string to be altered by a specific number of semitones and percentages, or "cents", thereof or by a specific amount of frequency. In some embodiments the inventive device allows for more than one relative pitch change request on a single string, thus the relative pitch change requests form a layer on top of a layer where communications are based on the absolute pitch of a string and its corresponding motor position. All relative pitch change requests must be resolved and converted into a single pitch alteration request before a pitch alteration occurs.

Rotating. Portion: a device which provides structural support for a camming surface portion and rotates about an axis of rotation when an input force is applied thereto.

String Force Function: a function which relates the string load to relevant variables such as string gauge, materials, weight, length, instrument specific friction factors, and typical operating conditions.

String Load: force exerted by a string under tension at a specific string tension level on the body or bodies which are carrying the string load. The string load increases as the tension on the string and resulting pitch of the string increase. The string load is carried by the devices attached to each end of the string and any additional devices which interrupt the straight line path between the two string end points such as a nut, bridge, and partial load pitch alteration device. Since most devices which carry the string load are typically attached to the body of the instrument, it is the body that provides the ultimate structural support for the strings.

Tension Transfer Portion: a device which is adapted to carry a portion of a string load and to vary the tension of a string by moving in response to a rotation of a rotating portion. Comprises at least one bearing means which is adapted to ride on a camming surface portion, thereby transferring the string load to the camming surface portion.

Variable Ratio Camming Surface: any variably sloped camming surface comprising a camming surface which has been predetermined by a load optimization calculation.

Variable Ratio Concave Camming Surface: any camming surface which is both a concave camming surface and a variable ratio camming surface.

DETAILED DESCRIPTION OF THE INVENTION

Referring to FIGS. 1 through 33, wherein like reference numerals refer to like components in the various views, there is illustrated therein a new and improved apparatus for string load reduction and real-time pitch alteration on stringed instruments. The complete apparatus will generally be referred to as a pitch alteration system 10.

First Embodiment

Structure

Figure 4:
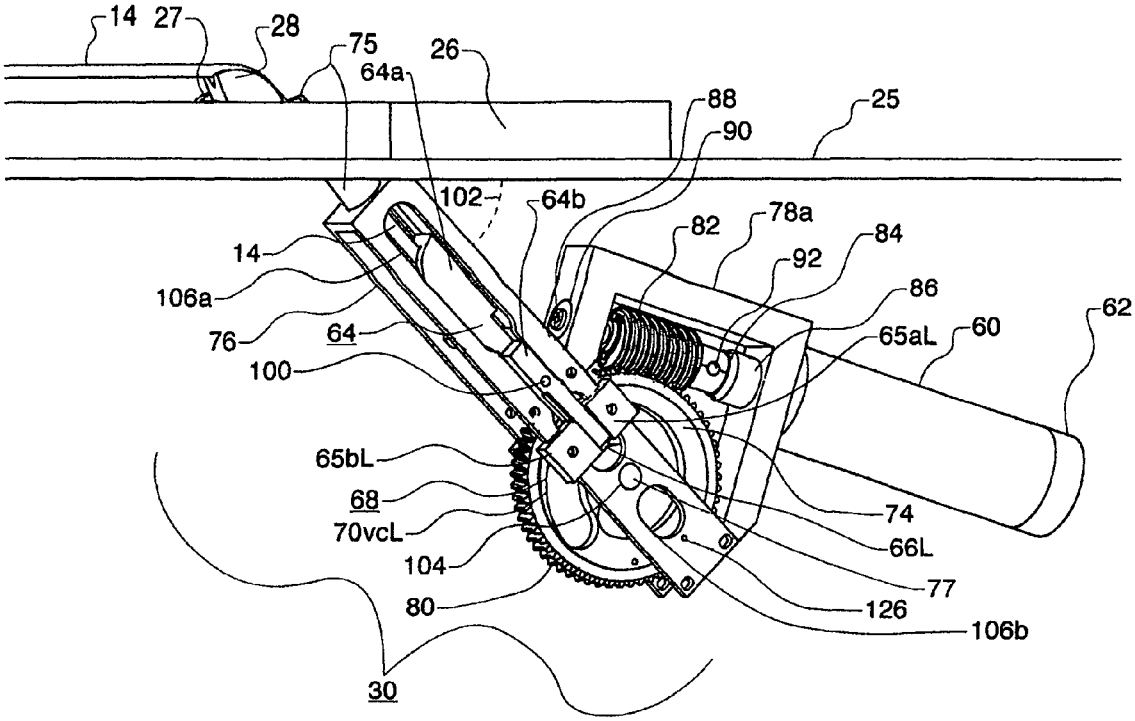
FIG. 4 provides a perspective view of the front of a single camming surface actuator 30 with associated servo motor 60 and encoder 62.
Figure 5:
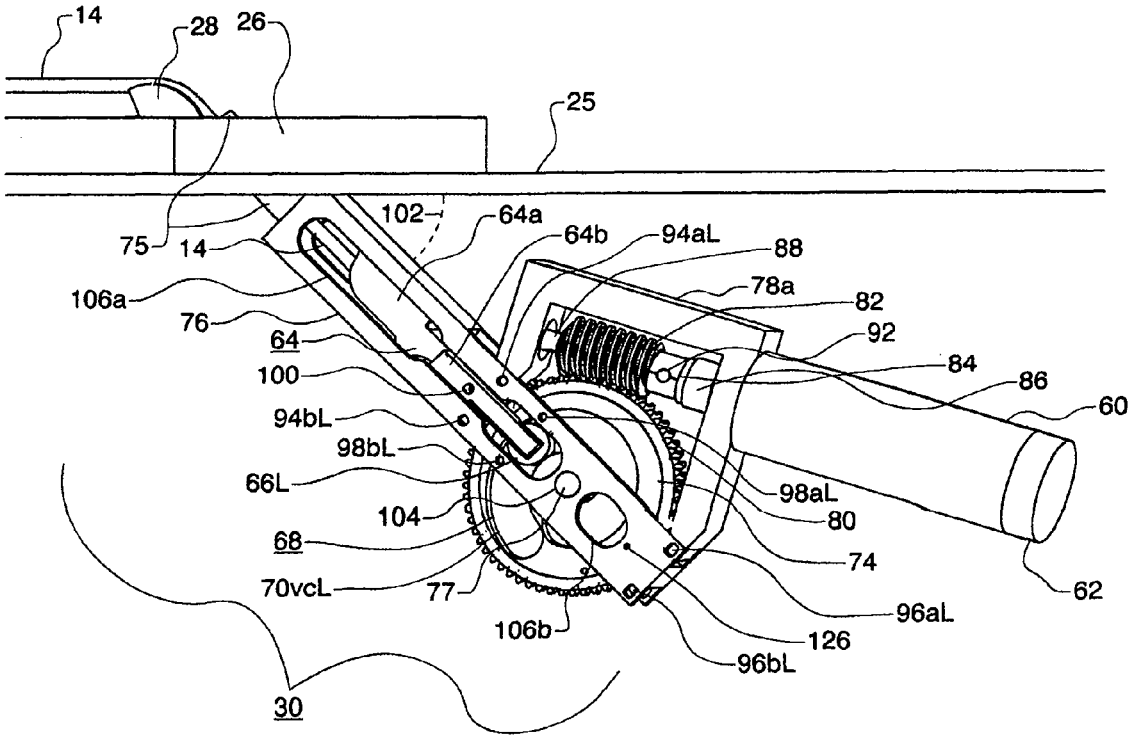
FIG. 5 provides a perspective view of the rear of a single camming surface actuator 30 with associated servo motor 60 and encoder 62.

FIGS. 1 through 14 depict a first embodiment of a pitch alteration system 10 of the present invention which has been adapted for use with a stringed instrument 12. FIG. 1 shows a perspective view of pitch alteration system 10. FIG. 3 shows a perspective from the back of a stringed instrument 12 with the back of the instrument 12 removed to reveal the equipment inside. Referring to FIGS. 1 and 5, stringed instrument 12 may be a typical fan-fret acoustic guitar with 8 strings 14*a*, 14*b*, 14*c*, 14*d*, 14*e*, 14*f*, 14*g*, 14*h*, a body 16, a neck 18, a headstock 20, standard tuning pegs 22, a nut 24, and a bridge 26. A standard acoustic guitar saddle has been replaced by 8 individually moveable rocker saddles 28. Eight separate camming surface actuators 30*a*, 30*b*, 30*c*, 30*d*, 30*e*, 30*f*, 30*g*, 30*h* are barely showing protruding behind rocker saddles 28 in FIG. 1, whereas camming surface actuators 30*a*-30*h* are fully revealed in FIG. 3. Camming surface actuators 30*a*-30*h* are primarily contained within the body 16 and may comprise the detailed elements discussed below. Control cord 32 links a control signal generator 34 with the rest of pitch alteration system 10 via a control connection port 54 on a controller 52. Control signal generator 34 comprises a control unit 36, a control object 50, and a control object range 44. Control object range 44 is shown as clashed since it is not an actual part, but rather a range of positions into which control object 50 can be moved. Control object 50 comprises a plurality of infrared transmitters which are housed in a lightweight plastic case which is adapted for attachment to a user's shoe 210. However, other embodiments contemplate transmitters operating at other frequency ranges such as radio, visible light, and microwaves. Still other embodiments utilize laser light transmitters housed in control object 50. Additional embodiments also contemplate a control object 50 which is adapted for attachment to other articles of clothing, body parts, or held by a user. Control unit 36 further comprises a base 38, an electromagnetic radiation sensor 40, and a display 42. This first embodiment contemplates a sensor 40 which includes a plurality of integral infrared optical sensors. However, other types of sensors are also suitable including optical sensors which are optimized for radio, visible, and microwave frequencies as well as laser light. Display 42 is a simple LCD-type or similar display which provides visual information to the user. Control object range 44 is demarcated by foot path markings 46 which can take various forms. This first embodiment contemplates simple markings 46 that a user applies to a musical stage with tape before each performance. Other types of foot path markings 46 are also suitable such as painted, engraved, etched, or dyed markings on a thin sheet of material or fabric. A heel pivot point marking 48 is provided to indicate a location for a user's heel. Foot path markings 46 indicate subdivisions which represent active zones 45. Each active zone 45 represents a range of position values for control object 50 which correspond to virtual buttons and sliders. In other embodiments control signal generator 34 is replaced by a more typical control means such as a musical instrument digital interface (MIDI) foot pedal, a variable potentiometer, or a series of control knobs, sliders, or switches. In still other embodiments a control means comprises laser interrupt actuators, distance sensors, pressure sensors, angle sensors, strain gages, tilt sensors, accelerometers, magnetic field sensors, motion detectors, touch screens, and touchpads. Thus, the first embodiment provides a preferred control means, but many types of control means are suitable. Any device which translates an action of a user into electrical control signals is suitable as a control means.

Referring now specifically to FIG. 3, controller 52 further comprises 8 motor connection ports 56*a*, 56*b*, 56*c*, 56*d*, 56*e*, 56*f*, 56*g*, 56*h* and one power input port 58. Inside the outer housing for controller 52 as shown here is a typical printed circuit board comprising controller 52 electronics. Controller 52 is small enough to fit inside a typical acoustic guitar body 16. Camming surface actuators 30*a*-30*h* comprise multiple parts not detailed here except for motor brackets 78*a* and 78*b* and 8 servo motors 60*a*, 60*b*, 60*c*, 60*d*, 60*e*, 60*f*, 60*g*, 60*h* and 7 encoders 62*b*, 62*c*, 62*d*, 62*e*, 62*f*, 62*g*, 62*h* (there are 8 encoders total, but encoder 62*a* is out of view here). Motor bracket 78 is alternately situated on the top and bottom of the actuator to provide ample clearance since the servo motors 60*a*-60*h* are approximately 50% wider than the space between two adjacent strings 14*a*-14*h*. Cabling between motor connection ports 56*a*-56*h* and servo motors 60*a*-60*h* and encoders 62*a*-62*h* is not shown here as this wiring is the same as typical servo motor control systems. Basic wiring connections are shown in FIG. 2.

Figure 2:
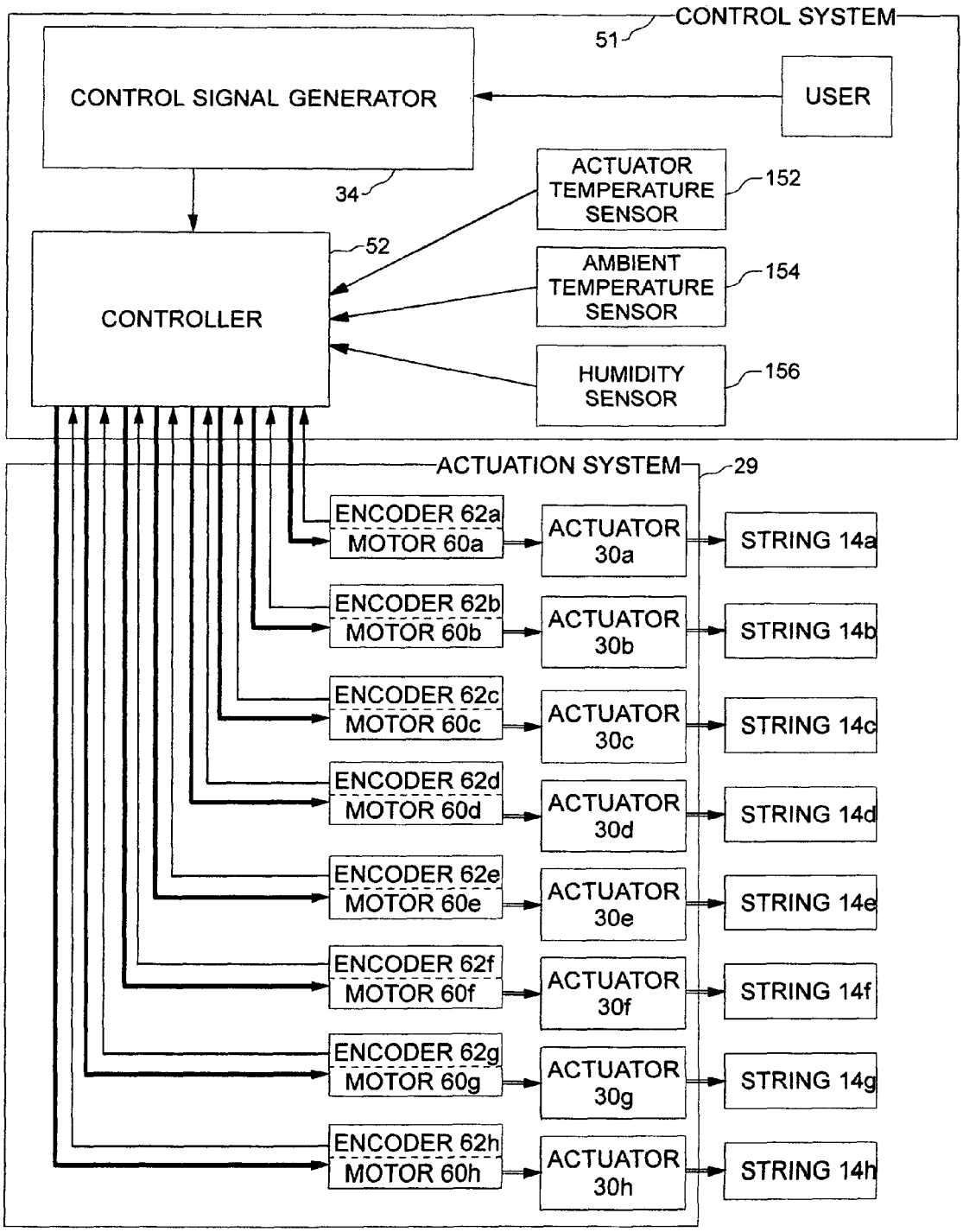
FIG. 2 depicts a flow chart of the pitch alteration system 10 which shows the flow of signals and power and the movement of elements in the system 10.
Figure 3:
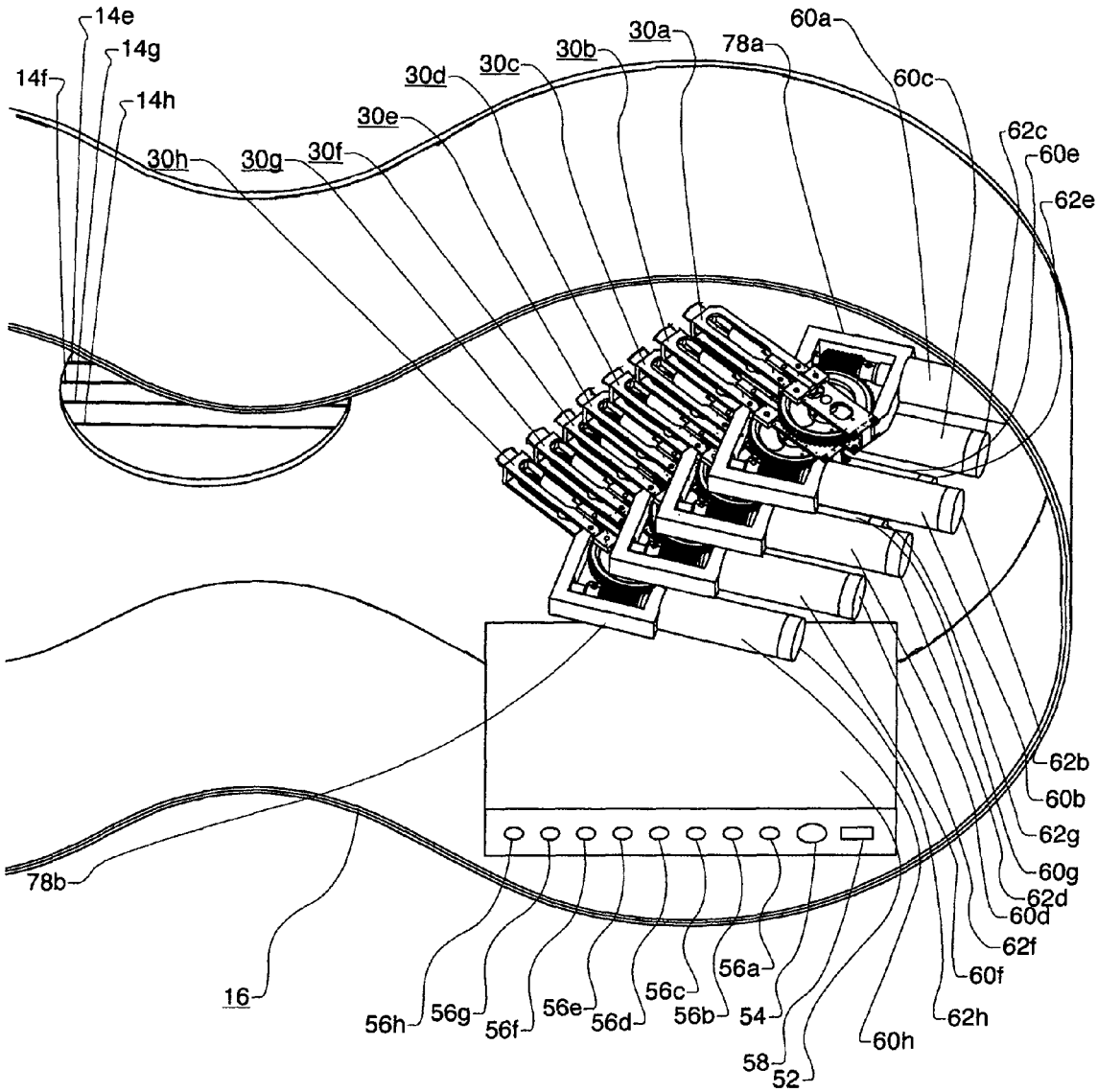
FIG. 3 shows a perspective from the back of a stringed instrument 12 with the back of the instrument 12 removed to reveal the equipment inside.

FIG. 2 depicts a flow chart of the pitch alteration system 10 which shows the flow of signals and power and the movement of elements in the system 10. Controller 52, control signal generator 34, and the user are all designated as being a part of an overall control system 51. Control signal generator 34 and controller 52 each have their own internal processing means and memory (both of which are not shown). Motors 60*a*-60*h* with integral encoders 62*a*-62*h* and actuators 30*a*-30*h* together may form an actuation system 29. The diagram specifically shows the flow of electrical signals, as represented by thin lines; electrical power, as represented by thick lines; and physical movement, as represented by double lines. Control signal generator 34 outputs signals to controller 52. Controller 52 sends power to motors 60*a*-60*h* and receives position information back from encoders 62*a*-62*h*. Rotation of motors 60*a*-60*h* causes each motor's respective actuator 30*a*-30*h* to move thereby causing the strings 14*a*-14*h* to move, which in turn results in a change in the pitch of strings 14*a*-14*h*. Each of the eight motor 60/actuator 30 pairs is capable of independent motion yet controller 52 provides a centralized control function for all independent movements. FIG. 4 and FIG. 5 provide perspective views of a single camming surface actuator 30 with an associated servo motor 60 and an encoder 62 and connected to a string 14, FIG. 4 revealing more of the front and FIG. 5 revealing more of the rear thereof. FIG. 5 is also distinguished by the removal of a pair of alignment bushings 65*a*L and 65*b*L in order to reveal parts behind them (corresponding alignment bushings 65*a*R and 65*b*R are located on the other side and are thus not viewable here). As seen in FIG. 3, the fan-fret nature of stringed instrument 12 in this embodiment requires a series of actuators 30 which are not aligned. Therefore each actuator 30 is a self-contained unit with a main bracket 76 and motor bracket 78*a* machined from a sturdy material such as aircraft aluminum or almost any material strong enough to handle the string load. Main bracket 76 comprises a hollow cylindrical portion 75 which fits into a hole drilled through bridge 26 and a top 25 of instrument 12 at a break angle 102 of approximately 45 degrees to the instrument top 25. Break angle 102 is shown here at 45 degrees since it is a common break angle for acoustic guitars, but as the other embodiments will show, actuator 30 can be fashioned to accept string 14 at any reasonable break angle 102. String 14 tension pulls main bracket 76 up into the underside of top 25 and thus secures actuator 30 to the top 25 of instrument 12. Main bracket 76 further comprises forward screw holes 94*a*L and 94*b*L for securing a forward portion of motor bracket 78*a* or 78*b* by means of a fastener (not shown) and rearward slots 96*a*L and 96*b*L for adjustably securing a rearward portion of motor bracket 78*a* or 78*b* to main bracket 76. Main bracket 76 also includes alignment bushing screw holes 98*a*L and 98*b*L for securing alignment bushings 65*a* and 65*b* respectively and a hole 104 for axle portion 77. Axle portion 77 is fixed to main bracket 76 by means of a friction fit, adhesive, or fastener such that it does not rotate. Main bracket 76 is also shown with several slots 106*a* and 106*b* which reduce weight and allow for easy assembly and visual inspection of the device.

String 14 is routed over rocker saddle 28 which rocks on rocker base 27 as string 14 moves during pitch alteration operations. Rocker base 27 sits in a milled cavity in bridge 26 and is adapted to provide the correct string height and intonation placement relative to the rest of the instrument 12. I contemplate the rocker saddle 28 and rocker base 27 to be fashioned from cow bone as is common for guitar saddles; however other materials are also suitable. String 14 leaves rocker saddle 28 at an angle approximately equal to break angle 102 and runs through hollow cylindrical portion 75 in main bracket 76 and then couples with tension transfer portion 64, which comprises a string end 64*a* and a bearing end 64*b*. Details of tension transfer portion 64 are discussed below.

Figure 6:
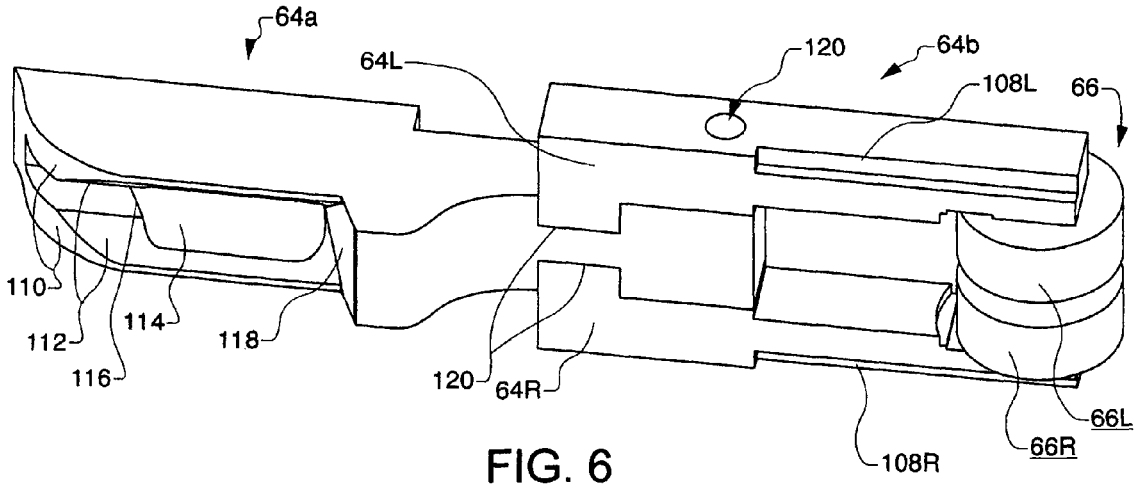
FIG. 6 shows a perspective view of tension transfer portion 64.
Figure 7:
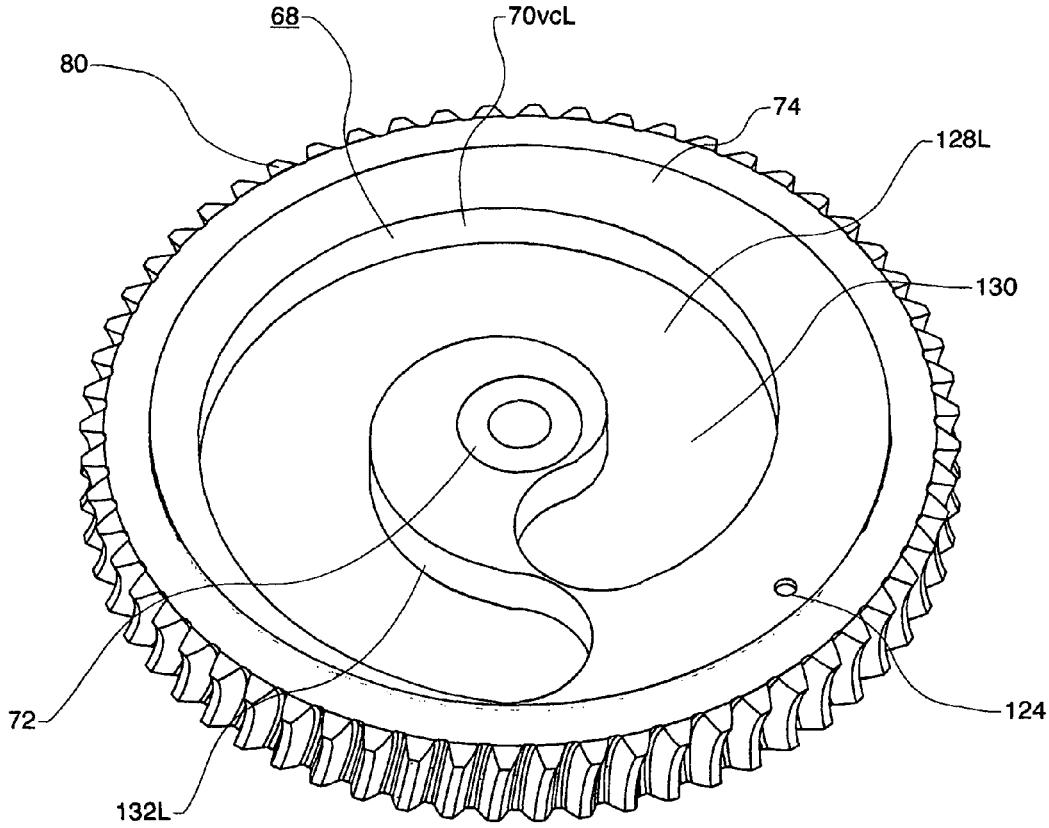
FIG. 7 shows a perspective view of tension transfer portion 64 and rotating portion 74.
Figure 8:
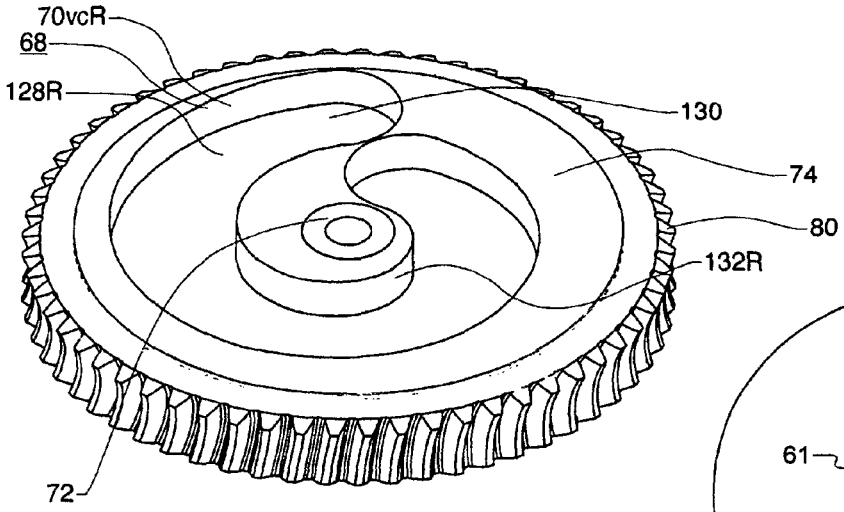
FIG. 8 is the same as FIG. 7 only flipped 180° around an axis running left to right on the page.

Expanding the discussion now to include FIGS. 6 and 7, which show perspective views of tension transfer portion 64 and rotating portion 74 respectively, and FIG. 8 which is the same as FIG. 7 only flipped 180° around an axis running left to right on the page, it is clear that tension on string 14 is transferred through tension transfer portion 64 to a camming surface portion 68 via bearing means 66. Camming surface portion 68 comprises two variable ratio concave camming surfaces 70*vc*L (pictured in FIG. 5 and FIG. 7) and 70*vc*R (pictured in FIG. 8) which carry corresponding miniature ball bearings 66L and 66R. Camming surface portion 68 comprises the outer surface of two substantially aligned grooves 128L and 128R, one milled into each side of rotating portion 74. The grooves 128L and 128R do not go all the way through, thus leaving a web 130 of material for additional structural support. I contemplate a rotating portion made of steel since the high load of the string is focused here, however many other materials such as titanium, aluminum, etc. are suitable. Rotating portion 74 further comprises a worm gear 80 around its perimeter and a bearing 72 in its bore for smoothly rotating about axle portion 77. Worm gear 80 includes a large enough bore to have entire rotating portion 74 fit snugly into the bore; thus the bore in worm gear 80 removes most of the material from worm gear 80, leaving only the outer portion where the teeth reside. Worm gear 80 meshes with worm 82. Therefore tension of string 14 results in a substantially linear pulling force on camming surface portion 68 in a direction substantially away from axle portion 77. Said pulling force results in clockwise rotational force about axle 77 due to a slope of camming surface portion 68 relative to a direction of travel of tension transfer portion 64. Aside from friction, rotation of rotating portion 74 is prevented by worm 82 or by a rotational force of motor 60 or by a combination of the two. I contemplate a worm 82 of approximately 50% efficiency for this embodiment. Such a worm 82 will not back-drive by string tension alone under most circumstances. However, worms of higher efficiency are suitable if it is acceptable to have motor 60 provide some amount of holding torque during use, and conversely a worm of lower efficiency could be used if back-driving is unacceptable. Worm gear 80 is approximately 30:1 ratio with approximately 1 to 2" pitch diameter. However, many ratios and sizes are suitable depending on load reduction required, speed, and other constraints as will be discussed below.

Worm 82 is secured to worm shaft 88 via a fastener (not shown) inserted into worm screw hole 92. Worm shaft 88 is secured to a shaft (not shown) on motor 60 such that rotation of motor 60 causes a corresponding rotation of worm shaft 88 and worm 82. Worm shaft 88 is supported by radial bearing 90 in motor bracket 78*a* and by thrust washer 84 and thrust bearing 86 when tension in string 14 causes said clockwise rotational force about axle 77 which in turn produces a linear force on worm 82 and worm shaft 88 in a direction substantially toward motor 60. While this simple method of supporting worm 82 and worm shaft 88 works well, many other arrangements of bearings and brackets are also suitable.

Motor 60 is shown as a 24 Volt DC servo motor with a rear shaft (not shown) that has been coupled to an encoder 62 which is a digital encoder which registers 2048 total counts, or 512 quadrature counts, per revolution of motor 60; though many types of motors and encoders are suitable. Encoder 62 provides motor position feedback to controller 52 in a closed loop positioning system. Other embodiments contemplate open loop stepper motor type positioning systems as well as linear motors, piezoelectric drivers, linear actuators and the like.

One skilled in the art will recognize that in addition to supplying a clockwise rotational force to rotating portion 74, tension on string 14 applies a downward force on tension transfer portion 64 at the point of contact between bearing means 66 and camming surface portion 68. Said downward force is resisted by alignment bushings 65*b*L and 65*b*R (not pictured) which also serve via tracks 108L and 108R in tension transfer portion 64 to insure proper left-right alignment as tension transfer portion 64 moves forward and backward. A second set of alignment bushings 65*a*L and 65*a*R are provided as a means to prevent tension transfer portion from moving too far vertically when bearing means 66 reaches the end of camming surface portion 68. Alignment bushings 65*a*L, 65*a*R, 65*b*L, 65*b*R can be made of a material such as PTFE-filled acetal, but many other types of low friction materials are suitable. Though not pictured here, it is also important to note that the location of every other worm 82/motor 60 assembly on the lower side of worm gear 80, as shown in FIG. 3, requires a flipping over of rotating portion 74 by 180° during assembly, which results in camming surfaces 70*vc*L and 70*vc*R switching places and the curve of camming surface portion 68 proceeding out from the center of rotating portion 74 in the opposite direction thereby resulting in a tension on string 14 causing a counter-clockwise rotational force about axle portion 77 which translates into a linear force on the worm 82 in the direction of motor 60 just the same as before (since worm 82 is now on the bottom of worm gear 80). It is also important to note that there are four different primary arrangements for worm 82 relative to camming surface portion 68, all of which are suitable: (a) worm 82 on top+camming surface portion 68 spirals outward in a counter-clockwise direction and causes a clockwise rotation of rotating portion 74, (b) worm 82 on top+camming surface portion 68 spirals outward in a clockwise direction and causes a counter-clockwise rotation of rotating portion 74, (c) worm 82 on bottom+camming surface portion 68 spirals outward in a counter-clockwise direction and causes a clockwise rotation of rotating portion 74, (d) worm 82 on bottom+camming surface portion 68 spirals outward in a clockwise direction and causes a counter-clockwise rotation of rotating portion 74. Arrangements (a) and (c) cause a linear force on worm shaft 88 in the direction of motor 60 and thus require thrust bearing 86 oriented as shown. Arrangements (b) and (d) cause a linear force on worm shaft 88 in direction away from motor 60 and thus require thrust bearing 86 to be relocated to the forward end of worm shaft 88. One skilled in the art will further recognize that these four arrangements are simply for the four primary directions of a 360° rotation and that worm 82 will work fine at any position along the teeth of worm gear 80 and that camming surface portion 68 can be flipped to cause either a clockwise or counter-clockwise rotation about axle portion 77 depending which is best for a particular embodiment.

Referring specifically to FIG. 6, which shows a perspective view of tension transfer portion 64, string end 64*a* of tension transfer portion 64 comprises curved forward surfaces 110 and beveled surfaces 112 which help to guide a string 14 into engagement with tension transfer portion 64. Specifically, surfaces 110 and 112 are shaped to urge a standard cylindrical string termination, or "string ball", into slot 114 where angled surface 116 captures it once tension is applied to string 14. Angled surface 118 at the rear of slot 114 provides a means for urging said string ball back out of slot 114 when tension is released from string 14 and a user pushes on string 14 to release it. Surface details as described above for string end 64*a* of tension transfer portion are well suited to an acoustic guitar as shown since the tension transfer portion 64 is not readily accessible. Other arrangements are suitable as will be described below.

Continuing with FIG. 6, bearing end 64*b* of tension transfer portion 64 comprises two disengageable tension transfer arms 64L and 64R with corresponding bearing means 66L and 66R on the rearward end. This arrangement of two arms 64L and 64R is required since camming surface portion 68 comprises two camming surfaces 70*vc*L and 70*vc*R. Arms 64L and 64R are secured via a fastener (not shown) in hole 120 or by adhesive or press fit into arm slots 120 such that the completely assembled tension transfer portion 64 is one piece which moves together as ball bearings 66L and 66R roll on camming surface portion 68. In other embodiments instead of two grooves 128L and 128R rotating portion 74 comprises a single groove 128L which results in a camming surface portion 68 which comprises a single camming surface 70*vc*L. And, correspondingly, tension transfer portion 64 comprises a single tension transfer arm 64L with a single ball bearing 66L. The slight unbalance to the load in this embodiment is overcome by utilizing a stiffer material for tension transfer portion 64 or by making the arm 64L thicker.

FIGS. 7 and 8, provide closer views so that camming surface portion 68 with aligned camming surfaces 70*vc*L and 70*vc*R, rotating portion 74 with grooves 128L and 128R and web 130 are evident. As can be seen, grooves 128L and 128R are wide enough to allow ball bearings 66L and 66R to roll along camming surfaces 70*vc*L and 70*vc*R without touching the opposite walls 132L and 132R of the groove. The shape of camming surfaces 70*vc*L and 70*vc*R in the first embodiment are more specifically described as concave variable ratio camming surfaces since bearing means 66 acts on a concave surface of camming surface portion 68 relative to axle portion 77 and since the slope of camming surface portion 68 relative to a direction of travel of tension transfer portion 64 varies thereby resulting in a variable reduction ratio at different levels of tension on string 14. To clarify, the slope of camming surface portion 68 is equal to the slope of each of its respective camming surfaces 70*vc*L and 70*vc*R at every point thereon. In this embodiment the slope along each point of camming surface portion 68 has been determined by a load optimization calculation as described below. The calculation is this case resulted in a slope of approximately 2 to 4 degrees at an innermost portion of camming surface portion 68 and a slope of approximately 5 to 15 degrees at an outmost portion of camming surface portion 68. Many different slopes are possible and the exact slope at any point along camming surface portion 68 will vary depending on a number of system variables as discussed below. In other embodiments similar to the first embodiment the slope of camming surface portion 68 is not optimized with a load optimization calculation, thereby resulting in camming surfaces 70*vc*L and 70*vc*R simply being concave camming surfaces which are designated 70*c*L and 70*c*R as will be discussed below. In still other embodiments similar to the first embodiment the slope of camming surface portion 68 is optimized with an optimization calculation but does not face axle portion 77 thereby resulting in camming surfaces 70*cv*L and 70*cv*R simply being variable ratio camming surfaces which are designated 70*v*R and 70*v*L as will be discussed below. Rotating portion 74 rotates smoothly on axle 77 due to low friction plain bearing 72. Other types of low friction bearing means are also suitable.

Assembly of actuator 30 is aided by alignment hole 124 on rotating portion 74. Alignment hole 124 lines up with main bracket alignment hole 126 when rotating portion is in a home position 134, which is the physical position of motor 60 and actuator 30 at which string 14 is tuned to standard pitch. Obviously, assembly aids such as alignment hole 124 are non-critical and therefore could eliminated or realized in different forms.

Figure 9:
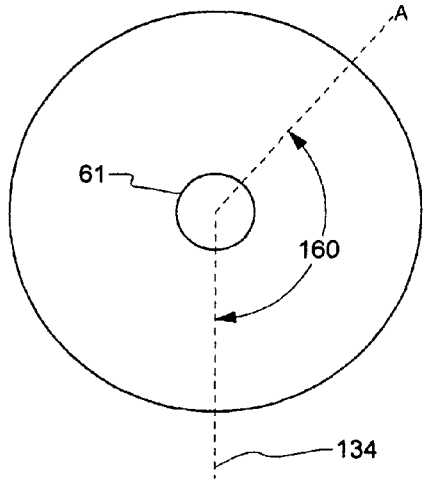
FIG. 9 depicts an end view of motor 60 showing a motor shaft 61 in the center of motor 60.

FIG. 9 depicts an end view of motor 60 showing a motor shaft 61 in the center of motor 60. A rotational position of motor 60, home position 134, is shown along with an amount of angular displacement, referred to as a new motor position 160. To clarify, an amount of motor 60 rotation from home position 134 to line A results in the motor being in the new motor position 160. Since actuator 30 is in its home position at the same time as motor 60, home position 134 is used herein to describe both the actuator home position 134 and motor home position 134.

Figure 10:
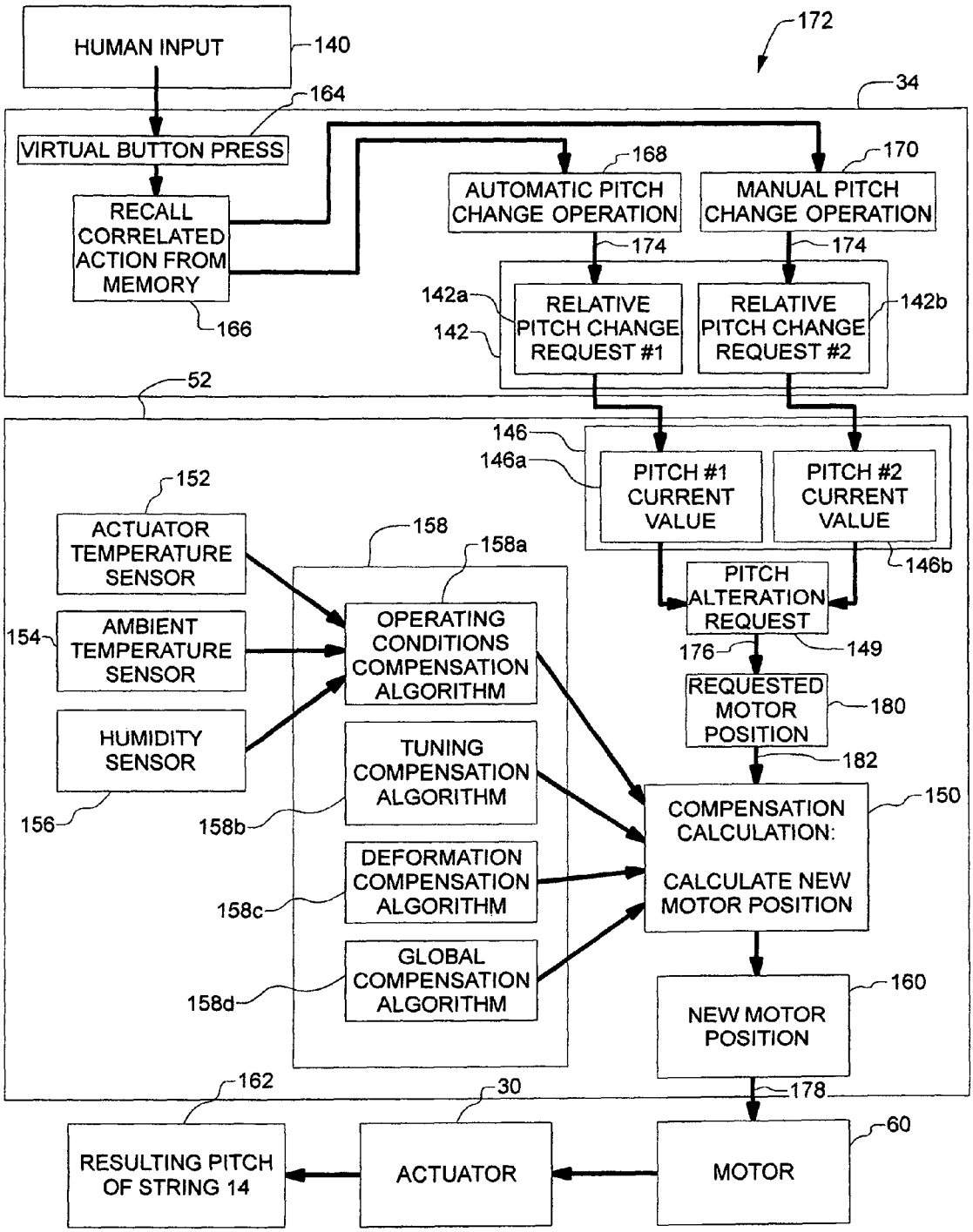
FIG. 10 depicts a flow chart showing an example of a pitch change operation 172.

FIG. 10 depicts a flow chart showing an example of a pitch change operation 172, which is defined herein as any operation executed by a pitch alteration system 10 that results in the altering of at least one pitch on at least one string of a stringed instrument. For clarity FIG. 10 depicts a simple pitch change operation 172 which only effects a single string 14. There are two types of pitch change operations shown: automatic pitch change operations 168 and manual pitch change operations 170. The difference is that automatic pitch change operation 168 generates signals automatically over a period of time once initiated (based on prior programming), whereas manual pitch change operation 170 requires human input 140 for each signal that is sent to controller 52. Automatic pitch change operation 168 stores instruction in the memory means of control signal generator 34. Please note that this drawing is a simplified example which shows only one automatic pitch change operation 168 and one manual pitch change operation 170 so that the basic routing of signals is understood. In actuality there could be a plurality of pitch change operations of both types (automatic and manual), only one pitch change operation of either type, a plurality of one type, or a plurality of the other type. Human input 140 to control signal generator 34 results in a virtual button press 164 (as discussed below) which causes an action to be recalled from memory 166. Action 166 in this example calls up an automatic pitch change operation 168 and a manual pitch change operation 170. Since the automatic pitch change operation could repeatedly send relative pitch change request 142*a* over a period of time, we will assume for this example that we are looking at a snapshot of a short period of time during which automatic pitch change operation 168 sends one relative pitch change request 142*a* to controller 52 and manual pitch change operation 170 sends one relative pitch change request 142*b* to controller 52 shortly thereafter. Relative pitch change requests 142*a* and 142*b* comprise a request identification code for the purpose of identifying which current value field 146*a* and 146*b* to update, a string identification number, and a requested amount of pitch alteration to be stored in current value fields 146*a* and 146*b*. Storage of values in current value fields 142 occurs in a memory means associated with controller 52. Controller 52 receives relative pitch change requests 142*a* and 142*b*, updates current value fields 146*a* and 146*b* and then sums the two values resulting in a pitch alteration request 149. Since the two relative pitch change requests 142*a* and 142*b* are not sent at the exact same time, receipt of a new relative pitch change request 142 at either location will result in the two current values being summed, converted to a requested motor position 180, and then sent as an input to a compensation calculation 150, unless a value of zero is received at either in which case nothing is sent to compensation calculation 150. In this way the pitch alteration request 149 is always relative to the most recent values of current value fields 146*a* and 146*b*. One skilled in the art will recognize that there are a variety of suitable techniques that can be used to compute a pitch alteration request 149 from two relative pitch change requests 142. For example, instead of sending zero to reset the calculation, certain current value fields could be designated as relative current values fields and others as absolute. Furthermore, there could be any number greater than or equal to two of current value fields 146 and corresponding incoming relative pitch change requests 142 since it takes at least two numbers to compute a pitch alteration request 149 (less than two numbers means that relative pitch function is lost as is the case in prior art devices). In other embodiments a compensation calculation 150 is run for every relative pitch change request 142 instead of only compensating the results of the relative quantities. Furthermore other embodiments contemplate pitch alteration requests 149 which are computed not by the sum of relative pitch change requests as stated above but by other functions of the incoming relative pitch change request 142 values.

Actuator temperature sensor 152, ambient temperature sensor 154, and humidity sensor 156 provide real-time operating conditions input to operating conditions compensation algorithm 158. Compensation calculation 150 calculates a new motor position 160 based on the pitch request sum 149 and the results from running this sum 149 through at least one compensation algorithm 158. Controller 52 then outputs power to motor 60 which results in motor 60 moving to new motor position 160 within the constraints of a real-time performance deadline. Please note that the presence and locations of many of the items shown here are flexible. For example, in one embodiment the control signal generator 34 is housed inside controller 52. In another embodiment there is no automatic pitch change operation 168, and in another embodiment there is no manual pitch change operation 170, and in another embodiment there is a plurality of various combinations of automatic pitch change operations 168 and manual pitch change operations 170 which are received by a plurality of current value fields 146. In another embodiment all components shown in FIG. 10 except human input 140, motor 60, actuator 30 and string 14 are housed in a separate enclosure remote from instrument 12. In another embodiment all functions shown in FIG. 10 except human input 140, motor 60, actuator 30 and string 14 are performed by a computer. In another embodiment a manual control signal generator is housed inside controller 52. In other embodiments the compensation calculation is simplified by leaving out selected compensation algorithms 158.

Figure 11:
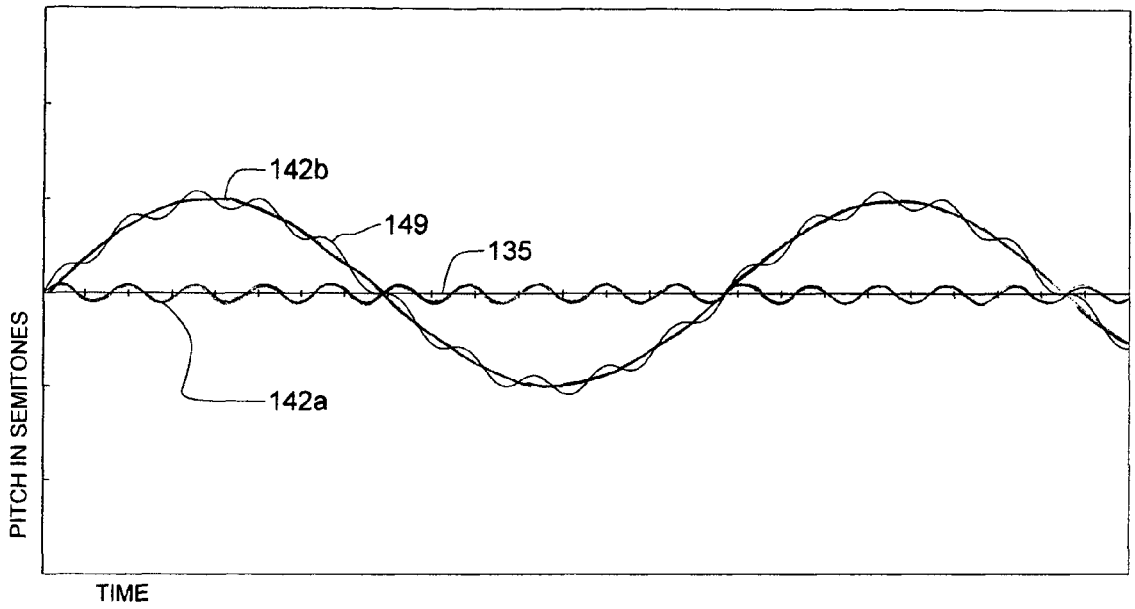
FIG. 11 shows relative pitch change requests 142*a* and 142*b* and their sum, pitch alteration request 149, prior to compensation as they vary over a period of time due to a series of inputs from control signal generator 34 over the period of time.
Figure 12:
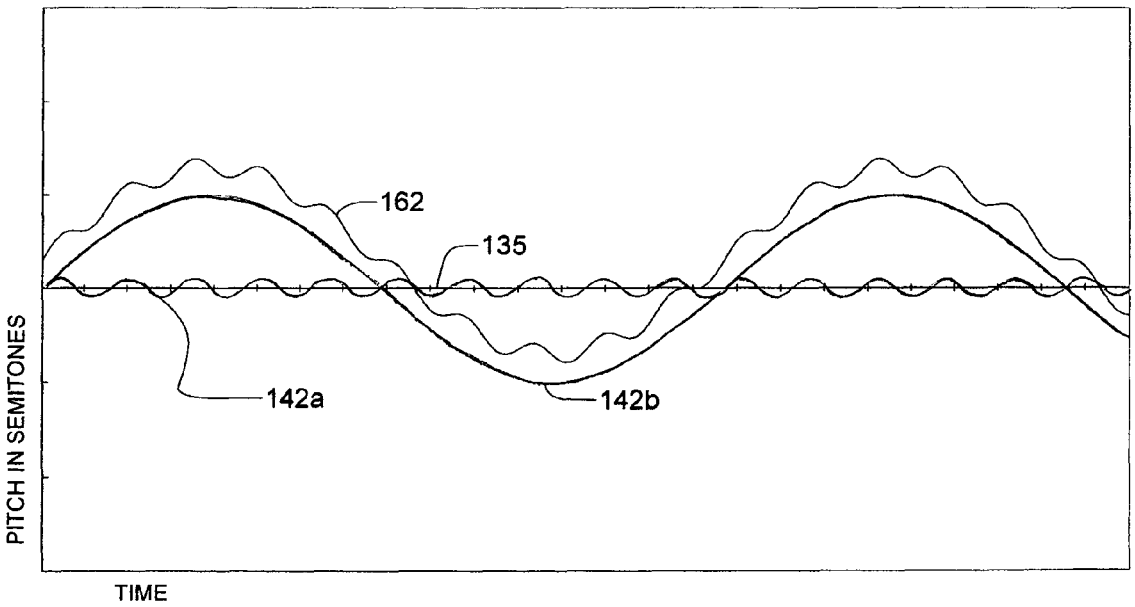
FIG. 12 is the same as FIG. 11 except that it shows the actual resulting pitch 162 of a string 14 after compensation calculation 150 instead of pitch alteration request 149.

FIGS. 11 and 12 show an example of a real-time pitch change operation 172 as could be executed by the pitch alteration system 10 of said first embodiment under discussion. FIG. 11 shows relative pitch change requests 142*a* and 142*b* and their sum, pitch alteration request 149, prior to compensation as they vary over a period of time due to a series of inputs from control signal generator 34 over the period of time. Horizontal line 135 is the home position pitch. The x-axis is time and the y-axis is the requested pitch in semitones prior to compensation. The scale shown here is approximately one second per marking on the x-axis. Please note that for explanatory purposes the discreet messages of relative pitch change requests 142 are shown as a single curve instead of a series points. In reality, of course, each message occurs at a particular point in time, and then there is a gap until the next message occurs. FIG. 12 is the same as FIG. 11 except that it shows the actual resulting pitch 162 of a string 14 after compensation calculation 150 instead of pitch alteration request 149. The y-axis in this graph represents both the requested pitch and the actual resulting pitch. As can be seen in this example, compensation calculation 150 raised the pitch alteration request by approximately the same amount at each point in time.

Figure 13:
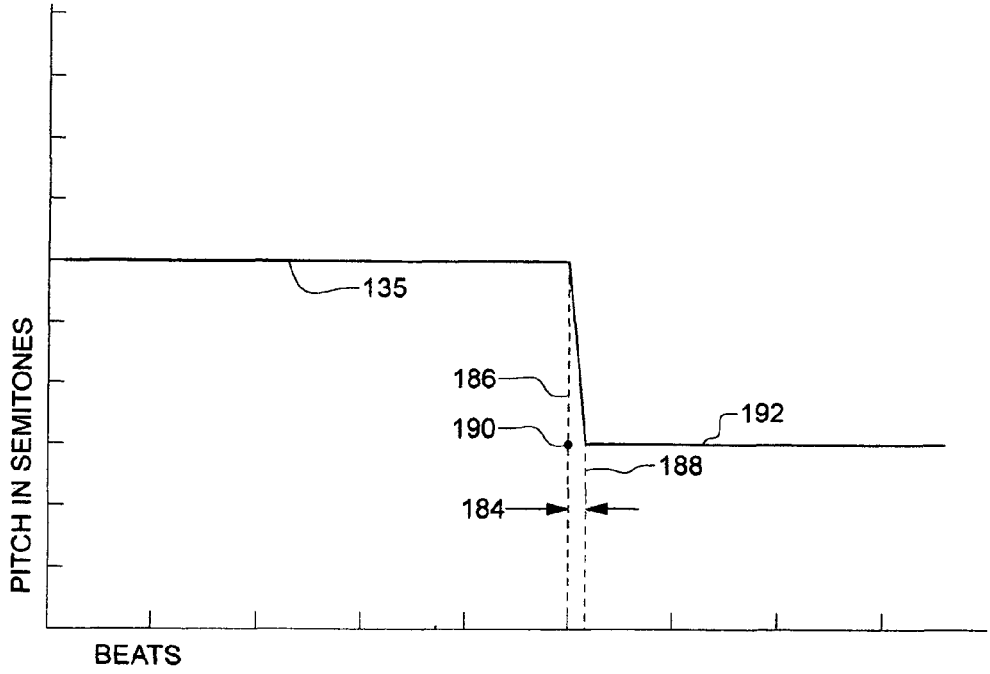
FIG. 13 depicts a graph which shows an example of a pitch change operation 172 in which a string 14 is lowered from its home position pitch 135 to a new pitch 192.

FIG. 13 depicts a graph which shows an example of a pitch change operation 172 in which a string 14 is lowered from its home position pitch 135 to a new pitch 192. The y-axis shows the pitch of string 14 in semitones and the x-axis shows beats at a musical tempo. The graph also shows an intended arrival time 186 at a new pitch 192 and an actual arrival time 188 at the new pitch 192 and their difference 184. The point when the user taps 190 on the floor to execute the operation 172 is also shown.

Figure 14:
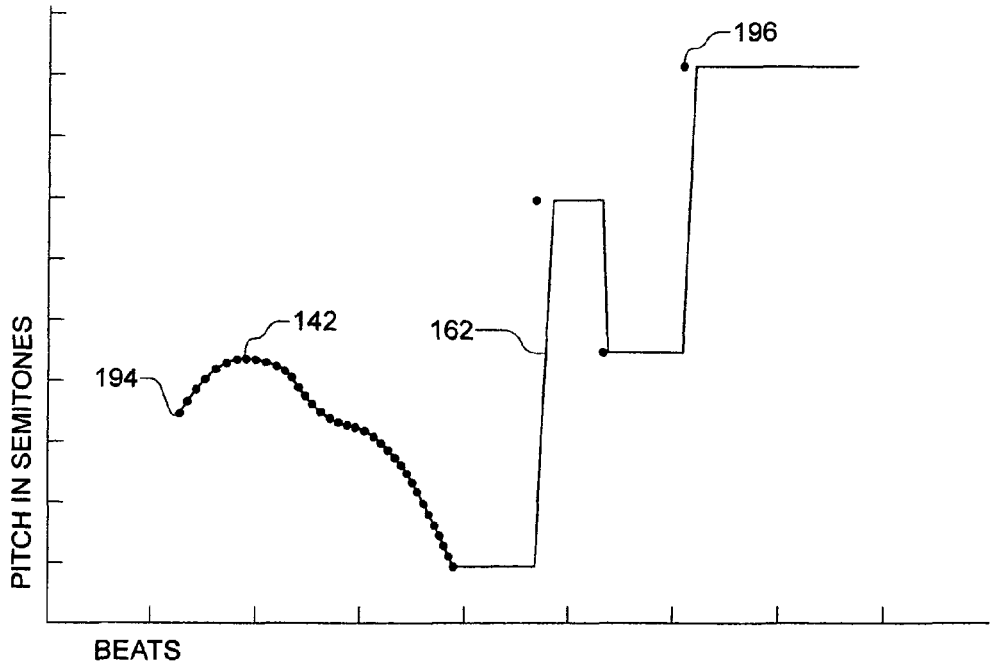
FIG. 14 depicts a graph which shows an example of a stream of relative pitch change requests 142 (shown as dots) which are automatically generated by an automatic pitch change operation 168 over a period of time.

FIG. 14 depicts a graph which shows an example of a stream of relative pitch change requests 142 (shown as dots) which are automatically generated by an automatic pitch change operation 168 over a period of time. The y-axis shows the pitch of string 14 in semitones and the x-axis shows beats at a musical tempo. In this graph all relative pitch change request's 142 are designated for the same current value field 146 and it is assumed that all other current value fields 146 are at zero, therefore there are no relative effects present here and each relative pitch change request 142 is equal to its corresponding pitch alteration request 149. Furthermore, to simplify the discussion, it is assumed that all compensation algorithms 158 yield a result of zero for this example. Thus the resulting pitch 162 closely matches the relative pitch change request 142 dots.

First Embodiment

Load Optimization Calculation

Figure 33:
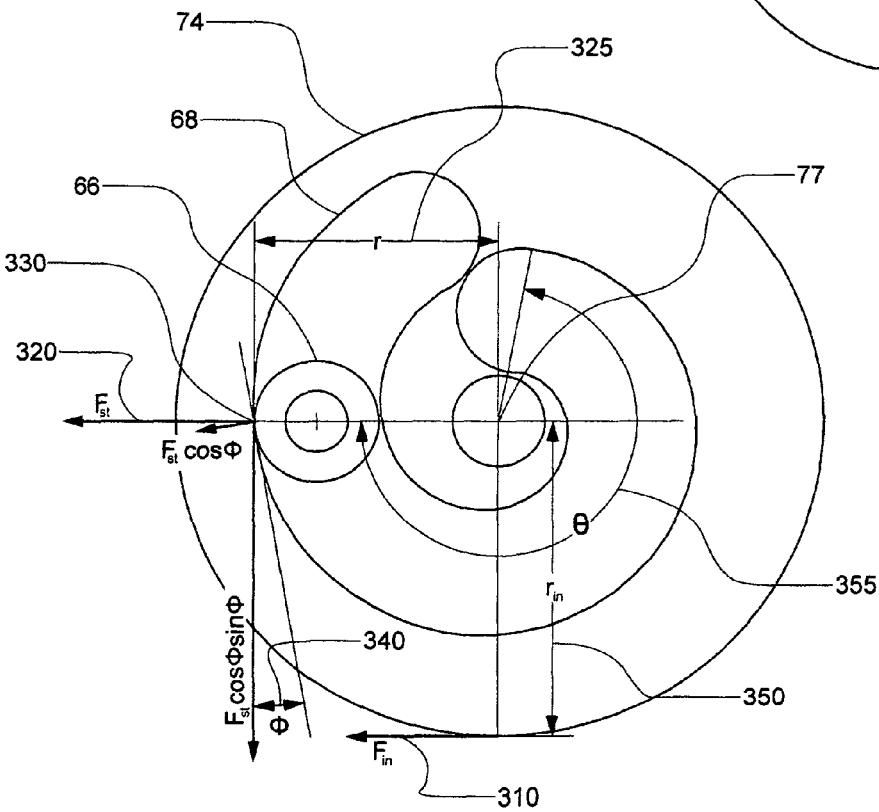
FIG. 33 provides an overview of load optimization calculations.

FIG. 33 and the discussion below provide an overview of load optimization calculations 300. In the first embodiment the distribution of loads presented to camming surface portion 68 is optimized by use of a load optimization calculation 130. A load optimization calculation is any function, series of equations, spreadsheet calculator, lookup table, graph or empirically derived set of values which is used to determine an optimum shape for a camming surface portion 68 given various design constraints and a distribution of forces presented to a rotating portion 74 which holds the camming surface portion 68. Such a calculation can result in a significant increase in the total load reduction provided by a camming surface portion 68 for a given set of size limitations. For example, cost and size limitations normally dictate the use of the smallest motor 60 possible for driving the rotation of a rotating portion 74 in a motorized pitch alteration device. Therefore, the motor's maximum torque capability must be matched to the highest load, which typically occurs when the string is at the highest tension level achievable with the device. If a decrease in tension from the highest tension level is not accompanied by a decrease in reduction ratio, then lower tension levels represent "wasted" reduction which directly translates into "wasted" length over which the load is distributed and a larger device than needed. However, if the ratio is reduced along with the reducing string tension load, then the maximum reduction possible from a given size can be achieved. Given that many pitch alteration devices utilize multiple modes of load reduction, one skilled in the art will see that there are various load optimization calculations which can be performed.

FIG. 33 provides an overview of the distribution of forces presented to rotating portion 74 in the first embodiment. Friction and other minor forces and effects are not accounted for in this drawing. A string load 320, represented by $F_{st}$, is pulling on camming surface portion 68 via bearing means 66. Bearing contact point 330 is assumed to be in line with $F_{st}$ though in actuality there may be a slight discrepancy. The slope 340 of camming surface portion 68 at a point of contact 330 is shown as $\phi$, the radius 325 to point of contact 330 is shown as r, and the amount of rotation 355 around the curve of camming surface portion 68 is given by $\theta$. An input force 310 is represented by $F_{in}$ and the radius 350 to input force 310 is given by $r_{in}$. String load 320 causes a counterclockwise torque ($r \times F_{st} \cos\phi \sin\phi$) on rotating portion 74 about axle portion 77 and input force 310 causes a clockwise torque ($r_{in} \times F_{in}$) on rotating portion 74 about axle portion 77. Aside from friction and other minor effects, rotating portion remains stationary when $r \times F_{st} \cos\phi \sin\phi = r_{in} \times F_{in}$. Those skilled in the art will recognize that the load reduction for this portion of actuator 30 (worm gear 80 not shown in this diagram) is very high when slope 340 is low. For example, when string 14 is at its highest tension and r is near its lowest value, slope 340 can be on the order of 2 degrees and $r_{in}$ can be in the range of 2 times r. In this example if the string load is 50 pounds, then the required input force 310 is given by:

$$F_{in} = r \times F_{st} \cos\phi \sin\phi \div r_{in} = 1 \times 50 \times \cos 2 \times \sin 2 \div 2 = 0.872 \text{ pounds.}$$

Thus, the initial string load of 50 pounds has been reduced down to 0.872 pounds. This equates to a reduction ratio of 57.3 to 1 and it fits in a space less than 2". Recall from the prior discussion that the most advanced lever/spring systems of this size can typically only achieve a reduction on the order of 40:1, and they require sound dampening springs and they double the load presented to the axis of rotation. The numbers above are of course only examples and other embodiments contemplate various sizes of parts and reduction ratios. One skilled in the art will also recognize that the basic physical relations shown in FIG. 33 can be used for various sizes and types of camming surface actuators 30 to determine the required slope 340 for each point along a camming surface portion 68 which results in an approximately constant input force requirement.

Accordingly, we will now provide an example of a load optimization calculation 300 which is applicable to the first embodiment of the present invention. The primary purpose of the calculation in this embodiment is to determine the slope for each point along the curve of camming surface portion 68 which results in a constant torque requirement by an input force means regardless of the string tension. The calculation includes the following steps:

1. Measure a required amount of travel for a tension transfer portion 64 for each desired pitch of a string 14. Convert the pitch to frequency in Hertz.
2. Determine an appropriate starting radius for a curve equation which will be used to describe the shape of the camming surface portion 68 as a function $r(\theta)$, where r is the radius 325 of the curve and $\theta$ is the angle 355 in standard polar coordinates. Determine the radius 325 for the curve at each measured point by adding the starting radius 325 to the travel measured in Step 1.
3. Run a simple linear regression analysis to determine a polynomial equation which expresses the radius 325 as a function of the frequency. Typically a second or third order equation works fine, but higher orders are possible.
4. Determine an approximate maximum allowable sweep for the curve given known size limitations for camming surface portion 68.
5. Iterate the following steps:
   (a) Choose a value for a constant torque
   (b) Determine an approximate requirement for a change in $\theta$ between a series of adjacent points $r_1 \ldots r_n$, $r_1$ corresponding the radius 325 at the lowest frequency in the travel and $r_n$ corresponding to the radius 325 at the highest frequency in the travel, with the following equation:

$$\Delta\theta = \frac{M_{avg\Delta}\, r}{r_{avg}}$$

where, $$\Delta\theta = \theta_2 - \theta_1$$

$$\Delta r = r_1 - r_2$$

$M_{avg}$=the average of the mechanical advantage $M_1$ at $r_1$ and the mechanical advantage $M_2$ at $r_2$.
$r_{avg}$=the average of $r_1$ and $r_2$ $$M = \text{mechanical advantage} = \frac{r F_{st}}{T}$$

T=constant torque from (a) above $\approx r F_{st} \sin\phi$
$\phi$=slope of the curve $$F_{st} = \text{force of the string} = \text{string load} = \frac{(21f)^2 m}{k}$$

l=length of the vibrating portion of the string
f=frequency of the vibrating portion of the string
m=mass of the vibrating portion of the string
k=constant=386.4 for units of inches and pounds (c) calculate the sum $\theta_T$ from $\theta_1$ to $\theta_n$ and compare to the sweep from Step 4
   (d) repeat until $\theta_T$=the sweep
6. Perform a linear regression on the values of $\theta$ and r from Step 5 in order to find a function $r(\theta)$ for all values of $\theta$ in the travel of the mechanism.
7. Graph $r(\theta)$ and construct a computer model of the camming surface portion 68 to verify that the curve still works given the size constraints of the mechanism. If not, repeat Steps 4-6 until the curve works with the geometry of the device.

The equation for $_{\Delta}\theta$ above is derived as follows:

The length of an arc s on a circle of radius r is given by:

$$s=r_{\Delta}\theta$$

For small changes in θ the length of the camming surface portion 68's curve from $\theta_1$ to $\theta_2$ is approximately equal to the length of an arc on a circle of the same radius. Therefore, $$_{\Delta}\theta \approx \frac{s}{r}$$

Mechanical advantage is defined as the distance over which force is applied divided by the distance over which force is moved. Therefore, $$M = \frac{s}{_{\Delta}r}$$

$$S = M_{\Delta}r$$

$$_{\Delta}\theta = \frac{M_{\Delta}r}{r}$$

Since the mechanical advantage and radius increase between two adjacent points and since changes in θ are small between two adjacent points, M and r are averaged between $\theta_1$ and $\theta_2$:

$$_{\Delta}\theta = \frac{\left(\frac{M_1 + M_2}{2}\right)(r_1 - r_2)}{(r_1 + r_2)}$$

And, as noted above, T≈r F sin ϕ. In actuality there are two primary modes of string force reduction (aside from friction). First, the force of the string is reduced by the cosine of ϕ because the force vector is at an angle of 90 minus ϕ. Second, the force is reduced by the sine of $_4$) since the firstly reduced force is acting at an angle to the axis of rotation of camming surface portion 68. Therefore, the proper relation, not accounting for friction, is T=r F sin ϕ cos ϕ. However since the slope is typically less than 10 degrees, the cosine of ϕ is always >0.98, and thus the cosine term can be ignored since the friction in the system will likely result in greater losses than this anyway, and it simplifies the calculations.

In another embodiment a higher accuracy for the curve equation is desired, therefore step one above is modified to include measurement of the travel for all of the desired pitches of the string plus all of the eighth tone intervals in between (one eighth tone equals 25% of a half step, where a half step is the standard smallest interval in most western music and as such is equal to the difference in frequency between two adjacent frets on a guitar).

In another embodiment it is desired to reduce the tension of a string 14 all the way down until it is at its resting length and can be removed from an instrument. In this case the load optimization calculation 300 described above is modified to include an additional step which adds additional length to the curve. Since the lowest tension levels do not produce a recognizable pitch, the curve for this portion is simply approximated or derived from a completely separate load optimization calculation which optimizes the curvature based on the steepest slope possible for smooth operation of the mechanism. This way the device can be used to vary the pitch with a constant torque requirement in the normal range of discernible pitches, but then if it is desired to remove the string, the mechanism can quickly de-tension the string as the torque requirement quickly drops close to zero.

In another embodiment a similar load optimization calculation to the one mentioned above is performed, except in this embodiment the purpose of the calculation is to find for a given maximum torque output of an input force means and string force deflection curve, such as a motor or human muscle power, the required sweep angle (θ), curve length, maximum curve radius, and resulting equation r(θ).

In another embodiment multiple load optimization calculations 300 as described above are run for a string 14 with each calculation being done under different operating conditions. For example, one calculation 300 is done for a light gauge string and another is done for a medium gauge string. Then a final equation to use for the camming surface portion 68 is determined by averaging the results of the light gauge and medium gauge equations, thus a curvature results which provides a constant input force requirement for neither case, but a reasonably close approximation for both cases, and thereby a manufacturing cost savings. One skilled in the art will recognize that there are many different methods that could be used to determine an optimum shape for camming surface portion 68 given the different types of instruments, string gauges, and environmental conditions (temperature, humidity, etc.) for which it is intended.

In another embodiment a simple load optimization calculation 300 is desired. Instead of running the calculations described above, a curve equation r(θ) is determined by simply selecting the starting point, midpoint, and ending point radiuses 325 based on a known amount of travel, then finding a known spiral equation of increasing slope, such as a logarithmic spiral, which matches the three data points.

In other embodiments camming surface portions 68 are subject to rotational urging by various combinations of forces acting with different moment arms, at different angles, and with different amounts of friction. In each case a load optimization calculation 300 is performed to determine the shape of the camming surface. Examples of a few of the multitude of types and degrees of forces which could be acting on a rotating portion 74 with a camming surface portion 68 are: full string load, partial string load, light gauge string, medium gauge string, heavy gauge string, servo motor, stepper motor, linear motor, constant force spring, linear force torsion spring, linear force coiled spring, constant torque spring, human power input, etc. Such forces can also be acting on the rotating portion through various force transmission means such as linkages, levers, tension transfer portions of various types, yokes, arms, changer fingers, worm gears, helical gears, planetary gears, spur gears, linear actuators, pulleys, wheels, actuators of various types, etc. Furthermore, such forces can be acting on rotating portion 74 at various angles, with differing amounts of friction, and under various environmental conditions. In each particular case a load optimization calculation 300 can be developed which takes into account some, all, or none of the interacting forces and yields a specific shape for camming surface portion 68 which is optimized for the particular application.

In other embodiments calculations are performed to optimize the shape of a camming surface portion 68 based on additional constraints. For example, in one embodiment a load optimization calculation 300 is designed to yield the maximum load reduction possible given a certain budget limit. In another embodiment a load optimization calculation 300 is designed to yield a constant unidirectional force on a worm gear 80 in order to prevent backlash. In still another embodiment a load optimization calculation 300 is designed to keep the rotational force from a string 10% under the constant force output of a constant force spring 234. One skilled in the art will recognize that there are too many specific combinations of constraints to mention in a short document but that all such combinations are within the scope of the present invention.

The example calculation provided above describes a method for the first embodiment of the present invention which approximately matches a substantially continuously variable mechanical advantage ratio of a camming surface portion to a variable string load. Thus it can be readily seen that a load optimization calculation 300 can be utilized to develop a variable ratio camming surface actuator 30 which can in some embodiments provide a substantially constant input force requirement despite fluctuations in string tension. Such a device is also referred to herein as a constant force pitch alteration device. In other embodiments a load optimization calculation 300 can be utilized to optimize a shape of a camming surface actuator based on a variety of constraints.

First Embodiment

Basic Operation

There are two primary modes of operation for the pitch alteration system 10 of the first embodiment: setup mode and performance mode. Before describing these modes, an explanation of basic operating concepts is required.

The home position pitch 135 is defined as the standard pitch to which a string is tuned when the actuator is physically in its home position 134. For many strings where it is desired to execute pitch change operations 172 that result in the string being both raised above its home position pitch 135 and lowered below its home position pitch 135, the home position 134 could be defined as a point approximately in the middle of the throw of tension transfer portion 64. However, the home position is arbitrarily defined in many cases. For example, in some cases it may be defined as a point near the upper end of the throw if the home position pitch is also the highest note that can be achieved with the string before it breaks. It is also important to note that It is also important to note that since the tension transfer portion's 64 position is directly related to its angular point of contact with camming surface portion 68, the home position is substantially permanently linked with a specific amount of angular rotation of rotating portion 74, which in turn is directly correlated to a specific rotational position of the motor 60, unless there is no desire to maximize the efficiency of the mechanism by means of a variable ratio as will be discussed below. In the case of said first embodiment under discussion now camming surface portion 68 does include a variable slope and therefore the home position is correlated to the angular position of the rotating portion. Please note that this fact results in the disadvantage of needing to maintain the home position pitch at its correct frequency without moving the actuator if maximum efficiency is desired. However, in practice small amounts of deviation from a perfect alignment of home position pitch and the physical home position are not a significant problem, and most prior art devices have a fixed amount of throw as well so they still have this problem too. However, as will be seen in other embodiments, the reduction capabilities of the inventive device for a given size are so high that it is possible to construct a camming surface actuator of reasonable size that is capable of taking a string all the way from a fully relaxed state to its highest tension level before breaking; therefore in some embodiments very close alignment of the home position pitch and the home position is possible by simply creating a homing routine which is based on a known travel from a fully relaxed state up to the home position pitch; this routine could of course be compensated for string aging and other factors as will be discussed below. Furthermore, small drops in efficiency are more than made up for since the inventive device is significantly more efficient than prior art devices.

The primary pitch alteration function of the inventive device is referred to herein as a pitch change operation 172. A pitch change operation 172 is defined as any operation which alters the pitch of at least one string 14 on instrument 12. A pitch change operation 172 can contain a plurality of relative pitch change requests 142 and can effect a plurality of strings 14 at the same time. Furthermore, a single pitch change operation 172 can contain multiple signal streams 174 for the same string resulting in additive effects and current position pitch relativity (discussed below). There are two sub-types of pitch change operations 172: automatic pitch change operations 168 and manual pitch change operations 170. An automatic pitch change operation 168 generates signals automatically over a period of time once initiated (based on prior programming), whereas a manual pitch change operation 170 requires human input 140 for each signal that is sent to controller 52. Examples of an automatic pitch change operation 168 are a pre-programmed series of pitch changes that oscillate periodically to create a vibrato effect, a series of chord changes that happen relative to a tempo, a simple constant rate increase or decrease in pitch for the purposes of tuning, and many others. Examples of a manual pitch Examples of a manual pitch change operation 170 are chord changes initiated by pressing of buttons on a control signal generator, user controllable pitch tracking of one or multiple strings as a device such a MIDI continuous controller foot pedal is moved up and down, assignment of multiple virtual pedals on an optical controller as described below to individual notes on a bass string thereby allowing organ-like performance of bass lines with the feet, and many others.

A relative pitch change request 142 is simply a request for the current pitch of the string to be altered by a specific number of semitones and percentages, or "cents", thereof, and it is always calculated relative to at least one other relative pitch change request 142. On the other hand, prior art pitch change requests are always directly linked to an absolute pitch of a string. In a first example, if a first pitch change request in a prior art device asks for the pitch to be lowered by one semitone and a second subsequent pitch change request that is activated while the sting is still held one semitone flat (because of the first request) asks for the pitch to be lowered by two semitones, the result is an actual pitch that is two semitones lower than the home position pitch of the prior art device. If the same scenario is repeated for the first embodiment of the present invention, the resulting pitch is 3 semitones lower since the second request of −2 is calculated relative to the first request of −1. This problem in prior art devices results in the user never having the ability to easily create relative pitch change effects. In a second example, a desirable effect is to first lower the pitch of a string by two semitones then have that lowered note oscillate with a smooth sine wave vibrato effect with a period of 500 milliseconds and a depth of 10 cents (0.1 semitones). There are two ways to create such an effect with prior art devices. One way is to issue a series of pitch change requests which all reference the desired location at each point in time relative to prior art home position pitch. The problem with this approach is that every unique pitch alteration operation which utilizes the stated vibrato effect, of which there are an enormous number, requires a different set of pitch change requests, resulting in an enormous amount of programming. A second prior art solution is to have the vibrato created by virtue of a variable rate of oscillation of motor 60. This is problematic though because ultimately the variable rate of oscillation of motor 60 is varied by a variable rate of motor position requests; again, requiring an enormous amount of programming if it is to be realized in practice. The problem is solved by the invention of the first embodiment by simply creating a layer on top of the absolute motor position layer which resolves the relative pitch effects before telling the motor where to go. More specifically, a system of current value fields 146 is implemented so that controller 52 can store in memory various relative pitch change requests 142 thereby enabling relative pitch determination based on past pitch change history. Continuing with the example, pitch alteration system 10 defines one pitch change operation 172 as the two semitones of pitch reduction and a second pitch change operation 172 as the vibrato effect. When first initiated, the first pitch change operation lowers the pitch by two semitones, then the vibrato progresses over time always referencing the new pitch, which is two semitones below home position pitch 135. In this way this single vibrato effect can now be applied to any other pitch change operation 172 or simply used on its own.

When a pitch alteration request is for a memorable pitch or one that a user will return to often, such as one whole step below home position pitch 135, it is referred to as a pitch stop 136. Theoretically, any amount of pitch displacement from home position pitch 135 can be defined as a pitch stop 136, but in practice there's not usually a strong reason to define the pitches in between semitones except in certain situations. Typically, the highest and lowest note of automatic and dynamically controlled vibratos are defined as pitch stops 136 so that the extremes can be tuned. Pitch stops 136 are normally defined so that pitch stop 136 can be tuned relative to home position pitch 135 as discussed below. Pitch stops 136 may be freely defined by the user and stored in controller 52 memory or in any storage medium. Pitch change operations 172 typically contain various combinations of relative pitch change request's 142 and pitch stops 136. Pitch change operations 172 can be further organized into patches and libraries as is customary with data of various kinds. In one embodiment Music Instrument Digital Interface (MIDI) is utilized as a communications protocol. This allows a user to use standard MIDI messages such a program changes, continuous controllers, and the like to relay pitch alteration information between control signal generator 34 and controller 52. Other communications protocols are also suitable.

The above discussion can be summarized by saying that the inventive device of the first embodiment adds significantly to the capabilities of prior art devices by implementing a multilayer, relative pitch strategy which enables greatly simplified access to a wide range of pitch alteration possibilities. When viewed over a period of time, multiple signal streams of relative pitch change requests 174 are resolved in real-time to yield a single signal stream of pitch alteration requests 176 which are correlated to a stream of motor position requests 182 and then converted by a compensation calculation into a stream of new motor position requests 178 which cause the motor to move and therefore alter the pitch of a string 14.

First Embodiment

Setup Mode

Before proceeding, it is important to point out the difference between an automatic tuning device and the first embodiment under discussion. The primary purpose of the first embodiment of the present invention is to allow the user to manipulate the pitches of strings in real time. Stringed instruments are tuned and then they are played. This first embodiment is focused on the latter. Automatic tuning devices, however, are focused on the former. Because of these two very different design goals, prior art automatic tuning devices require a minimum of 2 seconds to actuate a change of two semitones, whereas the first embodiment can actuate a two semitone change in less than 0.1 seconds. This factor of 20 speed difference is what enables the first embodiment to operate in a real-time pitch change environment unlike automatic tuning devices. However, the fact that the first embodiment of pitch alteration system 10 comprises a motorized actuation system 29 means that there are many automatic tuning methods which work quite well in association therewith. Furthermore, the increased speed of the first embodiment allows it to substantially reduce the time required for a complete automatic tuning operation as compared to prior art automatic tuners. Therefore, another embodiment of pitch alteration system 10 is the same as the first embodiment except that it also includes a transducer and automatic tuning software for enabling the automatic tuning of pitch stops 136.

Setup mode is for executing a homing routine, tuning of home position pitch 135, defining and tuning of pitch stops 136, defining and editing pitch change operations 172, creating and updating compensation algorithms, and defining relationships between specific control elements of control signal generator means 34 and specific pitch change operations 172. A user activates setup mode by engaging with control signal generator 34 to send a command for setup mode or by powering up the system.

Assuming that the system has just been powered up, a homing routine must be executed before entering performance mode so that the system is certain that all motors 60 and therefore all actuators 30 are in their home positions. There are many variations of such a routine but the basic concept is for a software routine to initiate a sequence of steps which reliably moves all actuators 30 to their respective home positions. In said first embodiment the homing routine slowly rotates motor 60 in a direction which causes rotating portion 74 to rotate such that tension transfer portion 64 moves in a direction toward the string thereby lowering the tension thereof. Slow rotation of motor 60 also causes the generation of motor count messages from encoder 62 to controller 52. When bearings 66L and 66R reach the end of grooves 128L and 128R, tension transfer portion 64 is forced up and into alignment bushings 65*a*L and 65*a*R and stops movement since motor 60 cannot overcome the load presented. Cessation of movement results in a cessation of motor count messages and therefore controller 52 determines that actuator 30 is in fact in its lowest position. At this point controller 52 executes a sequence of commands that results in motor 60 turning a predetermined number of rotations which bring it to the home position. The correct number of rotations of motor 60 is determined by using an equation that relates the angle of rotation, θ, of rotating portion 74 to the radius of camming surface portion 68 (discussed below) to determine the change in θ relative to the amount of throw required, which is simply the difference in a radius at the lowest position and the radius at the home position as discussed above. The angle θ is then converted into motor rotations by multiplying by the ratio of worm gear 80.

The next step after moving all actuators 30 to their respective home positions is to tune the home position pitch 135 for each string. Tuning of each string is accomplished by rotation of tuning pegs 22 in the usual manner. In other embodiments this step is accomplished by movement of actuator 30, but as mentioned above there are efficiency penalties if the actuator moves away from home position 134. It should also be noted that automatic tuning of home position pitch 135 via actuator 30, while it is possible, is only appropriate if efficiency losses are acceptable since the tuning process will likely move the actuator away from its home position 134. However, automatic tuning via a separate actuator works without efficiency losses.

Continuing with the discussion of setup mode, another task possible in this mode is the definition of pitch stops 136. The definition of a pitch stop 136 creates a direct correlation between a number of semitones and cents thereof of displacement away from home position Pitch 135 and a specific number of motor rotations and subdivisions thereof away from motor home position 134. In other words defining a pitch stop 136 converts semitones of displacement into motor rotations of displacement. The number of motor rotations is then used as a requested motor position 180 for input into compensation calculation 150. A pitch stop 136 can be defined by semi-automatic or automatic means. Semi-automatic definition, which employs motor 60 but not a transducer circuit, involves the steps of:

(a) If not already done, run homing routine and tune home position pitch as discussed above.

(b) Engage or virtually engage via movement of control object 50 into an active zone 45 with control signal generator 34 to initiate a special pitch change operation 172 which slowly raises or lowers the pitch of a string (see below). Stop when current pitch equals the desired pitch for the pitch stop 136. If desired, a typical handheld tuner or the like can be employed to aid in the determination of the correct pitch to use as the pitch stop 136.

(c) Engage or virtually engage via movement of control object 50 into an active zone 45 with control signal generator 34 to send a "store" command, storing current pitch as a pitch stop 136 in a specific memory location of controller 52.

The definition of pitch stops 136 for each string 14 can also be accomplished by means of an automatic tuning device as mentioned above. Such devices typically include a transducer of some sort which measures the frequency of a string 14 then moves an actuator in response to the amount of discrepancy between the measured frequency and a target frequency. In some embodiments a transducer and an automatic tuning function are incorporated enabling automatic pitch stop 136 definition as follows:

(a) If not already done, run homing routine and tune home position pitch as discussed above.

(b) Select desired pitch via automatic tuning function and initiate a command which measures the frequency of string 14, moves actuator to desired pitch using either a closed loop or open loop tuning process, then stores new location as a pitch stop 136.

Generally speaking, the definition of all pitch stops 136 for a particular pitch change operation 172 should be done with all other strings at the tension level that they are going to be at when the pitch stop is activated. Since pitch stops are at the layer below relative pitch change requests 142, the tuning of pitch stops may require the activation of all pitch change requests 142 associated with the pitch change operation 172. There are three modes of tuning pitch stops 136 provided. First, the user activates tuning mode and sends the pitch change operation 172 that is to be tuned. All strings within the pitch change operation 172 that include manual pitch change operations 170 will be moved to their previously defined pitches. All strings which include automatic pitch change operations 172 will be moved to the first pitch called for by the automatic pitch change operation 168. Subsequent pitches can be scrolled through and tuned as needed. In cases where the user does not want the automatic pitch change operation 168 influencing the manual pitch change operation 170 tunings, the automatic pitch change operations can be scrolled such that their actuators 30 are in home position 135. Once all actuators are positioned as desired, each pitch stop 136 within the pitch change operation 172 is tuned in the same way that it was defined originally, by simply moving the actuator until the pitch meets the target pitch then engaging, or virtually engaging via movement of control object 50 into an active zone 45, with control signal generator 34 to send a "store" command, storing the current pitch as a pitch stop 136 in a specific memory location of controller 52. In this way the pitch is tuned by simply writing over the old definition. Any pitch alteration requests 149 within an automatic pitch change operation 168 which do not have pitch stops associated with them, for example a string of pitch alteration requests between the peaks of a vibrato, have their respective requested motor positions 180 calculated automatically from the extremes of the vibrato. The second mode of tuning pitch stops 136 is essentially the same as the first except that an automatic tuning function is included so that the frequencies can be determined automatically. As is known in the prior art, all pitch stops 136 for a pitch change operation 172 can be automatically tuned simultaneously by a single strum of all affected strings, then individual transducer elements for each string provide the separate pitches for simultaneous analysis and tuning. The third mode of tuning pitch stops is in performance mode which will be discussed below.

In the first embodiment pitch change operations 172 are created by engaging, or virtually engaging via movement of control object 50 into an active zone 45, with control signal generator 34 for the purpose of associating the new pitch change operation 172 with a name and identification number thereby allowing control signal generator 34 to associate it with buttons, switches, menus, etc. In other embodiments pitch change operations 172 are created by the controller 34 and still others allow for creation of pitch change operations 172 in a computer. For creation of automatic pitch change operations 168, the user programs the string 14 number and relative pitch change requests 142 relative to a tempo and optional repeat cycle. Relative pitch change requests 142 are programmed for all current value fields 146 desired. Unused current value fields are set to zero so that they do not effect the pitch alteration request calculation. Manual pitch change operations 170 are created by programming the string number and relative pitch change requests 142 which will be sent immediately to controller 52 upon activation of the manual pitch change operation 170 by the control signal generator 34. All pitch change operations 172 can be called up at a later time for editing and or deletion.

The final task available in setup mode is for creating and updating compensation algorithms. A compensation algorithm is any function, series of equations, lookup table, or empirically derived set of values that has as its input a pitch alteration request plus at least one other variable and as its output a compensated new motor position 160. As seen in FIG. 10 there are four basic types of compensation algorithms: operating conditions compensation 158*a*, tuning compensation 158*b*, deformation compensation 158*c*, and global compensation 158*d*. While the first embodiment includes all types, other embodiments don't include any while others have various combinations of those mentioned. The upshot is that no compensation algorithms are necessary for basic functioning of the system 10, however, inclusion of one or several will help the instrument to play in tune, thereby reducing complications for the user. While many of the algorithms to be discussed here have a very small effect, on the order of several cents, the most significant is the deformation algorithm 158*c*. Since many embodiments have the ability to radically alter the pitch of strings 14, in some cases over an octave, some level of instrument deformation compensation is generally a good idea. For example, the reduction of a single string on the 8-string guitar under discussion by a musical fourth, or 5 semitones, will result in the rest of the strings going sharp by about 10 cents.

The overall compensation concept for this embodiment works as follows. First each algorithm 158 requires a setup procedure. From thereon the algorithms 158 can be calibrated with a simpler procedure if needed. Once an algorithm 158 has been setup, a formula, a fixed value, or a lookup table is created which determines an amount of correction required to a requested motor position 180 in order to convert it into a new motor position 160. Thus, a new motor position 160, written as $P_{motor}$, for an actuator 30 is calculated as follows:

$$P_{motor}=P_{request}+{}_{\Delta}P_{act}+{}_{\Delta}P_{amb}+{}_{\Delta}P_{hum}+{}_{\Delta}P_{tuning}+{}_{\Delta}P_{deform}+{}_{\Delta}P_{global}$$

where:

$P_{request}$=requested motor position 180

${}_{\Delta}P_{act}$=compensation amount due to actuator temperature ${}_{\Delta}P_{amb}$=compensation amount due to ambient temperature ${}_{\Delta}P_{hum}$=compensation amount due to humidity ${}_{\Delta}P_{tuning}$=compensation amount due to tuning changes made in performance mode ${}_{\Delta}P_{deform}$=compensation amount due to instrument deformation ${}_{\Delta}P_{global}$=compensation amount due to global factors.

Compensation due to actuator temperature, ${}_{\Delta}P_{act}$, is an important factor if the actuator is varying significantly in temperature as it is being used. For example, thrust bearing 86 can expand and contract enough to cause a noticeable difference in pitch between the extremes of the temperature range. Therefore ${}_{\Delta}P_{act}$ is calculated by determining the number of motor rotations of correction required for various temperatures. Motor rotations are determined by activating ${}_{\Delta}P_{act}$ mode within the setup mode, moving motor to home position, changing the actuator temperature, then altering pitch until it is back in tune, then hitting "store" which causes controller 52 to store the number of motor rotations associated with the current temperature reading provided by actuator temperature sensor 152. This procedure is repeated until a sufficient number of data points are logged. Upon exiting ${}_{\Delta}P_{act}$ mode the controller will run a linear regression analysis on the data and determine a polynomial equation which represents a close approximation of the relationship between actuator temperature and ${}_{\Delta}P_{act}$. In other embodiments the data points are simply stored in a lookup table without running a linear regression analysis. Since the actual value that is used in the above formula requires real-time updating, it is provided in one of three ways. The first option is to recalculate ${}_{\Delta}P_{act}$ for every requested motor position. However, due to the speed requirements of the real-time system 10, the second option is to simply have the calculation run once every few seconds or minutes, then update a value field. The third option is to simply store values for ${}_{\Delta}P_{act}$ and temperature in a lookup table as mentioned above.

Compensation due to ambient temperature, ${}_{\Delta}P_{amb}$, and compensation due to humidity, ${}_{\Delta}P_{hum}$, are both calculated according to the same method as ${}_{\Delta}P_{act}$. However these two variables are much less significant, and thus will likely only need to use the lookup table method outlined above. In other embodiments the more rigorous linear regression is implemented, but the calculation does not need to be repeated for every requested motor position since the results of ${}_{\Delta}P_{amb}$ vary by the hour and ${}_{\Delta}P_{hum}$ by the day. Thus, each variable includes a value field which is updated approximately every 30 minutes.

Compensation due to tuning, ${}_{\Delta}P_{tuning}$, is implemented as a means to allow the user to quickly and easily update the tuning of pitch stops 136 during a performance. Thus for most cases this value will be zero. But if the user finds that a pitch stop 136 is out of tune, he or she can easily correct the pitch by engaging, or virtually engaging via movement of control object 50 into an active zone 45, with control signal generator 34 to correct the problem. Any tuning changes like this that occur during performance mode are linked with the pitch stop 136 and show up in ${}_{\Delta}P_{tuning}$ when that pitch stop is activated. The user has the option later of saving those changes in setup mode.

Compensation due to instrument deformation, ${}_{\Delta}P_{deform}$, works as follows. Each string has about 10-20 possible pitches. This limit comes from the strings themselves which can only be pulled so tight before breaking and will only generate a musical pitch down to a certain tension level. Therefore ${}_{\Delta}P_{deform}$ is a function of the current state of all motor positions added together, or $P_{total}$. It is calculated for this first embodiment by first moving all motors to home positions 134 and initiating ${}_{\Delta}P_{deform}$ mode within setup mode. Then move all 8 motors into a first position, tune the string being analyzed, hit "store" and controller 52 records the total of all motor positions plus the number of motor rotations required to re-tune the string 14. Repeat this process until enough data points are recorded. Upon exiting ${}_{\Delta}P_{deform}$ mode the controller will run a linear regression analysis on the data and determine a polynomial equation which represents a close approximation of the relationship between ${}_{\Delta}P_{deform}$ and $P_{total}$. Given the real-time necessity of this compensation variable, the equation is then calculated for every requested motor position or if there is not enough processor speed to accomplish this, the equation is used to generate a lookup table which is accessed by every requested motor position 180. In another embodiment, the deformation equation is used to modify pitch stop definitions.

The final compensation variable, ${}_{\Delta}P_{global}$, accounts for global pitch issues such as age of strings or presence of a capo. In other embodiments the ambient temperature and humidity compensations above are included in this category as well. The value for ${}_{\Delta}P_{global}$, is determined through the same linear regression process as described above for actuator temperature except instead of analyzing the temperature, other variables such as capo first fret, capo second fret, strings one week old, etc. are compared to their respective amounts of motor rotation correction required, then summarized in a formula. Since global issues such as these are not real-time issues, the value in ${}_{\Delta}P_{global}$, is determined by the user selecting from a list of global parameters which currently apply (before performance), then each applicable calculation is run and the total of all compensations is stored in ${}_{\Delta}P_{global}$.

The final setup procedure step involves the defining of relationships between specific control elements of control signal generator means 34 and specific pitch change operations 172. In this first embodiment control signal generator means 34 comprises a virtual pedal based on real-time position measurement of control object 50 relative to sensor portion 40. The device includes virtual buttons and sliders comprised of active zones 45 which are symbolized by foot path markings 46. A "press" of a virtual button is caused by control object 50 entering the active zone of a virtual button and being sensed by a plurality of integral infrared optical sensors inside sensor portion 40. A "slide" of a virtual slider is caused by horizontal movement of control object 50 within active zone 45 of the virtual slider. It is therefore necessary to associate various virtual button "presses" and virtual "slides" with specific pitch change operations 172. The process is accomplished by selecting a pitch change operation 172 via engagement or virtual engagement with control signal generator means 34, then selecting a virtual button or slide to activate it. For example, a user could decide to associate a "press" in the leftmost footpath marking area with the execution of a pitch change operation 172 which lowers the first two strings by 2 semitones and raises the third string by 4 semitones.

Before the first use of the system 10 it is also necessary to calibrate active zones 45 with control object 50 relative to the typical movements that come natural to the user. The process involves an iterative adjustment of active zone 45 via engagement with setup buttons 39 as the foot is moved into an out of active zone 45. Adjusting the size of active zone 45 translates internally in control signal generator 34 as adjusting boundaries within the viewable range of infrared optical sensors inside sensor portion 40. Adjustable parameters include, but are not limited to, active zone height, width, and depth. Specifically, it is important to set the height such that a "press" is registered slightly before the foot contacts the floor. The exact amount of anticipation is dependent on the user's foot speed and the types of pitch change operations played where speed is most critical. For example, if the user tends to play a lot of two semitone pitch change operations where timing is critical, he or she would experiment with the height of active zone 45 until the "press" anticipates floor contact by approximately the amount of time that it takes the system 10 to actuate a two semitone operation, typically about 50-80 milliseconds, though other speeds are possible depending on a number of system parameters. In this way the slight delay in movement is mostly eliminated since the user will be conditioned to try and tap the foot on the floor in time with the current tempo of the music. Exact matching of the anticipation time and delay time are non-critical since an acceptable real-time performance deadline for this type of an application is 100 milliseconds. It is difficult for most people to detect a delay of less than 50 milliseconds, so anything under 100 milliseconds is in the range of workable from a musical performance perspective; especially since the musician can always intentionally anticipate the beat slightly as well. In other embodiments a real-time performance deadline is set higher to 250 ms to enable lower end-user cost. In other embodiments the size of active zone is controllable in real-time by the user. In still others the active zone size parameters are tied to a tempo source such as MIDI beat clock; and others attach active zone size parameters to each pitch change operation 172.

First Embodiment

Performance Mode

Once pitch alteration system 10 has been properly setup as described above, it is ready for performance. Since the system 10 is installed in stringed instrument 12 in a way that does not alter the basic playing surfaces, such as the neck, fingerboard, frets, strings, and body, instrument 12 can be played in the usual fashion. Pitch alteration system 10 essentially adds a whole new range of functionality without taking away from the original instrument 12. From a performance perspective pitch alteration system 10 of the first embodiment adds the capability of individually raising the pitch of each string 14 by up to 4 semitones and lowering the pitch of each string by up to an octave without requiring any force input by the user or sound dampening springs. The system 10 also provides real-time tracking of string pitch to one or multiple input signals enabling relative pitch change functionality and almost instantaneous access to notes without having to fret a string 14. The system 10 executes typical pedal steel-type pitch changes in less than 100 milliseconds, which in many cases is faster than even possible on a pedal steel. The system 10 is small, quiet, and lightweight and comprises an innovative virtual foot pedal which complements the added musical functionality with a control device that is tailored to the unique capabilities of the system 10. And furthermore, the system 10 provides a means for both manual and automatic execution of pitch changes, opening up whole new areas of musical expression that were not previously possible. Other benefits will be described as well.

The following is a partial list of some possible pitch change operations 172 which the first embodiment is capable of executing:

A. Pedal steel pitch changer type functionality: rapidly raise the pitch of a string 14 to specific, pre-defined pitch; rapidly lower the pitch of a string 14 to specific, pre-defined pitch; hold string 14 at altered pitch until user terminates operation or until a pre-programmed time interval has elapsed, then return string to original pitch; rapidly alter the pitches of any combination of strings 14 all at the same time and each by a pre-defined amount specific to that string.

B. Advanced bass, chord, and melody functions: enable playing of an enormous number of fretted chords that were previously impossible to play due to the physical size of the typical human hand; enable playing of melody lines in new and unusual ways, and in some cases enable the performance of melodies that were not previously possible; enable the playing of bass lines without requiring the fretting of notes, thereby opening up new possibilities in simultaneous bass, chord, and melody playing.

C. Advanced tremolo bar type functionality: dynamically raise or lower the pitch of all strings 14 together according to real time user input and without pitch compensation between strings, similar to a typical tremolo bar; dynamically raise or lower the pitch of one string 14 or any combination of strings 14 according to real time user input and without pitch compensation between strings 14; dynamically raise or lower the pitch of all strings 14 together according to real time user input and with pitch compensation between strings 14, such that the interval relationship between all strings 14 is maintained throughout the pitch alteration operation (for example, two strings which are tuned a $4^{th}$ apart like the A string and the D string will stay a $4^{th}$ apart); dynamically raise or lower the pitch of one string 14 or any combination of strings 14 according to real time user input and with pitch compensation between strings 14.

D. Effects: create periodic vibrato by repeatedly altering the pitch of a string 14 by a pre-defined amount in a pre-defined pattern over time, such as sinusoidal, square wave, saw tooth, etc., and at a pre-defined tempo; create shaped vibrato by altering the pitch of a string 14 according to a pre-defined tempo and pitch alteration program; create randomized vibrato by altering the pitch of a string 14 according to controller generated random pitch and tempo sequences; create dynamic pitch controlled vibrato by altering the pitch of a string 14 at a regular, pre-defined interval by a user controlled dynamically varying pitch alteration amount; create dynamic tempo controlled vibrato by altering the pitch of a string 14 by a fixed amount with a user controlled dynamically variable vibrato tempo; create tap tempo vibrato by altering the pitch of a string 14 at a periodic tempo which is determined by the amount of time between two "taps" by a user on control signal generator 34; create phase altered vibrato by altering the pitch of two or more strings according to any periodic vibrato scheme, but intentionally initiating the vibrato on different strings at different times such that the resulting vibratos of different strings are out of phase by pre-determined amounts; create tremolo effects by all of the above vibrato effects except increase the amount of pitch alteration for each cycle so that the effect is more tremulous; create string to string polyphonic chorusing by slightly altering the pitches of any combination of two or more strings by pre-determined amounts and pre-determined pitch curves in order to create an advanced type of polyphonic chorus effect; create dynamic polyphonic chorusing, same as string to string polyphonic chorusing above except that polyphonic chorus variables like speed and depth are controllable by the user in real time via control means; create automatic dive bomb effects, radical, automatic alterations of pitch according to pre-determined pitch change curves; create tape deck bend emulator by immediately dropping the pitch of a string 14 very low upon actuation, then snap back up to original pitch in order to emulate the sound of a stopped tape starting back up; create chord tone jumping effects by dropping and raising notes within a fretted chord to other surrounding chord tones.

E. Automatic Functions: create semi-automatic performances by "playing" sequences of chord changes and melodies which execute the pitch changes required, then the performer has the option of plucking, strumming, etc. as loud or as quiet as desired, thus providing more of a human "feel" to the sequence; create mechanical loops by allowing a user to record a series of pitch change operations 172 in real-time, then cycling (or looping) the sequence allowing new modes of playing.

F. Relative Pitch Change: alter the pitch of any combination of strings utilizing any combination of effects, wherein more than one effect can be applied to the same string simultaneously where applicable (for example polyphonic chorus-effect de-tunings can ride on top of a larger vibrato wave); initiate effects like vibrato and polyphonic chorus and have the effect continue with the same amount of relative pitch change as pedal steel-type changes and tremolo bar-type operations are executed.

In addition to the many types of pitch change operations possible, the pitch alteration system 10 of the first embodiment also provides unique expressive capabilities via control signal generator 34. Control signal generator 34 falls into the general category of devices which enable a performer to control an instrument, generally referred to as controllers. Typical prior art devices include manual pedals, levers, switches, buttons, and stops and more modern electronic devices such as MIDI foot pedals, continuous controller pedals, control surfaces, touch pads, touch screens, mice, and keyboards. All of these electronic devices are suitable for use with the present invention, however it is desired to have a device specifically tailored to the many musical possibilities available with the inventive device. For example, a MIDI foot pedal, as are widely available, is used in one embodiment. "One-shot" manual pitch change operations 170 which alter the pitches of strings between two states (as in a pedal steel-type chord change) and automatic pitch change operations 168 are assigned to various footswitches on the pedal and the pedal's additional continuous controller pedals are assigned to dynamic pitch change operations 172 for real-time pitch tracking of the pedal position. While this MIDI foot pedal works fine, it is difficult to quickly switch between two different pedals due to the rectangular shape and required stiffness of the footswitches (they must be robust in order to withstand being stepped on constantly). Furthermore, the device is large and heavy relative to the number of separate pitch change operations 172 that can be readily accessible through a single patch and a lack of ergonomic design features makes it difficult to play while standing.

The inventive control signal generator 34 of the first embodiment solves these prior art problems by replacing the physical structure of the unit with infrared light, thereby reducing size and weight and enabling the easy daisy chaining of multiple units for a large number of easily accessible pitch change operations 172. All the user needs to do is simply tape out on the floor or roll out a mat with pre-printed foot path markings 46 and a large number of virtual switches are instantly available. For example, in one embodiment 5 separate electromagnetic radiation sensors 36 are daisy chained together forming an array of 25 virtual pedals which can all fit in a small suitcase. In addition to the size benefits, control signal generator 34 provides unique expressive control possibilities due to the fact that sensor 40 can track the horizontal and vertical position of control object 50. Therefore the device can register a button "press" when the user's foot gets close to the floor as discussed, but then the user can pivot the foot on the heel, sliding the toes or toe-end of a shoe along the floor creating a virtual "slide" signal similar to slider or fader. A heel pivoting and sliding action like this is much faster and easier to control than a typical continuous controller foot pedal. Various positions within the slide zone can then be mapped to dynamic control aspects of pitch change operations like vibrato and polyphonic chorus parameters as well as pitch change amount. In a first example a "press" on the farthest active zone to the left initiates a pitch change operation which lowers a string 14 by an octave. The user can then ergonomically slide the toes around to the right to dynamically raise the pitch back up to its home position pitch 135 which is mapped to say the middle active zone. Sliding the toes back and forth between the leftmost and center active zones results in the pitch of the string following the motion of the toes as they move between one octave below and home position pitch 135. In this example the user also has the option a lifting the toes out of the active zone which programably either leaves the pitch at its last position before leaving or automatically goes back to another pitch such'as home position pitch 135. Furthermore, the user can pivot about the heel with the toes up and whenever it passes into an active zone a "press" is registered which initiates a pitch change operation. Experimental tests have shown that this method of "pressing" buttons is about twice as fast as the pressing of button on a typical MIDI foot pedal due to the ergonomic heel pivoting action and ability to shape active zones to a users natural movements. Plus the ergonomics make performing while standing much easier since the motions are similar to typical dance "moves" and don't require stomping on stiff footswitches. In a second example, the virtual slide motion between and within active zones is mapped to the rate of a vibrato so that the user can control the vibrato speed with the foot while still playing with both hands, possibly even synchronizing the vibrato "by ear" to the music currently being performed. As one skilled in the art will recognize, control signal generator 34 of the first embodiment greatly increases the expressive capabilities of the overall pitch alteration system 10.

In order to more fully explain the specifics of operation while in performance mode, we will now examine an example pitch change operation 172 from start to finish. All numbers provided in this example are purely hypothetical and are not meant to limit the first embodiment in any way; they are provided only to help explain the functionality thereof. With pitch alteration system 10 completely set up as described above, a user outfitted with control object 50 attached to the upper portion of his right shoe approaches control signal generator 34. He begins to move his right heel toward heel pivot point marking 48 with his toes lifted so as to avoid dipping control object 50 too low and causing a virtual button "press" by entering an active zone 45. Now with his heel comfortably resting on top of heel pivot point marking 48 and his toes still lifted he begins to play instrument 12 in the usual manner at an approximate tempo of 120 beats per minute. When he reaches a particular point in the song, he swings his toes down and taps on the second curved area from the right as indicated by foot path markings 46. He intentionally taps in the middle of the curved area indicated by foot path markings 46 in this zone. As soon as the bottom of his foot, at the current velocity that it is moving, is approximately 83 milliseconds from the floor, control object 50 enters active zone 45 for the second curved area from the right. As soon as control object 50 crosses into active zone 45, infrared optical sensors inside sensor portion 40 send a signal which causes control signal generator 34 to recognize that infrared transmitters on control object 50 are now in active zone 45 in the location of the second curved area from the right; and this causes control signal generator 34 to recall a correlated manual pitch change operation 170 from memory. Manual pitch change operation 170 is designed to lower the pitch of strings #2 and #3 by 3 semitones and one semitone respectively and thus contains: a first relative pitch change request which comprises a request identification code for the purpose of updating current value field 146*a* of string #2 with a requested amount of pitch alteration of −3 semitones; a second relative pitch change request which comprises a request identification code for the purpose of updating current value field 146*b* of string #2 with a requested amount of pitch alteration of zero semitones (since it is desired with pitch change operation 172 to clear any relative effects); and similar information for string #3 as will be clear to one skilled in the art. Continuing now following what happens on string #2, control signal generator 34 sends a relative pitch change request message 142*b* to controller 52 which causes controller 52 to replace the current value of current value field 146*b* with zero and a second relative pitch change request message 142*a* to controller 52 which causes controller 52 to replace the current value of current value field 146*a* with a value of −3 semitones. Since the first message was zero, no pitch alteration occurred, but when the second message is received at current value field 146*a*, since it is non-zero, it causes a pitch alteration request 149 of −3 semitones to be issued (since zero plus −3=−3). Controller 52 now matches the pitch alteration request of −3 semitones with a predefined −3 semitone pitch stop 136 to generate a requested motor position 180 of −1,652 motor counts, which is the stored motor count amount for the activated pitch stop.

Next a compensation calculation retrieves the following values from lookup tables for compensation: +20 motors counts for actuator temperature, +2 motor counts for ambient temperature, −1 motor count for humidity, +0 motor counts for tuning, and +5 for global factors. A stored formula then calculates a deformation compensation amount of +50 motor counts. As noted above the deformation formula provides a compensation amount based on the current state of all motor positions and since they have not moved yet for this particular pitch change operation, the deformation calculation uses a "look ahead" technique to anticipate the positions of all motors based on the currently known requested motor positions 180. In other embodiments this process is simplified by simply having the deformation compensation formula reference the requested motor position 180 or this value along with another variable. Other embodiments apply the deformation calculation just before new motor position 160 is reached. The total of the proceeding compensation values, +76 motor counts, is then added to the requested motor position 180 of −1,652 motor counts to yield a new motor position of −1,576 motor counts, which immediately causes controller 52 to send power to motor 60 such that it moves −1,576 motor counts away from its current position. Controller 52 engages in a closed loop communication process with encoder 62 in order to correctly guide motor 60 to new motor position 160. Rotation of motor 60 causes worm 82 to rotate thereby causing worm gear 80 and rotating portion 74 to rotate. Due to a worm gear 80 reduction ratio of 30:1, rotating portion 74 rotates substantially slower than motor 60. As worm 82 rotates the teeth of worm gear 80 remain pressed against the rearward side of the slight gap between the teeth due to a clockwise rotating force exerted on rotating portion 74 by the tension in string 14, which pulls on tension transfer portion 64, which contacts camming surface portion 68 via bearing means 66 at a non-zero angle. As bearing means 66 rolls along camming surface portion 68, the slope relative to camming surface portion 68 increases along with an increasing radius from axle portion 77 to a point of contact between bearing means 66 and camming surface portion 68, resulting in an approximately constant clockwise force being exerted on worm 82 by worm gear 80 despite a reduction in string 14 tension. As bearing means 66 rolls along camming surface portion 68, tension transfer portion 64 is urged into an approximately linear direction of travel away from axle portion 77 thereby lowering the pitch of string #2, once motor 60 has ceased rotation, by three semitones. The entire operation from the time when the user taps on the second curved area from the right, indicated by the dot at 190 in FIG. 13, to the cessation of all motor movement upon arrival at new motor positions 160 is contemplated to be approximately 83 milliseconds though other times are possible.

First Embodiment

Real-Time Performance

Continuing now with an analysis of the just completed pitch change operation 172 example and referring to FIG. 13, it is pertinent to discuss the real-time performance of the system as it received a request and executed a corresponding operation. A "soft" real-time deadline as is commonly described for real-time systems similar to the present invention is one in which a failure to meet the deadline does not result in a catastrophic loss but rather results in substantially reduced service quality. The real-time deadline represents the point beyond which the device ceases to adequately perform its intended function and is therefore only marginally useful or possibly useless. Thus the exceeding of a real-time performance deadline results in a substantially noticeable difference 184, relative to a musical tempo, between an intended arrival time 186 of a string 14 at a new pitch 192 and an actual arrival time 188 of string 14 at new pitch 192. As mentioned above, a total actuation time in the example was contemplated at 83 milliseconds. To put this into a musical perspective, 83 milliseconds is the duration of one sextuplet at the stated tempo of 120 beats per minute. Only very advanced musicians can play notes this fast, so from that perspective a delay of 83 milliseconds does not exceed a real-time performance deadline, particularly since a very slight anticipation of the beat when tapping to initiate pitch change operation 172, would result in the new motor position occurring on the beat rather than one sextuplet behind the beat as shown in FIG. 13. In other words, the dot 190 shown moves to the left by an amount equal to the difference 184. This anticipation can also be built into control signal generator 34 as discussed above thereby allowing the user to tap his foot right on the beat and have the string 14 arrive at new pitch 192 at approximately the same time. One other factor to consider is that there will always be a small amount of time required for string 14 to "settle in" to the destination pitch since the arrival is quite abrupt and the deceleration of sting 14 results in some bouncing effect when it stops. In practice this issue is a minor one, particularly with a well written motor control routine which decelerates smoothly, as are known in the art; so for the purposes of this discussion we assume that string 14 arrives at new pitch 192 at the same instant that motor 60 arrives at new motor position 160 and does not include any time to "settle in". We can therefore conclude that in all examples provided above the system 10 of this first embodiment is capable of meeting an applicable real-time performance deadline.

To generalize the discussion beyond the examples provided, it is important to analyze the real-time constraints of a pitch alteration system before determining if those constraints have been met. The method is as follows. First, determine the tempo at which the music is to be played. Slower tempos are more forgiving than fast ones. In the example above it can easily be seen that a slowing down of the tempo widens the space between beats thereby reducing the ratio of the difference 184 over the time per beat. Next, determine the type of real-time pitch change operation 172 to be performed since the longer the amount of travel, the longer the amount of time required to complete the operation. Then determine if there are any performance factors, like anticipating the beat, that can help to close the gap between the intended arrival time 186 and the actual arrival time 188. Once these constraints are known then a measured amount of time required to actuate a pitch change can be evaluated against the intended completion of the task relative to the tempo. If the discrepancy between these two factors is too great to yield acceptable music results, then the system is said to exceed the real-time performance deadline. In practice it has been determined that the first embodiment of the present invention does not exceed real-time performance deadlines in almost all situations and therefore provides distinct advantages over the prior art.

First Embodiment

Relative Pitch Function

FIGS. 11 and 12 provide an example of one of the many novel musical possibilities which is achievable with the first embodiment of the present invention due specifically to the relative pitch functionality of the device. FIG. 11 shows two signal streams 174 of relative pitch change requests 142 which have been generated by a single or two separate pitch change operations 172. FIG. 12 shows the resultant pitch of string 14 after compensation calculation 150. The larger wave 142*b* is generated by first activating the manual pitch change operation 170 for the function and then by executing a back and forth sliding movement within an active zone 45 of a control signal generator 34 which has been defined for the purpose. One simple way to implement such a control function is by assigning MIDI continuous controllers to the slide zone, then assigning those same controllers to the specific frequency range shown in FIG. 11. Other protocols are also suitable. The smaller wave is generated by first creating an automatic pitch change operation 168 which generates an endlessly looping stream 174 of relative pitch change requests 142 which has a relatively short period and a total variation of about 20 cents (assuming that each tick on the y axis is equal to a semitone). This stream of requests 174 is what creates the vibrato effect. It should be noted that controller 52 may include various types of smoothing algorithms to insure that the discreet messages sent actually end up producing a smooth variation in motor position. Once the automatic pitch change operation 168 has been created, the user simply turns it on and off by "pressing" a virtual button on control signal generator 34 which calls up the program. Thus the musical result of the implemented relative pitch functionality in this case enables the user to start a vibrato effect and then have the pitch of a string dynamically track a sliding movement of his toes along a virtual slider, all the while the shorter period vibrato follows the larger pitch movements caused by the motion of the foot. Furthermore, the same vibrato effect can also be called up relative to a completely different pitch change operation 172 than shown here and it will have the same effect. This is not possible with prior art systems.

In another example, if there is a MIDI implementation, a second manual pitch change operation 170 could be programmed to receive the same continuous controller resulting from the sliding motion of the toes as the larger wave 142*b*. This second manual pitch change operation 170 is the same as the first manual pitch change operation 170 except that it is programmed for the neighboring string and includes a variable delay that causes its pitch changes to track sometimes behind its neighbor and sometimes ahead, thus creating a polyphonic chorusing effect as the two neighboring strings oscillate slightly in and out of tune, all while the pitches are generally traveling along the bigger pitch wave 142*b*. In practice a musician can create hundreds or even thousands of these various pitch change operations, store them in patches and libraries, and experiment with different combinations. One skilled in the art will recognize that there are many permutations of these basic parameters possible. However, the key point to note is that the implementation of a second layer on top of the absolute motor position layer is what enables such simple creation of complex musical results, many ramifications of which have never been heard before.

In addition to the relative pitch possibilities discussed above, another very useful ramification of relative pitch implementation is that it greatly simplifies the switching of musical keys. The capo is a widely popular tool for guitars because it bars all strings at a particular fret, thereby allowing the musician to play songs in the exact same way except in a different key. There are two primary problems though with capos: they frequently make the guitar go out of tune and they reduce the number of frets available for playing. The inventive device of the first embodiment provides an alternative to the standard capo by simply altering the pitch of all strings up or down by the same amount. For example, singers frequently find that a tune is too high for their range. It is therefore desirable to drop the key of the tune down by 2 to 4 semitones. Due to the relative pitch implementation provided, a key change like this is as simple as having a single pitch change operation 172 which drops all strings down by say 3 semitones. Then the user can play as always and all pitch change operations 172 will still function the same only now all pitches are 3 semitones lower. In some embodiments multiple current value fields 146 are implemented so that standard key changes can be stored each in their own in current value field 146, thereby simplifying the accounting.

First Embodiment

Pitch Change Effects

As mentioned above, the first embodiment of the present invention provides both an apparatus and a method for creating a new type of polyphonic chorus effect. Standard chorus effects for electric guitars and the like are very popular and widely available. The basic operating principle of a chorus unit is that it mixes an original audio signal with delayed and pitch modulated copies of itself rendering an effect similar to multiple voices in a choir which are all singing slightly out of tune with each other. Stereo chorus units mix the effect across the stereo field to enhance the sound. Therefore we will refer to a standard chorus effect as an effect caused by multiple similar sounds varying in phase and pitch relative to each other. The advanced pitch control capabilities of the first embodiment of the present invention enable a new means of creating both a standard chorus effect as well as a new chorus-like effect that we will refer to as polyphonic chorus.

A standard chorus effect is created by the first embodiment by first creating an automatic pitch change operation 172 which first alters the pitch of two neighboring strings such that the strings are at the same pitch. For example, a first string has a home position pitch 135 of E and a second string has a home position pitch of the B below said first string's pitch of E. Initial activation of pitch change operation 172 causes the first string to lower down to a D and the second string to raise up to a D. Then the user defines a sequence of slight pitch alterations for each string, which are not necessarily regular like a vibrato, and stores them as part of the automatic pitch change operation 168. Next slide zones on control signal generator 34 are associated with a depth of pitch alteration as defined for the sequence and a rate of change of pitch alteration for the two affected strings. Once the pitch change operation is created, the user activates it at any time and slides his toes through the slide zones to effect chorus parameters or stops sliding to let the chorusing continue as the current settings.

A polyphonic chorus is created by the first embodiment in the same manner as described above for creating the standard chorus effect except that the effect is applied to any two or more strings which are tuned to any pitch. In this way, each string in a chord, for example, can have its own chorus effect instead of prior art chorus effects for guitar which only work with the monophonic guitar output. In other words, a typical guitar chorus effect for a chord merges all of the audio information from each string in the chord down to one signal and then applies a chorus effect to that monophonic source. The inventive device of the first embodiment allows the chorus effect to apply right to the string itself thereby enabling a polyphonic approach to chorusing.

In addition to chorusing effects, the inventive system 10 of the first embodiment also provides an apparatus and method for semiautomatic stringed instrument playing. A system is provided which can automatically execute the mechanical tensioning requirements for bass lines, chords, and melodies which have been stored in sequences inside individual automatic pitch change operations 168. The sequence can "play" whatever the stored pitch changes are at any stored or real-time modifiable tempo. The system is semi-automatic though because it does not activate the strings; this task is reserved for the performer. And there is a very good reason for it. The activation of the string is frequently the most significant mode of expressiveness available to the performer. One can hit the strings very hard for an aggressive effect or strum them very gingerly for a sweet effect. Thus the semiautomatic playing mode enables a performer to add a human "feel" to an otherwise rigid mechanical sequence. FIG. 14 provides a simple example of an automatic pitch change operation 168 as it plays a sequence over time. As can be seen, the pitch of string 14 closely follows a stream of relative pitch change requests 142 from the initial activation 194 of automatic pitch change operation 168 by control signal generator 34 to the cessation 196 of automatic pitch change operation 168. In this particular case cessation 196 is not accompanied by a relative pitch change request 142 which returns pitch 162 back to the starting pitch and the sequence only plays through once. One skilled in the art will recognize that there are innumerable variations of automatic pitch change operations 168 possible and that there are also many types of commands other than just relative pitch change requests 142 which can also be a part of the automatic pitch change operation 168. For example, in some embodiments the automatic pitch change operation 168 contains a command which loops the sequence back to the beginning 194 once the end 196 is reached. In other embodiments a command forces the sequence to always begin from home position pitch 135, whereas in other embodiments the automatic pitch change operation 168 is always run relative to the current pitch when it was activated. Still other embodiments include a command which requires a return to the home position pitch 135 upon cessation of automatic pitch change operation 168. In other embodiments various commands are implemented which determine what happens if a user wants to abort the sequence in the middle. For example, in one embodiment a user activates a command with control signal generator 34 which prompts the currently playing automatic pitch change operation to end, but not until the last relative pitch change request 142 has been issued; another embodiment includes a command which ends the sequence immediately. Another embodiment allows a user to nest pitch change operations within pitch change operations allowing one pitch change operation to activate another in the middle of a sequence.

In addition to playing sequences of pitch changes the inventive device of the first embodiment also provides the ability of recording those sequences in real-time and then cycling, or looping, them to create novel means of expression. For example the graph of FIG. 14 can also For example the graph of FIG. 14 can also be viewed as a stream of relative pitch change requests 142 which are played by the user in real-time as control signal generator 34 records each request along with its time stamp in memory, similar to popular sequencing programs and looping effects which are widely available today, except that control signal generator 34 is only recording a stream of relative pitch change requests 142, or more broadly pitch change operations 172, and related commands. This feature in effect allows a user to enable recording mode, perform a first piece of music containing pitch change operations 172, then have all of the pitch change moves from the piece of music play over again exactly as they were played the first time. With each successive cycle of the sequence the user has the option of activating the strings in different ways to create different expressions from the first piece of music. Furthermore, the performer also has the option of playing a completely different second piece of music while the sequence is still playing the pitch changes from the first piece of music thereby enabling a wide range of additive musical experimentation.

As mentioned above, there are a wide variety of other pitch changing effects which are enabled by the first embodiment of the present invention, some of which have been mentioned. One skilled in the art will recognize that many others are possible.

First Embodiment

Benefits

The above description of the first embodiment of the real-time pitch alteration system 10 of the present invention has described numerous benefits and advantages over prior art systems. A partial list of some benefits and advantages is provided here to help focus the discussion on some of the reasons why the first embodiment has been developed. The first embodiment of the real-time pitch alteration system 10 of the present invention:

(a) provides a simple, small, lightweight, low cost system for altering the pitch of strings 14 on a stringed instrument 12;

(b) provides a large jump in mechanical efficiency from prior art systems via a camming surface actuator 30 which combines the benefits of a variable ratio camming surface, a load optimization calculation, and a concave camming surface to maximize reduction ratio for a given size;

(c) works without sound dampening springs and therefore focuses the vibration of string 14 onto the instrument for enhancement of sound production;

(d) provides a motorized control system with pitch compensation to account for operating conditions and instrument deformation, relative pitch change functionality for greatly enhanced expressive capabilities, and real-time control which enables string 14 pitch to track the movements of a user fast enough to meet real-time performance deadlines in most cases;

(e) provides a control signal generator based on real-time position measurement of a control object relative to an electromagnetic radiation sensor which reduces size and weight and increases a user's actuation speed and accuracy over prior art foot pedals;

(f) is quieter than most prior art motorized systems due to use of servo motor and high-efficiency camming surface actuator which eliminates need for high ratio gearing;

(g) allows the performer to rapidly alter the pitch of string 14 by a pre-determined amount while requiring no significant amount of force input by the performer;

(h) allows complete control of the pitch bending apparatus with the players feet, so that both hands can focus exclusively on plucking, strumming, fretting, etc.;

(i) allows the performer to create pedal steel-like temporary pitch alterations on fretted stringed instruments;

(j) provides a system which does not limit the total number of possible pitch changes by the number of pedals and levers provided (like on a pedal steel), but rather provides a system where the user can program as many pitch changes as desired then group them as patches and libraries;

(k) reduces non-linear effects which cause improper string return to a negligible level via rocker saddle 28, tension transfer portion 64 pulls on string directly in line with string, no rollers or posts, and no winding around posts;

(l) low part count and light weight allows actuation system 29 to be mounted under the bridge of a flat top acoustic guitar without requiring screws and without dampening the top;

(m) string 14 tension causes worm gear 80 to always mesh against the same side of worm 82 teeth thereby eliminating intonation errors due to backlash;

(n) entire actuation system 29 floats from instrument bridge 26 so that top vibrations are not shunted away to the back and sides;

(o) allows steep break angle over bridge 26 for increased downward pressure on bridge 26 and therefore enhanced tone;

(p) works with standard ball-end guitar strings, and ball can be easily threaded through a hole in the bridge 26 similar to standard acoustic guitars except the ball is captured by tension transfer portion 64 instead of a bridge pin;

(q) minimal changes required for retrofitting on existing guitars;

(r) actuator 30 does not require power from motor 60, a spring, or any other input force means to hold the string at any pitch in its full range of motion; holding force provided by friction between worm 82 and worm gear 80.

(s) provides the ability to create a multitude of pitch alteration effects which have never been heard before; and (t) provides all within one system the conventional functionality of pitch changers, string benders, tremolo bars, and, in some embodiments, automatic tuning devices.

One skilled in the art will recognize that there are many other benefits as well. Some of which will be discussed below as we examine additional embodiments of the present invention.

Second Embodiment

Structure

Figure 15:
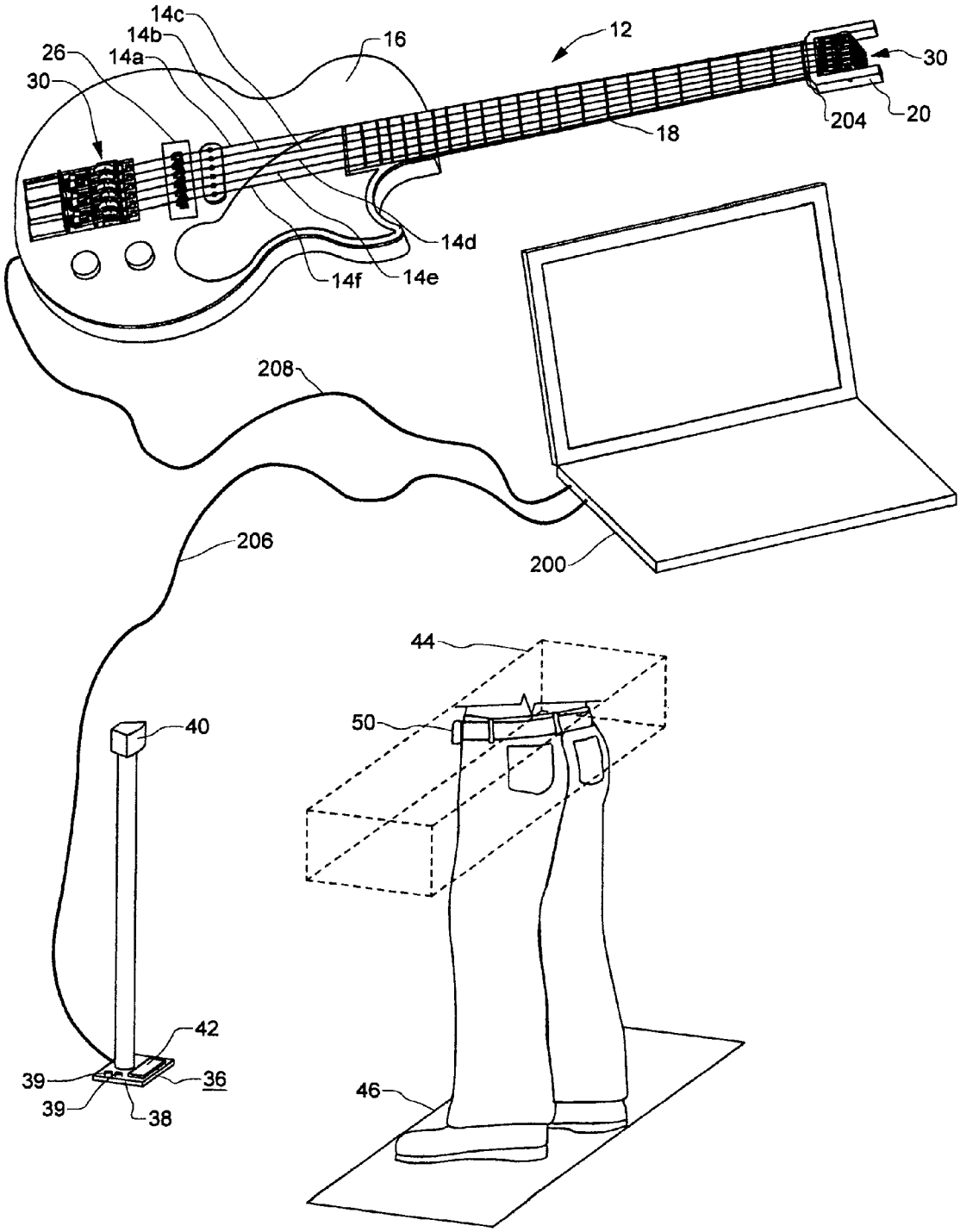
FIG. 15 shows a perspective view of pitch alteration system 10.

FIGS. 15 through 21 depict a second embodiment of a pitch alteration system 10 of the present invention which has been adapted for use with a stringed instrument 12. FIG. 15 shows a perspective view of pitch alteration system 10. Stringed instrument 12 is a typical electric guitar with 6 strings 14*a*, 14*b*, 14*c*, 14*d*, 14*e*, 14*f*, a body 16, a neck 18, a headstock 20, and a bridge 26. A standard set of headstock tuners has been replaced by hand-operated camming actuators 30 and a standard nut has been replaced by a roller nut 204. A typical electric guitar saddle has been replaced by 6 individually moveable rocker saddles 28. Six camming surface actuators 30, individually labeled as 30*a*, 30*b*, 30*c*, 30*d*, 30*e*, and 30*f*, are shown behind bridge 26. Camming surface actuators 30*a*-30*f* will be discussed in more detail below. Control cord 206 links a control signal generator 34 with a typical computer 200. Control cord 208 links computer 200 with controller 52. Control signal generator 34 is the same as in the first embodiment except that some control functions have been moved to computer 200 and control object 50 is attached to the user's belt buckle. Thus control object range 44 is now surrounding the user's waist and foot path markings 46 are now more generalized as they just show the user where to stand. Control unit 36 also elevates sensor 40 higher.

Figure 17:
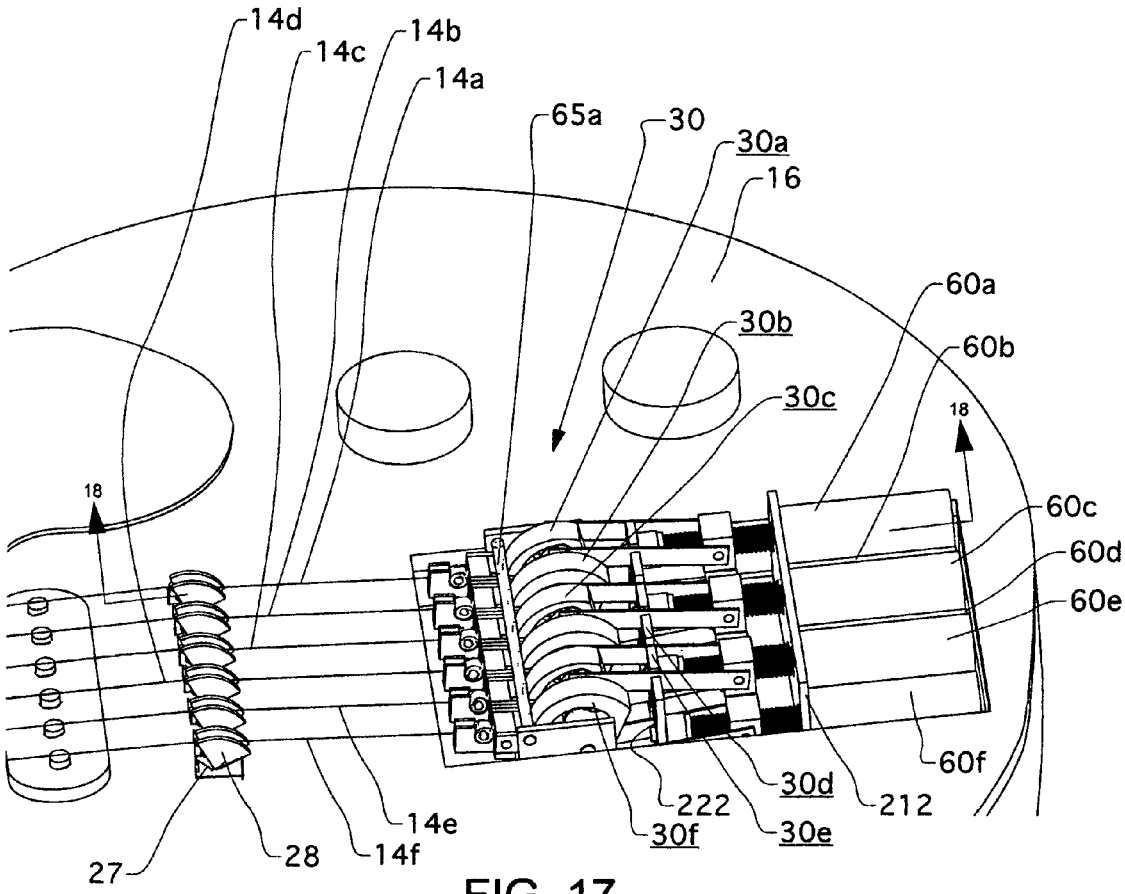
FIG. 17 shows a closer perspective of stringed instrument 12 focusing on the area behind bridge 26.
Figure 18:
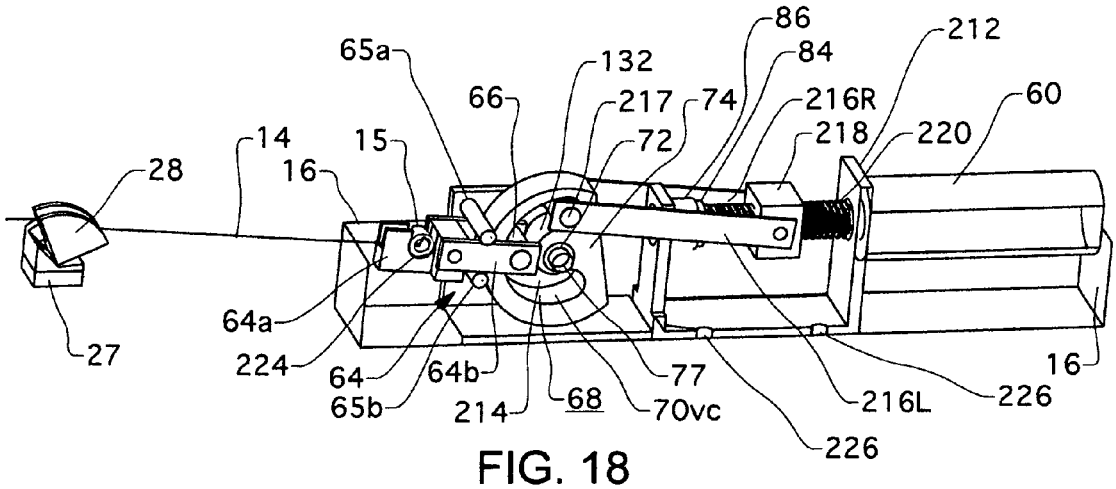
FIG. 18 shows a section of actuation system 29.

FIG. 17 shows a closer perspective of stringed instrument 12 focusing on the area behind bridge 26 and FIG. 18 shows a section of actuation system 29. Each string 14 is coupled with one actuation system 29. Each actuation system 29 comprises a motor 60 driving a camming surface actuator 30. Strings 14*a*-*f* are supported by rocker saddles 28 with rocker bases 27 and then couple with tension transfer portion 64 in a simpler arrangement than the first embodiment since tension transfer portion 64 is fully accessible on the second embodiment. String ball 15 simply drops into slot 224. Tension transfer portion 64 is again shown with string end 64*a* and bearing end 64*b*. Camming surface portion 68 here only comprises a single variable ratio concave camming surface 70*vc* instead two camming surfaces 70*vc*L and 70*cv*R as in the first embodiment thereby turning what was two grooves 128L and 128R on the first embodiment into a single slot 214 which goes all the way through rotating portion 74. And correspondingly, bearing means 66 only comprises a single ball bearing 66. In other embodiments similar to the second embodiment two ball bearings 66L and 66L ride on a single camming surface 70*vc*. In still other embodiments bearing means 66 comprises a low friction surface which slides on camming surface 70*vc*. Similar to the first embodiment tension on string 14 causes a rotational force on rotating portion 74 about axle portion 77, but in this case it is in the counterclockwise direction. Therefore alignment bushing 65*a* holds the upward force of tension transfer portion 64 when string 14 is under tension and alignment bushing 65*b* stops transfer portion 64 when rotating portion has been rotated fully counterclockwise as when a homing routine is executed. Rotating portion 74 rotates smoothly on axle 77 due to low friction plain bearing 72. Other types of low friction bearing means are also suitable. Separate bushings on each string 14 are replaced by the single upper alignment bushing 65*a* and lower alignment bushing 65*b*. The second embodiment replaces worm 82 and worm gear 80 with a lead screw 220, threaded nut 218, and linkage comprising linkage left member 216L and linkage right member 216R. Linkage bearing 217 fits into slot 214 in rotating portion 74 thereby interconnecting threaded nut 218 and rotating portion 74 since tension in string 14, as mentioned, supplies a counterclockwise force on rotating portion 74. Separate main brackets 76 and motor brackets 78 for each string on the first embodiment are now replaced by a much simpler arrangement of a single bracket 212 which holds all motors and actuators and fits easily in a routed out portion of body 16. Bracket 212 is secured to body 16 via fasteners (not shown) through screw holes 226. Motor 60 is contemplated in the second embodiment to be a stepper motor though other types are suitable. Motor 60 here is shown without an encoder means and thus works in an open loop positioning mode instead of the closed loop positioning system as shown for the first embodiment. In other embodiments stepper motors are used with closed loop positioning systems. The pulling force exerted on lead screw 220 by string 14 is resisted by thrust washer 84 and thrust bearing 86. Radial forces on lead screw 220 are resisted by a radial bearing 222 in bracket 212. Rotation of motor 60 results in rotation of lead screw 220 which moves threaded nut 218 and causes a rotation of rotating portion 74 as long as there is tension on string 14. As one skilled in the art will recognize, camming surface portion 68 has a much smaller value for $\theta_T$ (total rotational angle of rotating portion 74). However, the instrument, being an electric guitar, has about 30% less string 14 tension and therefore allows for an overall steeper slope $\phi$ of the camming surface portion for a given amount of motor torque available. Controller 52 (not pictured here) resides beneath actuation system or elsewhere in body 16.

Figure 19:
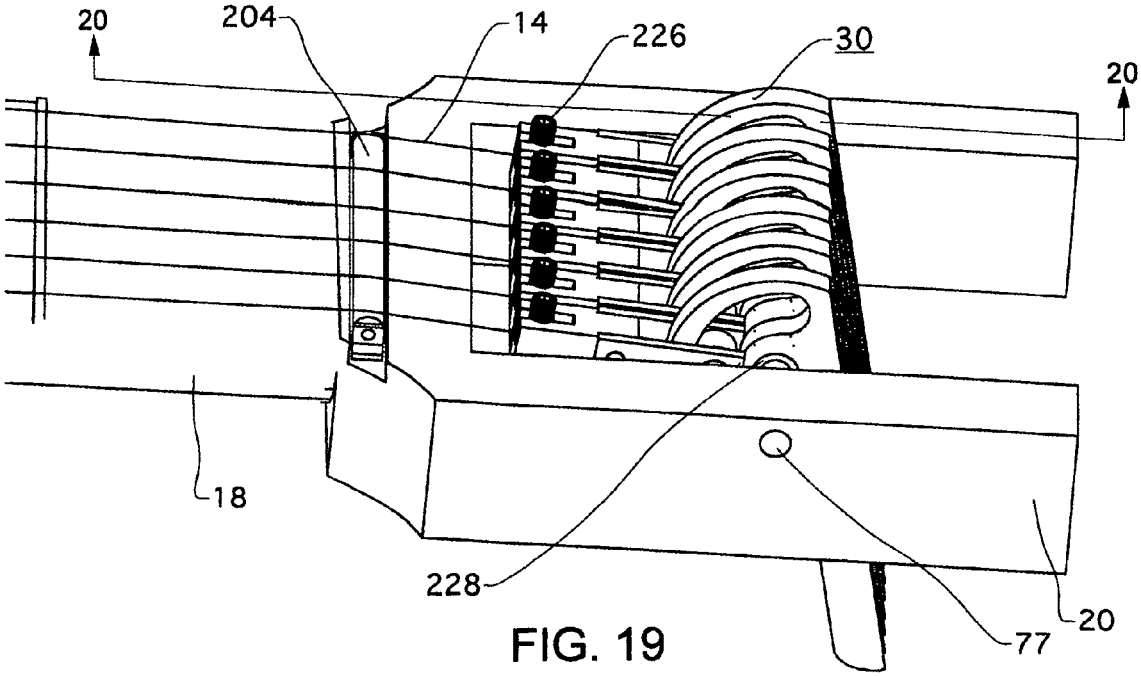
FIG. 19 shows a perspective view of headstock 20.
Figure 20:
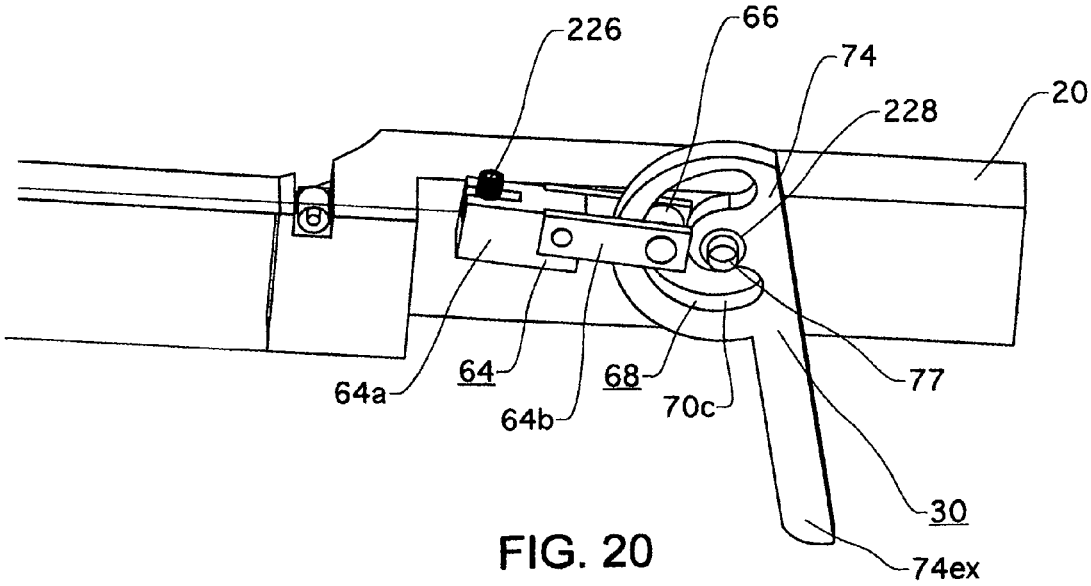
FIG. 20 shows a section of headstock 20.

Turning now to FIGS. 19 and 20, which show a perspective view and a section of headstock 20 respectively, the second embodiment of the present invention also demonstrates the use of a hand-operated camming surface actuator 30 which replaces the standard headstock tuners normally found on electric guitars. Each string 14 at the headstock end is coupled to a hand-operated camming surface actuator 30. Strings 14*a*-14*f* are supported by a low friction roller nut 204 and then terminate in the string end 64*a* of tension transfer portion 64. Strings 14*a*-14*f* are held by string screws 226. The bearing end 64*b* of tension transfer portion 64 and bearing means 66 are the same here as shown in FIGS. 17 and 18 for the other end of the strings 14 except that tension transfer portion 64 is slightly thinner to deal with the narrower string spacing typically found at the headstock. Accordingly, camming surface portion 68 is also thinner and in this embodiment is not optimized via a load optimization calculation. Therefore camming surface portion 68 in this embodiment comprises a single concave camming surface 70*c*. Rotating portion 74 comprises an extended portion 74*ex* for hand rotation. Axle portion 77 is supported by a friction bearing 228 which is adapted to resist the counterclockwise rotational force about axle portion 77 that results when string 14 is tensioned but allow movement by hand. One skilled in the art will notice that the less stringent alignment needs of this camming surface actuator 30 allow the elimination of alignment bushings 65*a* and 65*b*. However, other embodiments include an upper alignment bushing similar to bushing 65*a*. Another embodiment provides a hand-operated camming surface actuator 30 as described except that it further comprises at least one constant force spring 234 (see FIG. 23) to reduce an input force requirement of the user and reduce the amount of friction required to hold string 14 in tune. The addition of constant force springs 234 will be discussed in more detail below.

The shape of camming surface portions 68 for body actuators 30 for the second embodiment were determined with load optimization calculations. However, unlike the first embodiment, multiple measurements were done with various instruments in order to find the best ratio possible given a constraint to mass-produce many units of the same type. This process results in variable ratio camming surface portion 68 which does not perfectly match the load of any one string on any one instrument, but rather finds a shape which works well for all of them. Thus, the lower cost of mass production causes a slight drop in efficiency. As mentioned, the actuators 30 for the headstock are fixed ratio actuators and therefore did not include load optimization calculations, primarily due to the fact that maximizing load reduction is not as critical for a hand operated unit as it is for a motorized actuator as discussed. However, these actuators do still benefit from the enhanced load reduction inherent in the concave design. In another embodiment hand-operated camming surface actuators 30 do include a load optimization calculation which yields an approximately constant load regardless of string tension by varying the slope of camming surface portion 68 as discussed above. This approach provides the benefit of an improved feel for the user and also provides a built-in fine tuning capability due to the fact that the pitch will change faster when the tension is low and as it is increased close to the destination pitch the ratio increases thereby lowering the amount of pitch change per degree of rotation. In yet another embodiment, the hand-operated camming surface actuator 30 of the second embodiment further comprises a constant force spring as discussed below.

Figure 16:
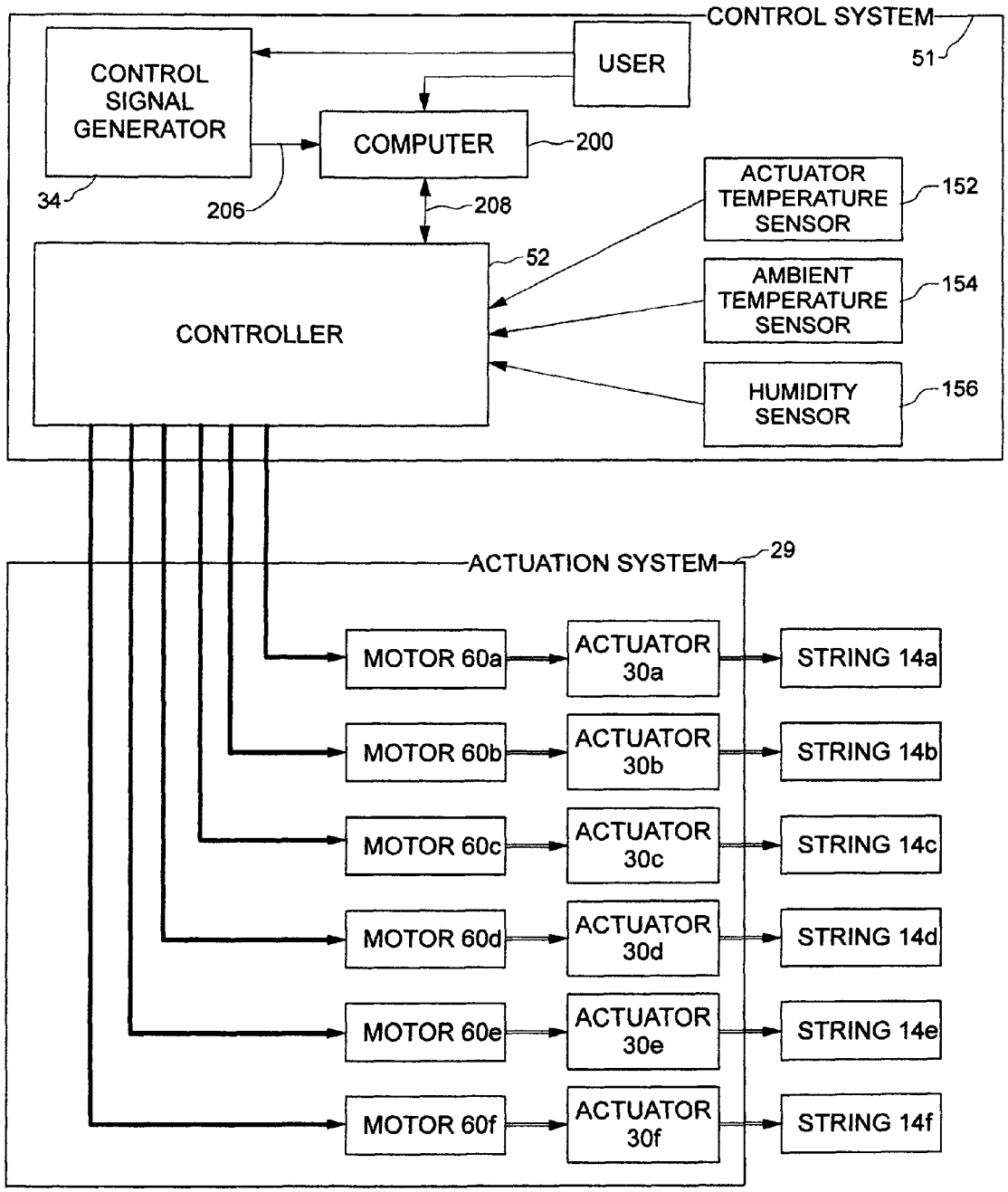
FIG. 16 provides a flow chart of the pitch alteration system 10 of the second embodiment which shows the flow of signals and power and the movement of elements in the system 10.

FIG. 16 provides a flow chart of the pitch alteration system 10 of the second embodiment which shows the flow of signals and power and the movement of elements in the system 10. The diagram specifically shows the flow of electrical signals, as represented by thin lines; electrical power, as represented by thick lines; and physical movement, as represented by double lines. In one aspect this embodiment differs from the first embodiment in that computer 200 provides some of the functions previously provided by controller 52 and control signal generator 34. The user can still activate pitch change operations via control signal generator 34, but the output of control signal generator 34 is now routed to computer 200 for processing, then computer 200 sends signals to controller 52 which result in pitch alterations of strings 14. As will be discussed in more detail below, computer 200 also handles compensation calculation 150, so now controller 52 receives input from sensors 152, 154, and 156 and routes sensor data to computer 200. As before, control signal generator 34 and controller 52 each have their own internal processing means and memory (both of which are not shown). Motors 60*a*-60*f* and actuators 30*a*-30*f* together form an actuation system 29. Rotation of motors 60*a*-60*f* causes each motor's respective actuator 30*a*-30*f* to move thereby causing the strings 14*a*-14*f* to move, which in turn results in a change in the pitch of strings 14*a*-14*f*. Each of the 6 motor 60/actuator 30 pairs is capable of independent motion yet controller 52 provides a centralized control function for all independent movements.

Figure 21:
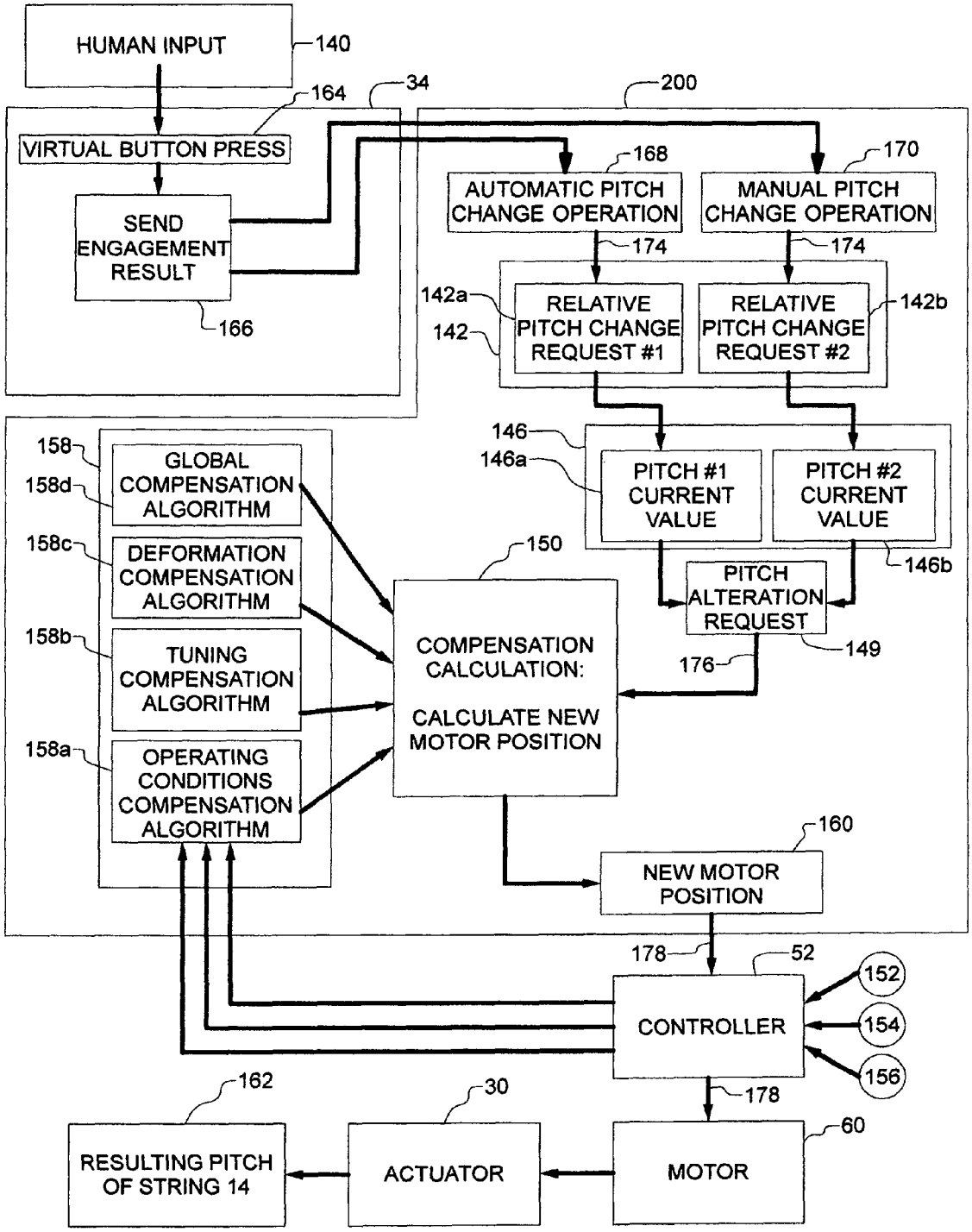
FIG. 21 depicts a flow chart showing an example of a pitch change operation 172.

FIG. 21 depicts a flow chart showing an example of a pitch change operation 172. Please note that this is a simplified example which shows only one automatic pitch change operation 168 and one manual pitch change operation 170 so that the basic routing of signals is understood. In actuality there could be a plurality of pitch change operations of both types (automatic and manual), only one pitch change operation of either type, a plurality of one type, or a plurality of the other type. This diagram is essentially the same as FIG. 10 except that it has been modified to show the different signal routings associated with the second embodiment. Human input 140 to create a virtual button press 164 on control signal generator 34 causes it to send the result 230 to computer 200. The result could be, for example, a MIDI program change or continuous controller or any suitable message which provides computer 200 with some information about user's interaction with control signal generator 34. Interaction in this embodiment involves movement of control object 50 into active zone 45. Other embodiments provide various types of interfaces such as foot pedals, switches, and the like. When computer 200 receives the message from control signal generator 34, it calls up an automatic pitch change operation 168 and a manual pitch change operation 170. The outputting of relative pitch change requests 142 is similar to the first embodiment except that they are not sent to controller 52 since current value fields 146 reside in computer 200. Computer 200 also handles compensation calculation 150 except that the calculation is processed based on pitch alteration request 149 (in semitones) instead of requested motor position 180. All of the compensation calculations discussed above for the first embodiment are similar here except that they each relate the pitch alteration request in semitones, or frequency in some embodiments, to the compensation variables. For example, the relationship between actuator temperature and $_{\Delta}P_{act}$ discussed above for the first embodiment is now a relationship between actuator temperature and $_{\Delta}f_{act}$, where $_{\Delta}f_{act}$ is the change frequency or pitch in semitones. This method allows all computation in computer 200 to be working with the pitch of the string until the very last step of sending new motor position 160 out to controller 52.

Sensors 152, 154, and 156 are connected to controller 52 inside guitar body 16, so controller routes sensor data to computer 200 which processes compensation calculation 150 then outputs a new motor position 160 to controller which outputs power to motor 60 which results in motor 60 moving to new motor position 60 within the constraints of a real-time performance deadline. Please note that the presence and locations of many of the items shown here are flexible. For example, in one embodiment the control signal generator 34 is eliminated and computer 200 provides all the functions shown for control signal generator 34 and computer 200 in FIG. 21.

Of note with the second embodiment is that it provides a solution which yields a significant increase in the amount of load reduction relative to depth required. For example, most prior art systems rely on a lever of some type which has to be at approximately 90 degrees to the angle of the strings 14. On typical electric guitars, which are only 1-2" deep, these lever systems are problematic.

Second Embodiment

Operation

Thus, the second embodiment provides a pitch alteration system 10 which comprises a motorized camming surface actuator 30 at one end of each string 14 and a hand-operated camming surface actuator 30 at the other end of each string 14. The basic operation, setup, tuning, pitch change operation 172 structure, and relative pitch functionality of the second embodiment are similar to the first embodiment. One difference is that the addition of computer 200 simplifies the electronics of control signal generator 34 and controller 52 thereby allowing those parts to be smaller, lighter, and less expensive. Computer 200 can also be optionally used to provide an improved graphical user interface for programming pitch change operations 172 and for displaying information about current pitch change operation 172 and control signal generator 34 setups. In one embodiment computer 200 provides a visual monitor for displaying the current functionality of specific active zones 34. For example, the screen could indicate that a first active zone 45 was for activating a particular chord change, a second active zone 45 was for activating a particular pitch change operation 172, etc. Computer 200 can also be used to program active zones and generally modify system parameters. In another embodiment all of the functions of computer 200 discussed for the second embodiment are contained within a different embodiment of control signal generator 34.

While the performance characteristics of the second embodiment are similar to the first embodiment, one difference is that the movement of control object 50 to the belt buckle changes the physical movements required to activate and control pitch change operations 172. For example, one could program active zones 45 so that standing straight up was just above the zones, but a slight dip of the knee yields a virtual "press". In another embodiment a side to side movement yields a "press", and in another embodiment a side to side movement yields a "slide". In still another embodiment a control object on the waist is combined with a control object as in the first embodiment. In other embodiments control objects are affixed to various parts of the body and clothing.

Hand-operated camming surface actuator 30 at headstock 20 also demonstrates the provision of real-time control even in an embodiment without a motorized control system. For example, standard guitar tuning mechanisms have to be geared so high that it is not practical to use the tuner for musical effect during performance. Hand-operated camming surface actuator 30, on the other hand, provides instant access in real time to the entire tension range by simply pushing or pulling on extended portion 74*ex* of rotating portion 74.

Some of the advantages of the second embodiment of the present invention are that it:

(a) allows optional control of the apparatus via the performer's knees, hands, or other body parts;

(b) provides a substitute for a standard headstock tuner which does not wrap string 14 around a post and therefore does not have non-liner string return problems;

(c) is adapted for use on electric guitars and as such the body actuation system fits much better than prior art systems within the typical 1-2" depth of most electric guitars; and (d) provides a very low parts count, low cost, and easy to mass produce solution.

Third Embodiment

Structure and Operation

Figure 22:
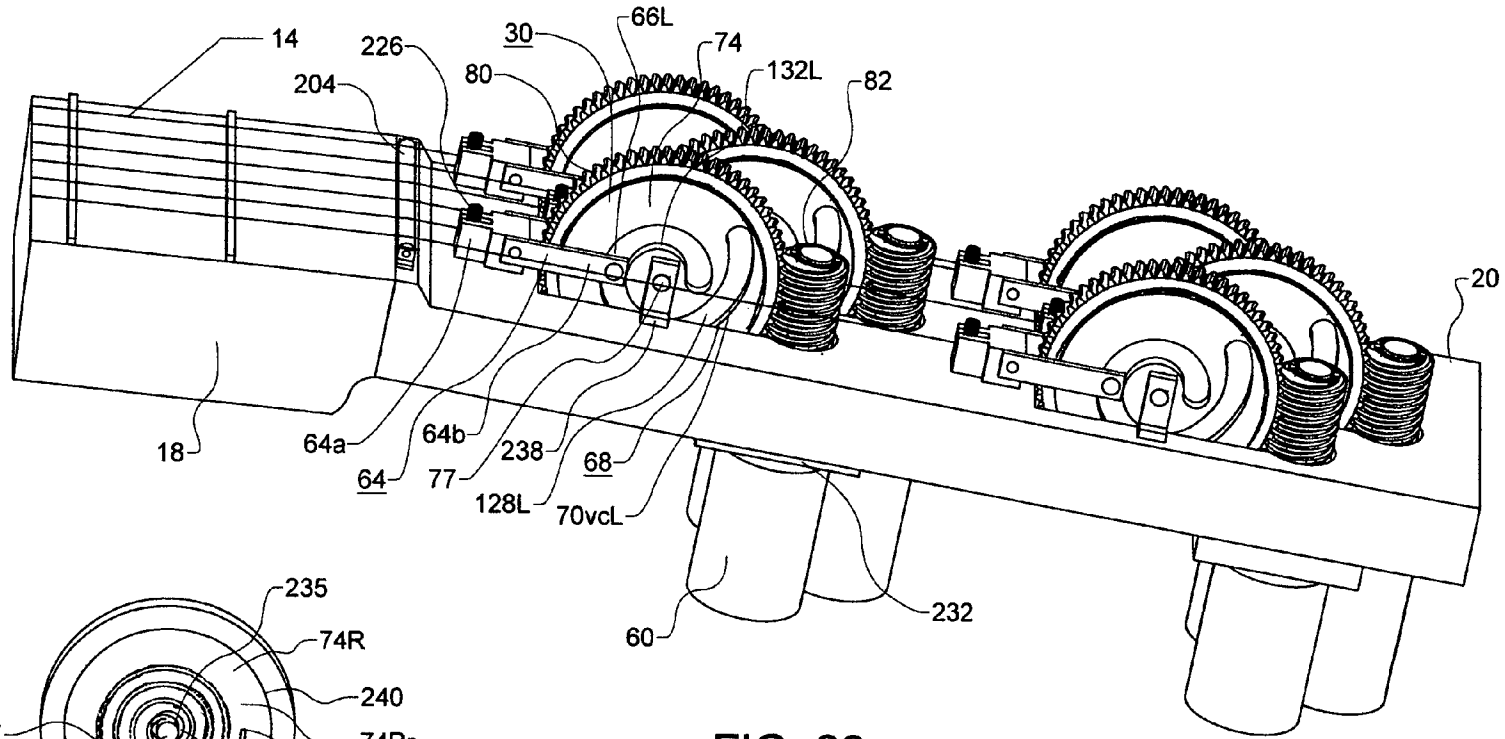
FIG. 22 shows a perspective view of a motorized actuation system 29 outfitted on a typical headstock 20.
Figure 23:
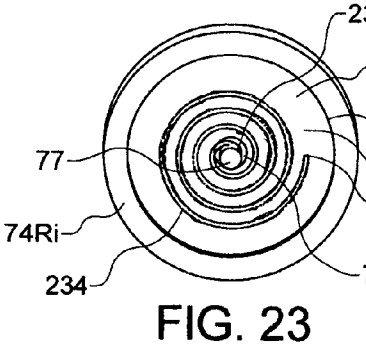
FIG. 23 shows rotating portion 74 in approximately the same orientation as FIG. 22 with rotating portion half 74L removed to reveal rotating portion half 74R with its inside 74Ri showing.
Figure 24:
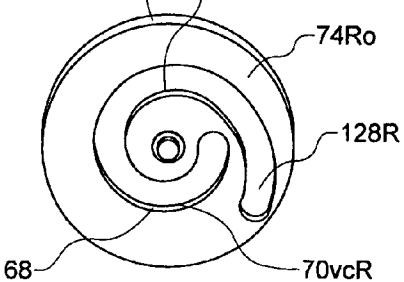
FIG. 24 shows rotating portion half 74R flipped over with its outside 74Ro showing.

Referring now to FIGS. 22 through 24, a third embodiment is provided for real-time pitch alteration system 10 which comprises a motorized actuation system 29 that is adapted for installation on the headstock 20 of a stringed instrument 12. This type of adaptation is particularly well-suited to instruments of the steel guitar family such as lap steels, pedal steels, and the like, though other stringed instruments are suitable as well. FIG. 22 shows a perspective view of the motorized actuation system 29 outfitted on a typical headstock 20. As shown in previous embodiments, each string 14, of which there are 6 in this case, is supported by a roller nut 204. Other types of low friction nuts such as a rocker nut, similar to rocker saddle 28, or other low friction slider type nuts are also suitable. As long as the nut supports string 14 as required for proper string length and minimizes nonlinear stick-slip friction effects, then it will be suitable for use with this embodiment. Each of the six strings 14 is connected to one of six identical actuation systems 29. Thus only one actuation system will be numbered in the figure and discussed herein. Actuation system 29 comprises a camming surface actuator 30 driven by a motor 60. Please note that it is not mandatory for all strings to include an actuation system 29. For example, in some embodiments only 3 of the six strings include an actuation system 29. Other combinations are also possible. Other stringed instruments with a large number of strings 14 such as harps, pianos, clavichords, electric clavichords, and the like, may include a plurality of actuation systems 29, but not necessarily connected to every string. Returning to FIG. 22, string 14 is held by string screw 226 which is threaded into string end 64*a* of tension transfer portion 64. Other arrangements of string holding are also suitable so long as string 14 is solidly coupled to tension transfer portion 64. Tension transfer portion 64 further comprises bearing end 64*b* which is forked to wrap around rotating portion 74 and which comprises bearing means 66 with miniature ball bearings 66L and 66R on opposite sides of rotating portion 74. Similar to the first embodiment, rotating portion 74 comprises grooves 128L and 128R on opposite sides with resulting camming surface portion 68 with associated camming surfaces 70*vc*L and 70*vc*R. All parts with an "R" in the part name are not viewable in FIG. 22 because they are on the back side. Rotating portion 74 rotates as before about axle portion 77 when motor 60 rotates worm 82 which is meshed with worm gear 80. As can be seen, motor 60 and worm 82 are oriented at approximately 90 degrees to headstock 20 in this embodiment and the motor/worm assembly is secured to headstock with headstock bracket 232 which contains thrusts and radial support bearings (not shown). As can be seen, camming surface portion 68 includes a longer angle of rotation $\theta_T$ (total rotational angle of rotating portion 74) than previously shown embodiments, so long in fact that it is greater than 360 degrees which makes the curve of camming surface portion 68 continue past its starting point in a spiral-like shape. The shape of camming surface portion 68 is concave and has been optimized with a load optimization calculation. The calculation in this case had two primary constraints: maximize efficiency of mechanism in primary operating range, then when string tension falls below a usable level, increase slope 4) of the camming surface portion more rapidly to enabling a quick loosening of string 14 to its completely relaxed state. This results in an actuator which can take a completely relaxed string 14 all the way up to its maximum possible tension level before breaking, thereby reducing or eliminating the need for a tuning mechanism at the other end of string 14. In one embodiment an extra long camming surface portion like this is utilized with a small fine tuning mechanism, as are known in the art, at the other end of string 14. Thus, camming surface portion 68 has a slope in the primary operating range of string 14 which results in an approximately constant torque requirement on motor 60, then the torque requirement actually increases slightly as the string tension drops below a usable level so that the string can be rapidly taken all the way down and removed.

Including FIGS. 23 and 24 in the discussion, we will now discuss another distinguishing aspect of the third embodiment. Though not viewable in FIG. 22, rotating portion 74 actually comprises to two halves, 74L and 74R, which are mirror images of each other. The two halves are detachably held together by fasteners or adhesives, neither of which are shown. FIG. 23 shows rotating portion 74 in approximately the same orientation as FIG. 22 with rotating portion half 74L removed to reveal rotating portion half 74R with its inside 74Ri showing. FIG. 24 shows rotating portion half 74R flipped over with its outside 74Ro showing. FIG. 23 reveals a recessed portion 74Rr of rotating portion inside 74Ri which when mated with the other half 74L with its recessed portion 74Lr (not shown) results in a cylindrical cavity within rotating portion 74, the boundary of which is indicated by the number 240. Contained within this cavity and secured at an outer end 236 to rotating portion half 74R and an inner end 235 to axle portion 77 is a constant force spring 234. As shown in other embodiments rotating portion 74 comprises rotating portion bearing 72 for smooth, low friction rotation about axle portion 77 which is fixed to headstock 20 via axle brackets 238. Constant force spring 234 is shown in its relaxed state, thus a rotation of rotating portion 74 in a clockwise direction tends to untwist constant force spring 234; and since constant force spring 234 wants to return to its original shape, it exerts an approximately constant torque on rotating portion 74 about axle portion 77. In other embodiments constant force spring is "wound up" by coiling it tighter around axle portion 77, and in still others a roll-type constant force spring is utilized as will be discussed below. Any spring which can be configured to exert an approximately constant rotational force on rotating portion 74 about axle portion 77 is suitable for this embodiment of the present invention. FIG. 24 also shows camming surface portion 68 with camming surface 70*vc*R and groove 128R with opposite wall of groove 132R as shown in the first embodiment.

The inclusion of a constant force spring 234 is an advancement in the art which follows naturally from the advancement of an optimized variable ratio camming surface actuator 30 as discussed herein. Once an actuator which converts the variable string load into an approximately constant force opposing an input force means has been provided, then a constant force spring 234 can be matched to the approximately constant string force thereby greatly reducing the required amount of input force. To my knowledge standard coiled extension springs and standard torsion springs (in a few rare cases) are used in all prior art pitch alteration devices which include some kind of bias means. There are two primary reasons for this: constant force springs are typically lower power than extension springs for the same size and prior art devices do not have a means for reducing the string load to a constant force. To clarify the discussion it is important to understand the difference between a constant force spring 234 and a typical spring. If a spring is not designated "constant force" then the spring is assumed to be a linear force spring and the force which the spring applies obeys Hooke's Law, which simply states that the force of the spring in its normal operating range is equal to the amount of spring displacement multiplied by a spring constant. Commercially available springs typically have a published spring constant for each spring. Thus, for pitch alteration systems one simply multiplies the amount of spring displacement by the constant to determine how much force is exerted at each point in the total throw of the mechanism. It follows then that the further that the spring is displaced the more force is applied by the spring. Though not as intuitive, it is also true that the spring is exerts its maximum force when the string is at its lowest tension. A constant force spring 234, on the other hand, does not obey Hooke's Law. As the spring is displaced, the force remains approximately constant instead of continually increasing. In a first type of constant force spring 234 the constant force spring 234 is constructed as a rolled ribbon of spring steel such that the constant force spring 234 is relaxed when it is fully rolled up. As it is unrolled, the restoring force comes primarily from the portion of the ribbon near the roll. Because the geometry of that region remains nearly constant as the constant force spring 234 unrolls, the resulting force is nearly constant. Constant force springs 234 are typically found in devices such as seat belt or cord rollup mechanisms because they are particularly useful at rolling things around spools. A second type of constant force spring 234 is the opposite of the first type: the constant force spring 234 is relaxed when it is fully unrolled. Other constant force springs 234 are relaxed when partially rolled.

Therefore the third embodiment comprises a constant force spring 234 which is located inside rotating portion 74 and which is wound up several times during assembly prior to installing tension transfer portion 64. Once tension transfer portion 64 is installed, and prior to installing worm 82, constant force spring 234 will force rotating portion 74 to rotate clockwise until bearing means 66 runs into the innermost ends of grooves 128L and 128R. In other words, constant force spring opposes the rotational force presented by string 14. Depending on string spacing and other size requirements, constant force spring can be sized to either provide a portion of the constant force load supplied by the string 14, the entire constant force load supplied by the string 14, or more than the constant force load supplied by the string 14. In most cases constant force spring 234 can be sized large enough to substantially reduce the required size of motor 60. It is also important to note that constant force spring 234 is not operating on the entire string 14 load since camming surface portion 68 greatly reduces string 14 load first. Therefore the small size and the nature of the operation of constant force spring 234 mean means that very little to no noticeable dampening of string 14 vibrations will result. This is not true of prior art systems where the coiled extension spring typically carries the full load, or in some cases even more than the full load of the string (when positioned with a less favorable moment arm).

Though not shown in the figures, the third embodiment also comprises a simplified control means. Instead of including control signal generator 34 as described above, the third embodiment comprises a standard MIDI foot pedal which communicates with a controller. The controller comprises a processor and memory and associated motor control circuitry. The user engages in the usual manner with the MIDI foot pedal to send MIDI messages such as continuous controllers and program changes to the controller. The controller translates these messages into control signals which vary the position of the motors 60 and thereby alter the pitch of strings 14. The controller is optionally outfitted with temperature and humidity sensors and a simple compensation algorithm so that a user can selectively choose compensation amounts for various pitch change operations 172.

Fourth Embodiment

Structure and Operation

Figure 25:
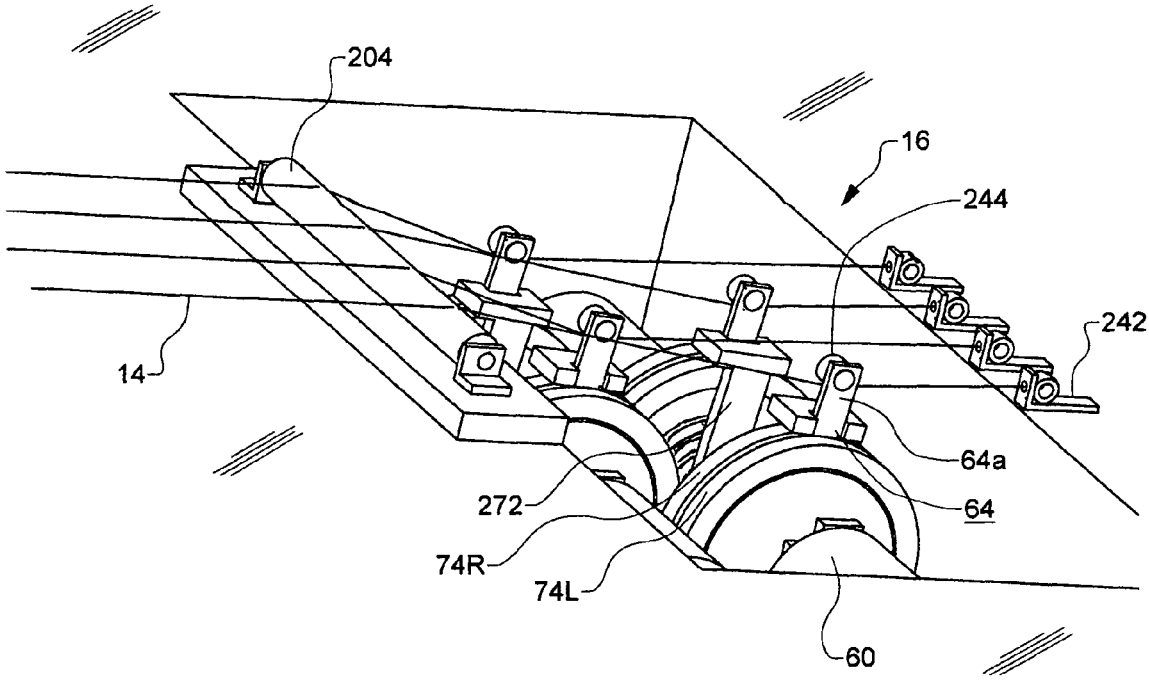
FIG. 25 shows a perspective view of actuation systems 29 coupled to strings 14.
Figure 26:
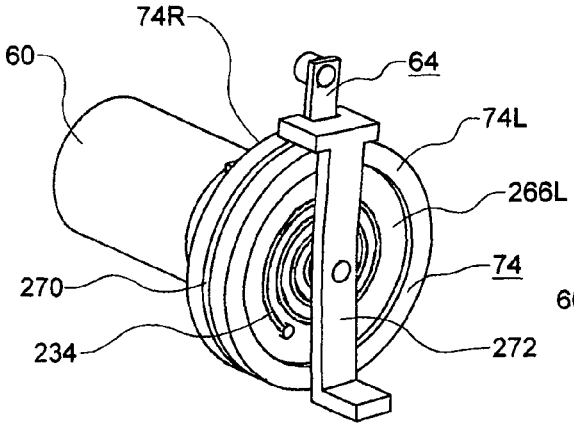
FIG. 26 shows a single camming surface actuator 30 and associated motor 60.
Figure 27:
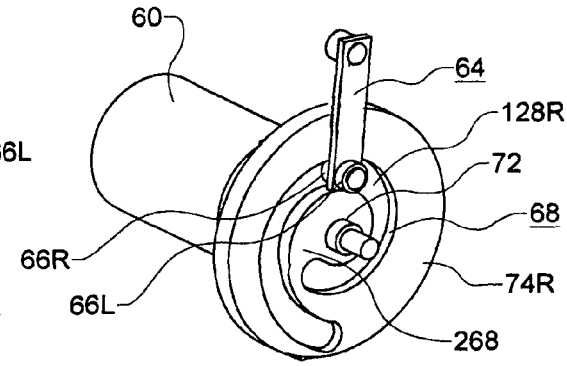
FIG. 27 shows the single camming surface actuator 30 with bracket 272 and rotating portion half 74L removed.

Referring now to FIGS. 25 through 27, we will review a fourth embodiment of the pitch alteration system 10 of the present invention. FIG. 25 shows a perspective view of actuation systems 29 coupled to strings 14. FIG. 26 shows a single camming surface actuator 30 and associated motor 60. FIG. 27 shows the single camming surface actuator 30 with bracket 272 and rotating portion half 74L removed. As discussed above, one technique which is used to reduce the amount of string 14 load that a pitch alteration system has to oppose is by simply securing both ends of string 14 to body 16 of instrument 12. Thus, there is provided a load reduction system and accompanying motorized actuation system 29 for devices of this type. FIG. 25 shows strings 14 which are secured to a headstock in the usual way (not shown) and body 16 of instrument 12 via string brackets 242. Like features to other discussed embodiments will be skipped. Instead of tension transfer portion 64 carrying the full load of string 14, string end 64*a* of tension transfer portion 64 comprises string roller 244 which rollably pulls on string 14 to increase the tension thereof. Rotating portion 74 in this embodiment is similar to the third embodiment except that the two halves 74R and 74L of rotating portion are reversed yielding an internal camming surface portion 68 and two external spring recesses 266L and 266R (266R not viewable), one on each side. Each external spring recess 266L and 266R contains a constant force spring 234 which operates in the same fashion as described for the third embodiment. In order to allow linear translation of tension transfer portion 64, each rotating portion half 74L and 74R comprises a raised portion 268 which results in a gap 270 between the two when they are assembled together. Bearing means 66 comprises two ball bearings 66L and 66R which ride in camming surface portion 68 which is created via grooves 128L and 128R as before. The shape of camming surface portion 68 is the same as the third embodiment and constant force springs 234 in this embodiment are contemplated to be approximately equal to the approximately constant string force which they oppose thereby eliminating the need for worm 82 and worm gear 80 and allowing for a very small motor 60. Bracket 272 secures assembly to body 16 and provides alignment function for tension transfer portion 64. Motor 60 is oriented 90 degrees to string line and parallel with the top of instrument 12.

String 14 tension causes tension transfer portion 64 to apply a pulling force on concave camming surface portion 68 which results in a clockwise rotational force of rotating portion 74 as shown in FIG. 27. This rotational force is approximately canceled by an opposite rotational force from constant force spring 234. The small difference between the two opposite forces is either less than the friction in the system, in which case there is no holding torque required of motor 60, or very small, in which case the holding torque on motor 60 is very small. Rotation of motor 60 causes tension transfer portion 64 to move linearly thereby altering the pitch of string 14. Thus a motorized actuation system 29 is provided which enables the use of low cost motors 60 due to the combination of a variable ratio concave camming surface actuator 30 and a constant force spring 234. In another embodiment similar to the fourth embodiment the two grooves 128L and 128R are replaced by a single groove 128L thereby necessitating an unbalanced configuration where rotating portion half 74L is thicker than 74R and tension transfer portion 64 comprises a single ball bearing 66L and the gap 270 is now moved to the right somewhat.

Additional Embodiments

Figure 28:
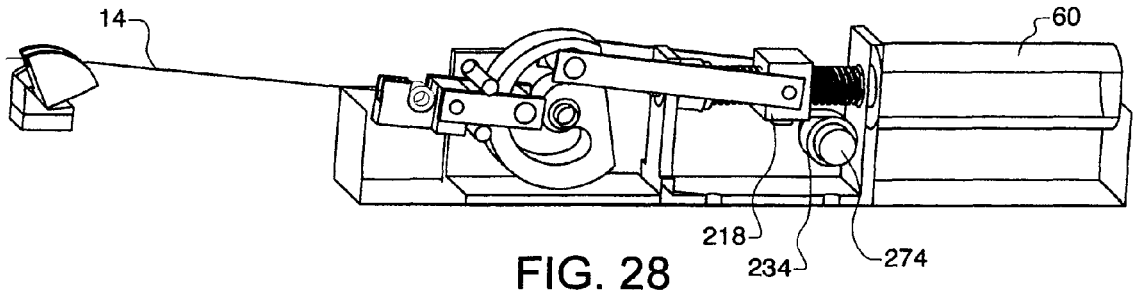
FIG. 28 provides a perspective view of an embodiment which is the same as the second embodiment except that constant force spring 234 has been added.
Figure 29:
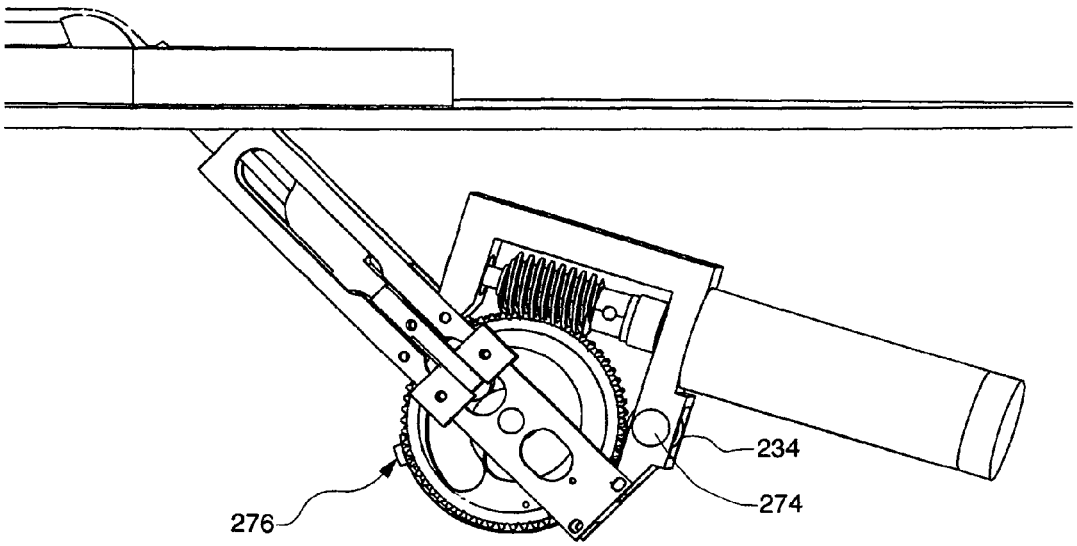
FIG. 29 provides a perspective view of the actuation system 29 of the first embodiment which has been outfitted with the same type of constant force spring 234 as shown in FIG. 28 except that it is connected to an unused portion of worm gear 80.
Figure 30:
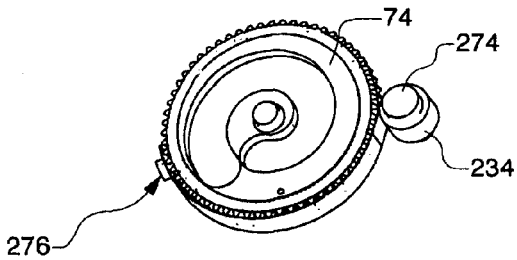
FIG. 30 shows rotating portion 74 and constant force spring 234 of the previous drawing in isolation so that constant force spring 234 can be better seen.

FIG. 28 provides a perspective view of an embodiment which is the same as the second embodiment except that constant force spring 234 has been added. Constant force spring 234 in this embodiment is of a type that is designed to unroll linearly as opposed to providing a torque about an axis. Constant force spring 234 is relaxed when completely rolled up around spring axle 274. It is attached to underside of threaded nut 218 thereby exerting a pulling force toward motor 60 when unrolled as the string tension is lowered and threaded nut 218 moves to the left. FIG. 29 provides a perspective view of the actuation system 29 of the first embodiment which has been outfitted with the same type of constant force spring 234 as shown in FIG. 28 except that it is connected to an unused portion 276 of worm gear 80. Furthermore, constant force spring 234 wraps around the outside of worm gear 80 as string 14 tension is lowered; thereby taking advantage of the fact that only the worm gear 80 teeth that are touching worm 82 at any one time are needed. FIG. 30 shows rotating portion 74 and constant force spring 234 of the previous drawing in isolation so that constant force spring 234 can be better seen.

Figure 31:
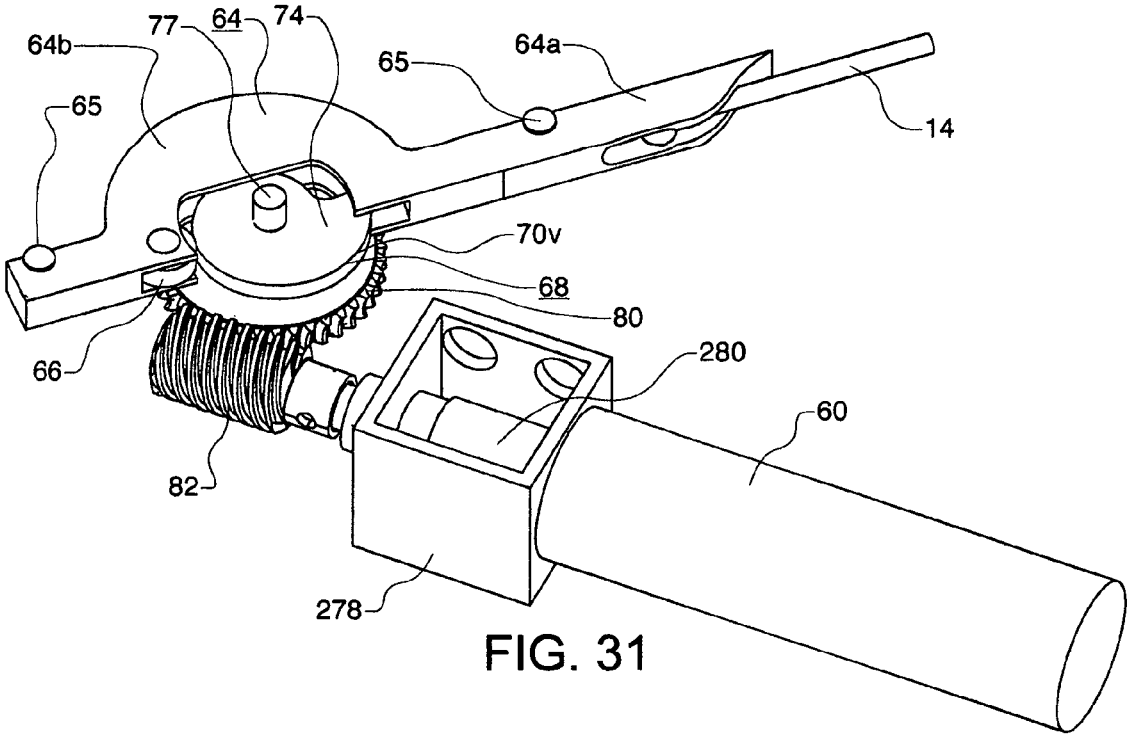
FIG. 31 provides a perspective view of an actuation system 29.
Figure 32:
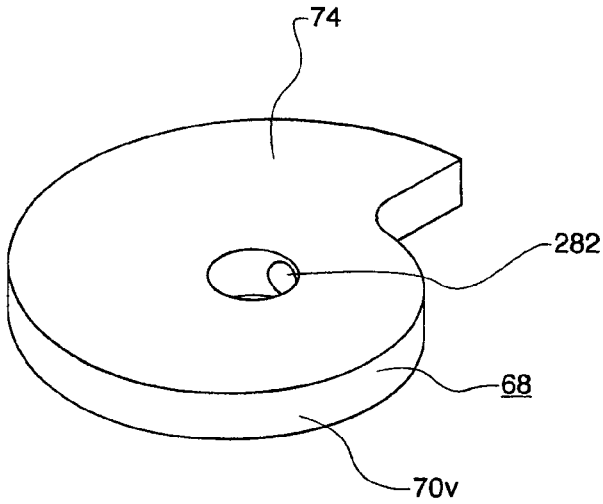
FIG. 32 provides a perspective view of rotating portion 74 in isolation with screw hole 282 for securing it to axle portion 77.

FIGS. 31 and 32 provide an embodiment where camming surface portion 68 comprises a variable ratio camming surface 70*v* which is on the exterior of rotating portion 74 and therefore does not face axle portion 74 as shown in some previous embodiments. FIG. 31 provides a perspective view of an actuation system 29 and FIG. 32 provides a perspective view of rotating portion 74 in isolation with screw hole 282 for securing it to axle portion 77. A bracket which wraps around the whole assembly and secures axle portion 77 to body 16 is not shown for clarity. String 14 is secured to tension transfer portion 64 which is held in alignment by alignment bushings 65 that ride in grooves in the main bracket which is not shown. Bearing means 66 is now riding on a camming surface portion 68 which is facing away from axle portion 77 instead of toward it as in previous embodiments described herein. Since the exterior surface of rotating portion 74 is now required for camming purposes, worm gear 80 is secured to axle portion 77 beside rotating portion 74. Motor 60 is held by motor bracket 278 which is secured to body 16 and has its shaft connected to coupling 280 which is connected to worm 82. Thus rotation of motor 60 rotates worm 82 which rotates worm gear 80. Rotation of worm gear 80, since it is connected to the same axle portion 77 as rotating portion 74, causes rotation of rotating portion 74 and thereby linear movement of tension transfer portion 64, which causes a change in the pitch of string 64. While this embodiment does not provide the load reduction benefit of concave camming surface 70*c* (where load is further reduced by the radius decreasing with increasing tension), it does include a variable ratio camming surface 70*v* which has been optimized with an optimization calculation. This sacrifice is made in this case because of the reduced cost of production for the rotating portions in this embodiment. In a similar embodiment a constant force spring is added to further reduce the torque on motor 60. In another similar embodiment tension transfer portion 64 further comprises a pivot axis which is anchored to body 16. String tension is applied to tension transfer portion 64 in the same way, but tension transfer portion pivots about pivot axis instead of requiring alignment bushings. Other embodiments provide this same pivoting design except with concave camming surfaces 70*c* as discussed above; and still others provide this same pivoting design except with variable ratio concave camming surfaces 70*vc*L and 70*vc*R as discussed above.

CONCLUSIONS, RAMIFICATIONS, AND SCOPE

The above disclosure provides a method and apparatus for string load reduction and real-time pitch alteration on stringed instruments. A string load is substantially reduced with a camming surface actuator so that the pitch can be rapidly manipulated by ari input force which is generated by human power or an electronically controlled motor. Variable ratio camming surfaces, concave camming surfaces, and combined variable ratio concave camming surfaces are provided along with a load optimization calculation which determines the shape of a variable ratio camming surface. A camming surface portion is rotated about an axis and a tension transfer portion carries a load of a string and rides on the camming surface portion thereby altering the pitch of the string. Multiple embodiments are described including a constant force pitch alteration device, a motorized control system with pitch compensation and real-time tracking of string pitch to multiple relative input signals, a control signal generator based on real-time position measurement of a control object relative to an electromagnetic radiation sensor, and methods for generating mechanical looping, vibrato, and polyphonic chorus effects which can be automated or dynamically controlled by a user. Many other embodiments are provided as well.

Thus the reader will see that at least one embodiment of the present invention provides a simple, small, lightweight, low cost system for altering the pitch of a string or strings on a stringed instrument in real time. Other benefits include but are not limited to:

(a) improved mechanical efficiency and load reduction for a given size;
(b) works without sound dampening springs;
(c) provides compensation for operating conditions and instrument deformation;
(d) provides relative pitch change functionality for greatly enhanced expressive capabilities;
(e) provides an improved control means which reduces size and weight and increases a user's actuation speed and accuracy over prior art foot pedals;
(f) allows complete control of the pitch bending apparatus with the players feet, so that both hands can focus exclusively on plucking, strumming, fretting, etc.;
(g) is quieter than most prior art motorized systems;
(h) allows the performer to rapidly alter the pitch of a string by a pre-determined amount while requiring no significant amount of force input by the performer;
(i) allows the performer to create pedal steel-like temporary pitch alterations on fretted stringed instruments;
(j) provides a system which does not limit the total number of possible pitch changes by the number of pedals and levers provided (like on a pedal steel), but rather provides a system where the user can program as many pitch changes as desired then group them as patches and libraries;
(k) reduces non-linear string return effects to a negligible level;
(l) provides the ability to create a multitude of pitch alteration effects which have never been heard before; and
(m) provides all within one system the conventional functionality of pitch changers, string benders, tremolo bars, and, in some embodiments, automatic tuning devices.

Accordingly the present invention may be characterized in one aspect as a load reduction device for string tension adjustment systems comprising: (a) a tension transfer portion adapted to carry a portion of a load of a string on a stringed instrument, transfer the load to a camming surface portion by means of a bearing riding thereon, and to vary the tension of the string by moving in response to a rotation of a rotating portion; (b) a rotating portion providing structural support for the camming surface portion and rotating about an axis of rotation when an input force is applied thereto; (c) an axle portion being substantially collinear with said axis of rotation and providing structural support for the rotating portion; and (d) a variably sloped camming surface portion with an increasing radial distance from the axis of rotation to each point thereon and a shape which reduces a required input force across a range of string tension levels by a substantially continuously variable mechanical advantage ratio, wherein a slope of the camming surface portion is relative to a direction of force supplied by the tension transfer portion to the camming surface portion and the variable mechanical advantage ratio results from a variation in the slope, which is predetermined by a load optimization calculation.

The present invention may be characterized in another aspect as a pitch alteration device for stringed instruments comprising: (a) a tension transfer portion adapted to carry a portion of a load of a string on a stringed instrument, transfer the load to a camming surface portion by means of a bearing riding thereon, and to vary the tension of the string by moving in response to a rotation of a rotating portion; (b) a rotating portion providing structural support for the camming surface portion and rotating about an axis of rotation when an input force is applied thereto; (c) an axle portion being substantially collinear with said axis of rotation and providing structural support for the rotating portion; and (d) a camming surface portion facing the axis of rotation and having a length and a varying radial distance from the axis of rotation to each point thereon, wherein the tension transfer portion applies a pulling force on the camming surface portion in a direction substantially away from the axis of rotation when the string is under tension.

The present invention may also be described as a stringed instrument with a real-time system for altering the pitch of at least one of its strings comprising: (a) a plurality of actuators, each coupled to its own string and having a range of motion which at least corresponds to a range of pitches of its respective string; (b) a like plurality of motors for driving the actuators, wherein each motor has a motor position corresponding to a position of its respective actuator and therefore to a pitch of its respective string, is describable by at least one of a number of motor rotation counts and fractions thereof, a number of steps, and an amount of linear displacement, and is operable in a first direction for increasing the tension on its respective string and a second direction for decreasing the tension on its respective string; and (c) a control means having a processor means and a memory means and being capable of generating at least two relative pitch change requests for the same string within an interval of time, a timing of when the at least two relative pitch change requests are generated being controllable in real-time by at least one of a human, a computer, a machine, and a processor; calculating a new motor position based on a function of the at least two pitch alteration requests and at least one compensation algorithm; and sending power to the motor which results in the motor moving to the new motor position. The real-time system is further capable of actuating a pitch change within the constraints of a real-time performance deadline, a failure to meet the deadline resulting in a substantially noticeable difference, relative to a musical tempo, between an intended arrival time of a string at a new pitch and an actual arrival time of the string at the new pitch.

In yet another aspect the present invention may be described as a control signal generator for a pitch alteration device for a stringed instrument comprising in combination: (a) a control object for variable positioning by a user within a predetermined range of motion; and (b) a stationary control unit comprising and an electromagnetic radiation sensor for real-time detection of a position of the control object, a signal processing means for converting the position into an electrical signal which is representative of the position, and a signal output means for sending a corresponding electrical signal to the pitch alteration device which alters a pitch of a string on the stringed instrument in response to the corresponding electrical signal.

The above disclosure is sufficient to enable one of ordinary skill in the art to practice the invention, and provides the best mode of practicing the invention presently contemplated by the inventor. While there is provided herein a full and complete disclosure of some embodiments of this invention, it is not desired to limit the invention to the exact construction, dimensional relationships, and operation shown and described. Various modifications, alternative constructions, changes and equivalents will readily occur to those skilled in the art and may be employed, as suitable, without departing from the true spirit and scope of the invention. Such changes might involve alternative materials, components, structural arrangements, sizes, shapes, forms, functions, operational features or the like. Other changes might include various types of mounting brackets and assemblies to hold camming surface actuators. For example, the first embodiment described herein could be modified to provide a mounting assembly which attached the actuators 30 to the back or rear of the inside of instrument 12; isolation mounts could also be included to isolate actuators from other parts of instrument 12. Or brackets could be slotted to provide heat-sinking capability. Other variations on rotating portion 74 are also possible such as milling grooves 128L and 128R right into the side of a worm gear thus combining rotating portion 74 and worm gear 80 into a single part. Other variations on signal routing are also possible such as wireless communication between control signal generator 34 and controller 52.

Therefore, the above description and illustrations should not be construed as limiting the scope of the invention, which is defined by the appended claims.

What is claimed is:

1. A pitch alteration device for a stringed instrument, said instrument comprising a plurality of strings, a tension of a first string of said plurality of strings being substantially independently adjustable by said pitch alteration device, thereby enabling said first string to vibrate at a plurality of pitches, said pitch alteration device comprising:

(a) a tension transfer portion adapted to engage with said first string, comprising a bearing portion, and being movable into a plurality of positions relative to said instrument, said plurality of positions substantially corresponding to said plurality of pitches;

(b) a rotating portion rotating about an axis of rotation when an input force is applied thereto; and (c) a camming surface portion being supported by and rotating with said rotating portion and having a curved length and a substantially increasing radial distance from said axis of rotation to substantially all sequential points along said curved length, said sequential points substantially corresponding to said plurality of positions of said tension transfer portion;

wherein said bearing portion is adapted to apply a string force of substantially consistent general direction to said camming surface portion while said rotating portion rotates, said string force being proportional to said tension; such that a rotation of said rotating portion causes said camming surface portion to rotate and said bearing portion to move, substantially resulting in a change in a pitch of said first string.

2. The device according to claim 1 wherein said camming surface portion further comprises at least one variable ratio camming surface, a shape of said at least one variable ratio camming surface being predetermined by a load optimization calculation, said calculation optimizing said shape relative to said string force.

3. The device according to claim 1 wherein said camming surface portion comprises a first camming surface located on a front face of said rotating portion and a second camming surface located on a rear face of said rotating portion, said first camming surface being of substantially similar curvature to said second camming surface, said tension transfer portion being forked to partially wrap around said rotating portion, said bearing portion comprising a first bearing riding on said first camming surface and a second bearing riding on said second camming surface.

4. The device according to claim 1 wherein said pitch alteration device further comprises a constant force spring, said constant force spring engaging said rotating portion, delivering an approximately constant force output to said rotating portion over a range of motion, and reducing said input force.

5. The device according to claim 1 wherein said input force is applied by human muscle power.

6. The device according to claim 1 wherein said input force is applied by a motor.

7. The device according to claim 1 wherein said camming surface portion comprises a substantially continuously variable mechanical advantage ratio, said mechanical advantage ratio resulting from a variable slope of said camming surface portion and increasing as said tension increases such that a minimum amount of said input force required to increase said tension of said first string is approximately constant for most of said plurality of positions of said tension transfer portion, said variable slope being relative to a radius of said rotating portion.

8. The device according to claim 1 further comprising an alignment bushing portion for slidably supporting said tension transfer portion in order to maintain proper alignment between said bearing portion and said camming surface portion when said tension transfer portion is moved between said plurality of positions.

9. The device according to claim 1 further comprising an axle portion, said axle portion being substantially collinear with said axis of rotation, providing structural support for said rotating portion, and being structurally supported by a body of said stringed instrument.

10. The device according to claim 1 further comprising an axle portion, said axle portion being substantially collinear with said axis of rotation, providing structural support for said rotating portion, and being structurally supported by a bracket portion, said bracket portion being structurally supported by a body of said stringed instrument.

11. The device according to claim 1 wherein a first end of said first string is removably secured to said instrument and said tension transfer portion further comprises a string capturing portion for removably coupling with a second end of said first string.

12. The device according to claim 1 wherein said first string comprises a first end and a second end, each of the ends being removably secured to said instrument, and said tension transfer portion comprises a slidable or rollable string engagement portion, said engagement portion pushing or pulling said first string at a point away from the ends when said tension transfer portion is moved between said plurality of positions.

13. The device according to claim 1 wherein said rotating portion further comprises a driven rotary transmission portion and said input force is applied by a driving rotary transmission portion.

14. The device according to claim 12 wherein said driven rotary transmission portion is a worm gear and said driving rotary transmission portion is a worm.

15. The device according to claim 12 wherein said driving rotary transmission portion is coupled to a motor having angular positions which substantially correspond to said plurality of positions of said tension transfer portion, said motor being controlled by a control portion, said control portion receiving commands and outputting power to said motor according to predefined parameters, whereby input to said control portion results in power output to said motor, rotational movement of said motor and said rotating portion, movement of said tension transfer portion, and a change from a first pitch of said first string to a second pitch of said first string.

16. The device according to claim 15 wherein said motor is selected from a group containing a servo motor, a stepper motor, a brushed direct-current motor, a brushless direct-current motor, an alternating current motor, a radio-controlled servo, a torque motor, a pneumatic motor, and a hydraulic motor.

17. The device according to claim 15 wherein said control portion executes operations based on input from input sources, said input sources including at least one of a temperature sensor, a humidity sensor, a position sensor, a strain gage, an accelerometer, a frequency detection portion, a pickup, and an electronic actuator.

18. The device according to claim 17 wherein said electronic actuator comprises at least one of a foot pedal, a footswitch, a switch, a lever, a knob, a dial, a slider, a computer, a pressure sensor, a breath controller, a touchpad, a velocity sensor, a joystick, a laser-interrupt sensor, an infrared sensor, an ultrasonic distance sensor, an air pressure sensor, a shock sensor, a flex angle sensor, a strain gage, a tilt sensor, an acceleration-deceleration sensor, a magnetic field sensor, a motion detector, and a touch sensor.

19. The device according to claim 17 wherein said electronic actuator communicates with said control portion using at least one of a MIDI protocol and a high-speed communications protocol.

20. The device according to claim 1 wherein said bearing portion comprises a rollable or slidable element for minimizing friction between said bearing portion and said camming surface portion during rotation of said rotating portion.

21. The device according to claim 1 wherein said camming surface portion further comprises at least one concave camming surface.

22. A pitch alteration device for a stringed instrument, said instrument comprising a plurality of strings, a tension of a first string of said plurality of strings being substantially independently adjustable by said pitch alteration device, thereby enabling said first string to vibrate at a plurality of pitches, said pitch alteration device comprising:

(a) a tension transfer portion adapted to engage with said first string, comprising a bearing portion, and being movable into a plurality of positions relative to said instrument, said plurality of positions substantially corresponding to said plurality of pitches; and (b) a camming surface portion adapted to rotate about an axis of rotation and having a curved length and a substantially increasing radial distance from said axis of rotation to substantially all sequential points along said curved length, said sequential points substantially corresponding to said plurality of positions of said tension transfer portion;

wherein a string force of said first string is proportional to said tension and said bearing portion is adapted to apply said string force to said camming surface portion in a substantially consistent general direction and to move in response to a rotation of said camming surface portion such that said rotation results in a change in a pitch of said first string.

23. The device according to claim 22 further comprising a rotating portion adapted to support said camming surface portion and rotate about said axis of rotation when an input force is applied thereto.

24. The device according to claim 22 wherein said camming surface portion further comprises at least one variable ratio camming surface, a shape of said at least one variable ratio camming surface being predetermined by a load optimization calculation, said calculation optimizing said shape relative to said string force.

25. The device according to claim 23 wherein said camming surface portion comprises a first camming surface located on a front face of said rotating portion and a second camming surface located on a rear face of said rotating portion, said first camming surface being of substantially similar curvature to said second camming surface, said tension transfer portion being forked to partially wrap around said rotating portion, said bearing portion comprising a first bearing riding on said first camming surface and a second bearing riding on said second camming surface.

26. The device according to claim 23 wherein said pitch alteration device further comprises a constant force spring, said constant force spring engaging said rotating portion, delivering an approximately constant force output to said rotating portion over a range of motion, and reducing said input force.

27. The device according to claim 23 wherein said input force is applied by human muscle power.

28. The device according to claim 23 wherein said input force is applied by a motor.

29. The device according to claim 23 wherein said camming surface portion comprises a substantially continuously variable mechanical advantage ratio, said mechanical advantage ratio resulting from a variable slope of said camming surface portion and increasing as said tension increases such that a minimum amount of said input force required to increase said tension of said first string is approximately constant for most of said plurality of positions of said tension transfer portion, said variable slope being relative to a radius of said rotating portion.

30. The device according to claim 22 further comprising an alignment bushing portion for slidably supporting said tension transfer portion in order to maintain proper alignment between said bearing portion and said camming surface portion when said tension transfer portion is moved between said plurality of positions.

31. The device according to claim 23 further comprising an axle portion, said axle portion being substantially collinear with said axis of rotation, providing structural support for said rotating portion, and being structurally supported by a body of said stringed instrument.

32. The device according to claim 23 further comprising an axle portion, said axle portion being substantially collinear with said axis of rotation, providing structural support for said rotating portion, and being structurally supported by a bracket portion, said bracket portion being structurally supported by a body of said stringed instrument.

33. The device according to claim 22 wherein a first end of said first string is removably secured to said instrument and said tension transfer portion further comprises a string capturing portion for removably coupling with a second end of said first string.

34. The device according to claim 22 wherein said first string comprises a first end and a second end, each of the ends being removably secured to said instrument and said tension transfer portion comprises a slidable or rollable string engagement portion, said engagement portion pushing or pulling said first string at a point away from the ends when said tension transfer portion is moved between said plurality of positions.

35. The device according to claim 23 wherein said rotating portion further comprises a driven rotary transmission portion and said input force is applied by a driving rotary transmission portion.

36. The device according to claim 35 wherein said driven rotary transmission portion is a worm gear and said driving rotary transmission portion is a worm.

37. The device according to claim 35 wherein said driving rotary transmission portion is coupled to a motor having angular positions which substantially correspond to said plurality of positions of said tension transfer portion, said motor being controlled by a control portion, said control portion receiving commands and outputting power to said motor according to predefined parameters, whereby input to said control portion results in power output to said motor, rotational movement of said motor and said rotating portion, movement of said tension transfer portion, and a change from a first pitch of said first string to a second pitch of said first string.

38. The device according to claim 37 wherein said motor is selected from a group containing a servo motor, a stepper motor, a brushed direct-current motor, a brushless direct-current motor, an alternating current motor, a radio-controlled servo, a torque motor, a pneumatic motor, and a hydraulic motor.

39. The device according to claim 37 wherein said control portion executes operations based on input from input sources, said input sources including at least one of a temperature sensor, a humidity sensor, a position sensor, a strain gage, an accelerometer, a frequency detection portion, a pickup, and an electronic actuator.

40. The device according to claim 39 wherein said electronic actuator comprises at least one of a foot pedal, a footswitch, a switch, a lever, a knob, a dial, a slider, a computer, a pressure sensor, a breath controller, a touchpad, a velocity sensor, a joystick, a laser-interrupt sensor, an infrared sensor, an ultrasonic distance sensor, an air pressure sensor, a shock sensor, a flex angle sensor, a strain gage, a tilt sensor, an acceleration-deceleration sensor, a magnetic field sensor, a motion detector, a capacitance sensor, a touch screen, and a touch sensor.

41. The device according to claim 39 wherein said electronic actuator communicates with said control portion using at least one of a MIDI protocol and a high-speed communications protocol.

42. The device according to claim 22 wherein said bearing portion comprises a rollable or slidable element for minimizing friction between said bearing portion and said camming surface portion.

43. The device according to claim 22 wherein said camming surface portion further comprises at least one concave camming surface.

* * * * *